US008047281B2

(12) United States Patent
Costa et al.

(10) Patent No.: US 8,047,281 B2
(45) **Date of Patent: *Nov. 1, 2011**

(54) SLEEVE FOR EXPANDABLE TUBULAR THREADED CONNECTION AND METHOD OF EXPANDING TUBULAR THEREOF

(75) Inventors: Scott Costa, Kingwood, TX (US); Joel Gray Hockaday, Tomball, TX (US); Kevin K. Waddell, Houston, TX (US); Lev Ring, Houston, TX (US); Michael Bullock, Houston, TX (US); Robert Lance Cook, Katy, TX (US); Larry Kendziora, Needville, TX (US); David Paul Brisco, Duncan, OK (US)

(73) Assignee: Enventure Global Technology, L.L.C., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/772,073

(22) Filed: Apr. 30, 2010

(65) Prior Publication Data

US 2010/0282477 A1 Nov. 11, 2010

Related U.S. Application Data

(63) Continuation of application No. 10/500,745, filed as application No. PCT/US02/39418 on Dec. 10, 2002, now abandoned.

(60) Provisional application No. 60/346,309, filed on Jan. 7, 2002.

(51) Int. Cl.
*E21B 23/00* (2006.01)
*E21B 23/02* (2006.01)
*E21B 43/10* (2006.01)

(52) U.S. Cl. ..... 166/207; 166/206; 166/242.6

(58) Field of Classification Search ..... 285/33, 285/334, 390, 355; 166/206, 207, 242.6
See application file for complete search history.

(56) References Cited

U.S. PATENT DOCUMENTS

| | | | | |
|---|---|---|---|---|
| 2,273,017 | A * | 2/1942 | Boynton | 285/89 |
| 5,083,608 | A * | 1/1992 | Abdrakhmanov et al. | 166/55 |
| 6,021,850 | A * | 2/2000 | Wood et al. | 166/380 |
| 6,263,968 | B1 * | 7/2001 | Freeman et al. | 166/313 |
| 6,564,875 | B1 * | 5/2003 | Bullock | 166/382 |
| 7,740,076 | B2 * | 6/2010 | Costa et al. | 166/380 |

* cited by examiner

*Primary Examiner* — William P Neuder
*Assistant Examiner* — Cathleen Hutchins
(74) *Attorney, Agent, or Firm* — Conley Rose, P.C.; Derek V. Forinash

(57) ABSTRACT

A tubular sleeve overlaps the threaded connection between a pair of adjacent tubular members that are to receive an expansion device for radial expansion and plastic deformation of the threaded tubular connection.

21 Claims, 56 Drawing Sheets

SLEEVE FOR EXPANDABLE TUBULAR THREADED CONNECTION AND METHOD OF EXPANDING TUBULAR THEREOF

CROSS-REFERENCE TO RELATED APPLICATIONS

The present application is a continuation of U.S. patent application Ser. No. 10/500,745, filed on Jul. 6, 2004 now abandoned, which was the U.S. National Phase filing under 35 U.S.C. 371 for PCT/US02/39418, filed on Dec. 10, 2002, which claimed the benefit of U.S. Provisional Patent Application Ser. No. 60/346,309, filed on Jan. 7, 2002, the disclosures of which are incorporated herein by reference.

BACKGROUND OF THE INVENTION

This invention relates generally to oil and gas exploration, and in particular to forming and repairing wellbore casings to facilitate oil and gas exploration.

During oil exploration, a wellbore typically traverses a number of zones within a subterranean formation. Wellbore casings are then formed in the wellbore by radially expanding and plastically deforming tubular members that are coupled to one another by threaded connections. Existing methods for radially expanding and plastically deforming tubular members coupled to one another by threaded connections are not always reliable or produce satisfactory results. In particular, the threaded connections can be damaged during the radial expansion process.

The present invention is directed to overcoming one or more of the limitations of the existing processes for radially expanding and plastically deforming tubular members coupled to one another by threaded connections.

SUMMARY OF THE INVENTION

According to one aspect of the present invention, a method of radially expanding and plastically deforming a first tubular member and a second tubular member is provided that includes inserting a threaded end portion of the first tubular member into an end of a tubular sleeve having an internal flange; inserting a threaded end portion of the second tubular member into another end of the tubular sleeve; threadably coupling the threaded end portions of the first and second tubular members within the tubular sleeve; and displacing an expansion device through the interiors of the first and second tubular members to radially expand and plastically deform portions of the first and second tubular members; wherein the internal diameters of the radially expanded and plastically deformed portions of the first and second tubular members are equal.

According to another aspect of the present invention, a method of radially expanding and plastically deforming a first tubular member and a second tubular member is provided that includes inserting a threaded end portion of the first tubular member into an end of a tubular sleeve; coupling the end of the tubular sleeve to the threaded end portion of the first tubular member; inserting a threaded end portion of the second tubular member into another end of the tubular sleeve; threadably coupling the threaded end portions of the first and second tubular member within the tubular sleeve; coupling the other end of the tubular sleeve to the threaded end portion of the second tubular member; and displacing an expansion device through the interiors of the first and second tubular members to radially expand and plastically deform portions of the first and second tubular members; wherein the internal diameters of the radially expanded and plastically deformed portions of first and second tubular members are equal.

According to another aspect of the present invention, a method of radially expanding and plastically deforming a first tubular member and a second tubular member is provided that includes inserting an end of a tubular sleeve having an external flange into an end of the first tubular member until the external flange abuts the end of the first tubular member, inserting the other end of the tubular sleeve into an end of a second tubular member, threadably coupling the ends of the first and second tubular member within the tubular sleeve until both ends of the first and second tubular members abut the external flange of the tubular sleeve, and displacing an expansion device through the interiors of the first and second tubular members.

According to another aspect of the present invention, a method of radially expanding and plastically deforming a first tubular member and a second tubular member is provided that includes inserting an end of the first tubular member into an end of a tubular sleeve having an internal flange into abutment with the internal flange; inserting an end of the second tubular member into another end of the tubular sleeve into abutment with the internal flange; coupling the ends of the first and second tubular member to the tubular sleeve; and displacing an expansion device through the interiors of the first and second tubular members to radially expand and plastically deform the ends of the first and second tubular members; wherein the internal diameters of the radially expanded and plastically deformed ends of the first and second tubular members are equal.

According to another aspect of the present invention, an apparatus is provided that includes a first tubular member comprising a threaded end portion; a second tubular member comprising a threaded end portion; and a tubular sleeve that receives, overlaps with, and is coupled to the threaded end portions of the first and second tubular members; wherein the threaded end portion of the first tubular member is threadably coupled to the threaded end portion of the second tubular member; wherein portions of the first and second tubular members are radially expanded and plastically deformed; and wherein the internal diameters of non-threaded portions of the radially expanded and plastically deformed portions of the first and second tubular members are equal.

According to another aspect of the present invention, an apparatus is provided that includes a first tubular member comprising a threaded end; a second tubular member comprising a threaded end; and a tubular sleeve that is received within, overlaps with, and is coupled to the threaded ends of the first and second tubular members; wherein the threaded end of the first tubular member is threadably coupled to the threaded end of the second tubular member; and wherein the threaded ends of the first and second tubular members are radially expanded and plastically deformed.

According to another aspect of the present invention, an apparatus is provided that includes a first tubular member; a second tubular member; and a tubular sleeve that receives, overlaps with, and is coupled to the threaded ends of the first and second tubular members; wherein the ends of the first and second tubular members are in circumferential compression and the tubular sleeve is in circumferential tension; wherein the ends of the first and second tubular members are radially expanded and plastically deformed; and wherein the internal diameters of the radially expanded and plastically deformed ends of the first and second tubular members are equal.

According to another aspect of the present invention, an apparatus is provided that includes a first tubular member comprising a threaded end portion; a second tubular member comprising a threaded end portion; a tubular sleeve that receives, overlaps with, and is coupled to the threaded end portions of the first and second tubular members; one or more first resilient locking members for locking the first tubular member to the tubular sleeve; and one or more second resilient locking members for locking the second tubular member to the tubular sleeve; wherein the threaded end portions of the first and second tubular members are in circumferential compression and the tubular sleeve is in circumferential tension; wherein portions of the first and second tubular members are radially expanded and plastically deformed; and wherein the internal diameters of radially expanded and plastically deformed portions of the first and second tubular members are equal.

According to another aspect of the present invention, a method of radially expanding and plastically deforming a first tubular member and a second tubular member is provided that includes inserting a threaded end portion of the first tubular member into an end of a tubular sleeve having an internal flange; inserting a threaded end portion of the second tubular member into another end of the tubular sleeve; threadably coupling the threaded end portions of the first and second tubular members within the tubular sleeve; and displacing an expansion device through the interiors of the first and second tubular members to radially expand and plastically deform portions of the first and second tubular members; wherein the internal diameter of at least one of the non-threaded portion of the first tubular member and the non-threaded portion of the second tubular member is equal to the internal diameter of the internal flange of the tubular sleeve.

According to another aspect of the present invention, a method of radially expanding and plastically deforming a first tubular member and a second tubular member is provided that includes inserting a threaded end portion of the first tubular member into an end of a tubular sleeve having an internal flange; inserting a threaded end portion of the second tubular member into another end of the tubular sleeve; threadably coupling the threaded end portions of the first and second tubular members within the tubular sleeve; and displacing an expansion device through the interiors of the first and second tubular members to radially expand and plastically deform portions of the first and second tubular members; wherein, after the radial expansion and plastic deformation, the internal diameter of at least one of the non-threaded portion of the first tubular member and the non-threaded portion of the second tubular member is equal to the internal diameter of the internal flange of the tubular sleeve.

According to another aspect of the present invention, a method of radially expanding and plastically deforming a first tubular member and a second tubular member is provided that includes inserting a threaded end portion of the first tubular member into an end of a tubular sleeve having an internal flange; inserting a threaded end portion of the second tubular member into another end of the tubular sleeve; threadably coupling the threaded end portions of the first and second tubular members within the tubular sleeve; and displacing an expansion device through the interiors of the first and second tubular members to radially expand and plastically deform portions of the first and second tubular members; wherein a portion of the first tubular member abuts an end face of the internal flange of the tubular sleeve; and wherein a portion of the second tubular member abuts another end face of the internal flange of the tubular sleeve.

According to another aspect of the present invention, a method of radially expanding and plastically deforming a first tubular member and a second tubular member is provided that includes inserting a threaded end portion of the first tubular member into an end of a tubular sleeve; coupling the end of the tubular sleeve to the threaded end portion of the first tubular member; inserting a threaded end portion of the second tubular member into another end of the tubular sleeve; threadably coupling the threaded end portions of the first and second tubular member within the tubular sleeve; coupling the other end of the tubular sleeve to the threaded end portion of the second tubular member; and displacing an expansion device through the interiors of the first and second tubular members to radially expand and plastically deform portions of the first and second tubular members; wherein the internal diameter of at least one of the non-threaded portion of the first tubular member and the non-threaded portion of the second tubular member is equal to the internal diameter of the internal flange of the tubular sleeve.

According to another aspect of the present invention, a method of radially expanding and plastically deforming a first tubular member and a second tubular member is provided that includes inserting a threaded end portion of the first tubular member into an end of a tubular sleeve; coupling the end of the tubular sleeve to the threaded end portion of the first tubular member; inserting a threaded end portion of the second tubular member into another end of the tubular sleeve; threadably coupling the threaded end portions of the first and second tubular member within the tubular sleeve; coupling the other end of the tubular sleeve to the threaded end portion of the second tubular member; and displacing an expansion device through the interiors of the first and second tubular members to radially expand and plastically deform portions of the first and second tubular members; wherein, after the radial expansion and plastic deformation, the internal diameter of at least one of the non-threaded portion of the first tubular member and the non-threaded portion of the second tubular member is equal to the internal diameter of the internal flange of the tubular sleeve.

According to another aspect of the present invention, a method of radially expanding and plastically deforming a first tubular member and a second tubular member is provided that includes inserting a threaded end portion of the first tubular member into an end of a tubular sleeve; coupling the end of the tubular sleeve to the threaded end portion of the first tubular member; inserting a threaded end portion of the second tubular member into another end of the tubular sleeve; threadably coupling the threaded end portions of the first and second tubular member within the tubular sleeve; coupling the other end of the tubular sleeve to the threaded end portion of the second tubular member; and displacing an expansion device through the interiors of the first and second tubular members to radially expand and plastically deform portions of the first and second tubular members; wherein a portion of the first tubular member abuts an end face of the internal flange of the tubular sleeve; and wherein a portion of the second tubular member abuts another end face of the internal flange of the tubular sleeve.

According to another aspect of the present invention, a method of radially expanding and plastically deforming a first tubular member and a second tubular member is provided that includes inserting an end of the first tubular member into an end of a tubular sleeve having an internal flange into abutment with the internal flange; inserting an end of the second tubular member into another end of the tubular sleeve into abutment with the internal flange; coupling the ends of the first and second tubular member to the tubular sleeve; and displacing an expansion device through the interiors of the first and second tubular members to radially expand and plastically deform the ends of the first and second tubular members; wherein the internal diameter of at least one of the non-threaded portion of the first tubular member and the non-threaded portion of the second tubular member is equal to the internal diameter of the internal flange of the tubular sleeve.

According to another aspect of the present invention, a method of radially expanding and plastically deforming a first tubular member and a second tubular member is provided that includes inserting an end of the first tubular member into an end of a tubular sleeve having an internal flange into abutment with the internal flange; inserting an end of the second tubular member into another end of the tubular sleeve into abutment with the internal flange; coupling the ends of the first and second tubular member to the tubular sleeve; and displacing an expansion device through the interiors of the first and second tubular members to radially expand and plastically deform the ends of the first and second tubular members; wherein, after the radial expansion and plastic deformation, the internal diameter of at least one of the non-threaded portion of the first tubular member and the non-threaded portion of the second tubular member is equal to the internal diameter of the internal flange of the tubular sleeve.

According to another aspect of the present invention, an apparatus is provided that includes a first tubular member comprising a threaded end portion; a second tubular member comprising a threaded end portion; and a tubular sleeve that receives, overlaps with, and is coupled to the threaded end portions of the first and second tubular members; wherein the threaded end portion of the first tubular member is threadably coupled to the threaded end portion of the second tubular member; wherein portions of the first and second tubular members are radially expanded and plastically deformed; and wherein the internal diameter of at least one of the non-threaded portion of the first tubular member and the non-threaded portion of the second tubular member is equal to the internal diameter of the internal flange of the tubular sleeve.

According to another aspect of the present invention, an apparatus is provided that includes a first tubular member comprising a threaded end portion; a second tubular member comprising a threaded end portion; and a tubular sleeve that receives, overlaps with, and is coupled to the threaded end portions of the first and second tubular members; wherein the threaded end portion of the first tubular member is threadably coupled to the threaded end portion of the second tubular member; wherein portions of the first and second tubular members are radially expanded and plastically deformed; wherein a portion of the first tubular member abuts an end face of the internal flange of the tubular sleeve; and wherein a portion of the second tubular member abuts another end face of the internal flange of the tubular sleeve.

According to another aspect of the present invention, an apparatus is provided that includes a first tubular member comprising a threaded end portion; a second tubular member comprising a threaded end portion; and a tubular sleeve that receives, overlaps with, and is coupled to the threaded end portions of the first and second tubular members; wherein the threaded end portion of the first tubular member is threadably coupled to the threaded end portion of the second tubular member; wherein the internal diameter of at least one of the non-threaded portion of the first tubular member and the non-threaded portion of the second tubular member is equal to the internal diameter of the internal flange of the tubular sleeve.

According to another aspect of the present invention, an apparatus is provided that includes a first tubular member comprising a threaded end; a second tubular member comprising a threaded end; and a tubular sleeve that is received within, overlaps with, and is coupled to the threaded ends of the first and second tubular members; wherein the threaded ends of the first and second tubular members are radially expanded and plastically deformed.

According to another aspect of the present invention, an apparatus is provided that includes a first tubular member comprising a threaded end; a second tubular member comprising a threaded end; and a tubular sleeve that is received within, overlaps with, and is coupled to the threaded ends of the first and second tubular members; wherein the threaded end of the first tubular member is threadably coupled to the threaded end of the second tubular member.

DETAILED DESCRIPTION OF THE ILLUSTRATIVE EMBODIMENTS

Figure 1A:
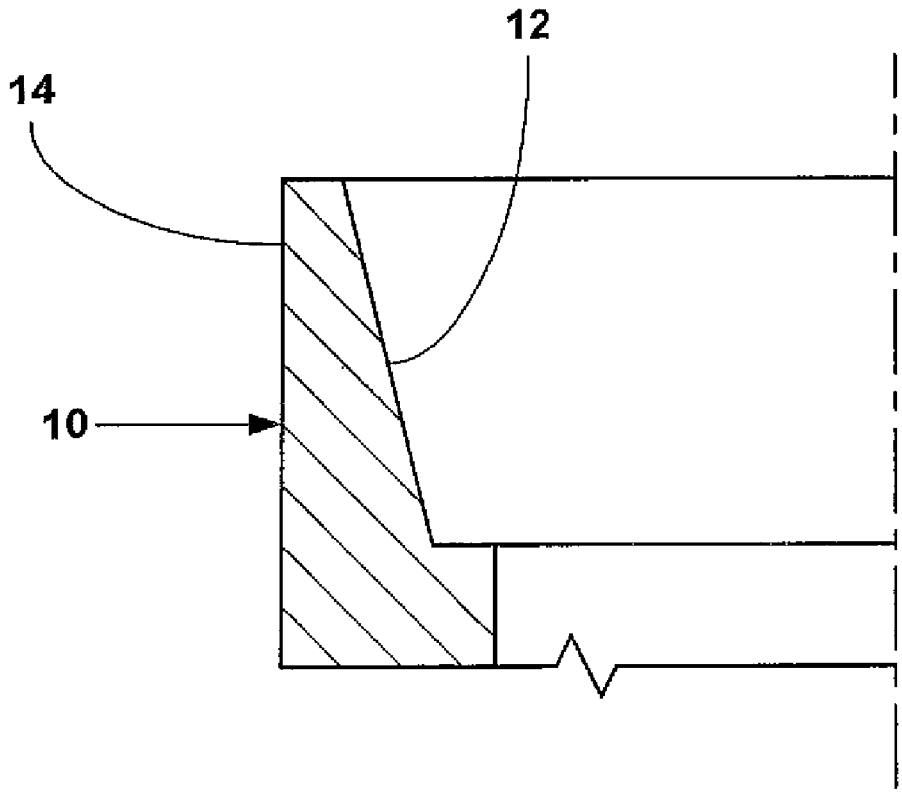
FIG. 1*a* is a fragmentary cross-sectional illustration of a first tubular member having an internally threaded connection at an end portion.
Figure 1B:
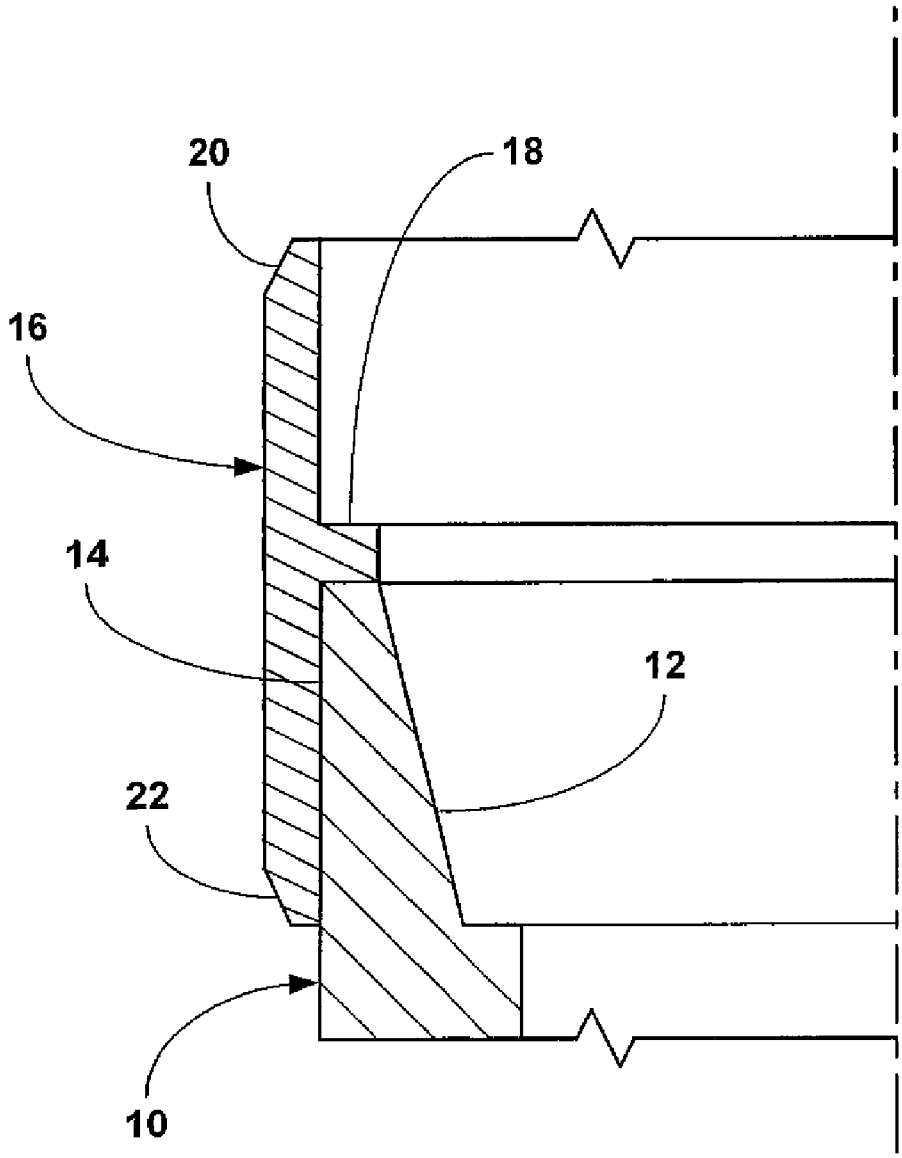
FIG. 1*b* is a fragmentary cross-sectional illustration of the placement of a tubular sleeve onto the end portion of the first tubular member of FIG. 1*a*.
Figure 1C:
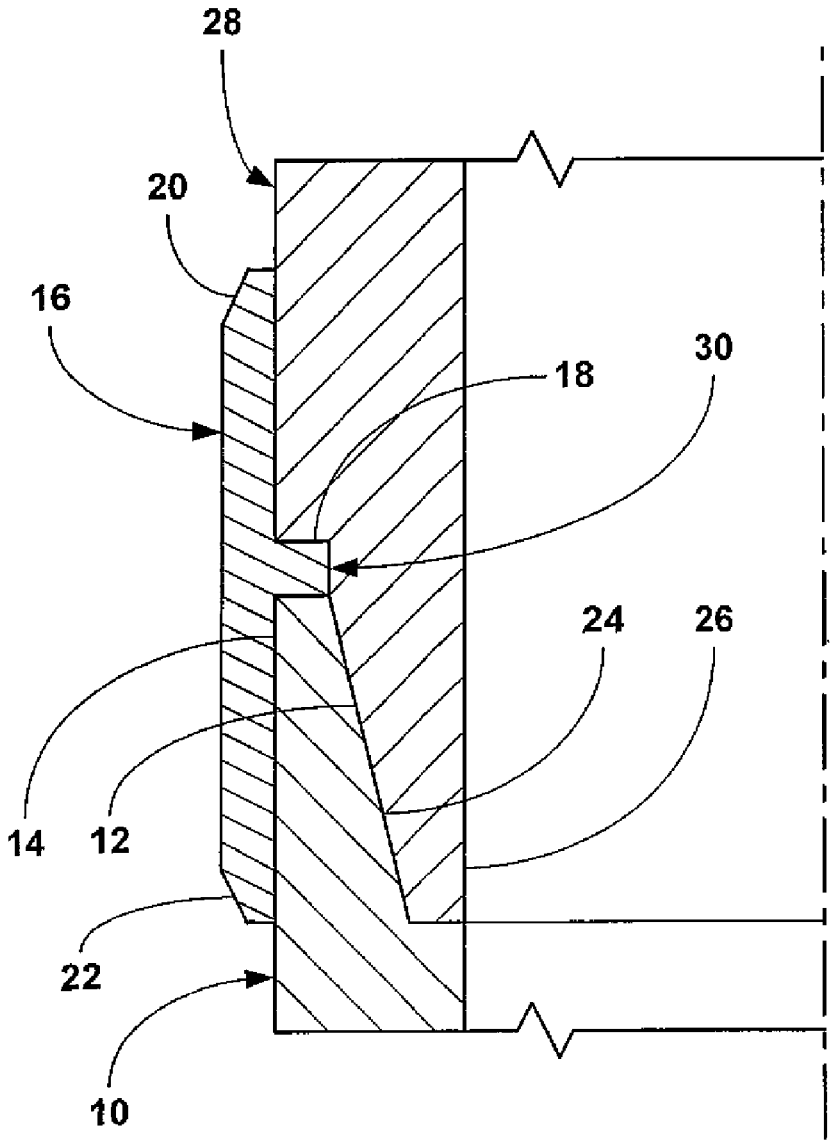
FIG. 1*c* is a fragmentary cross-sectional illustration of the coupling of an externally threaded connection at an end portion of a second tubular member to the internally threaded connection at the end portion of the first tubular member of FIG. 1*b*.

Referring to FIG. 1*a*, a first tubular member 10 includes an internally threaded connection 12 at an end portion 14. As illustrated in FIG. 1*b*, a first end of a tubular sleeve 16 that includes an internal flange 18 and tapered portions, 20 and 22, at opposite ends is then mounted upon and receives the end portion 14 of the first tubular member 10. In an exemplary embodiment, the end portion 14 of the first tubular member 10 abuts one side of the internal flange 18 of the tubular sleeve 16, and the internal diameter of the internal flange of the tubular sleeve is substantially equal to or greater than the maximum internal diameter of the internally threaded connection 12 of the end portion of the first tubular member. As illustrated in FIG. 1*c*, an externally threaded connection 24 of an end portion 26 of a second tubular member 28 having an annular recess 30 is then positioned within the tubular sleeve 16 and threadably coupled to the internally threaded connection 12 of the end portion 14 of the first tubular member 10. In an exemplary embodiment, the internal flange 18 of the tubular sleeve 16 mates with and is received within the annular recess 30 of the end portion 26 of the second tubular member 28. Thus, the tubular sleeve 16 is coupled to and surrounds the external surfaces of the first and second tubular members, 10 and 28.

In an exemplary embodiment, the internally threaded connection 12 of the end portion 14 of the first tubular member 10 is a box connection, and the externally threaded connection 24 of the end portion 26 of the second tubular member 28 is a pin connection. In an exemplary embodiment, the internal diameter of the tubular sleeve 16 is at least approximately 0.020" greater than the outside diameters of the first and second tubular members, 10 and 28. In this manner, during the threaded coupling of the first and second tubular members, 10 and 28, fluidic materials within the first and second tubular members may be vented from the tubular members.

Figure 1D:
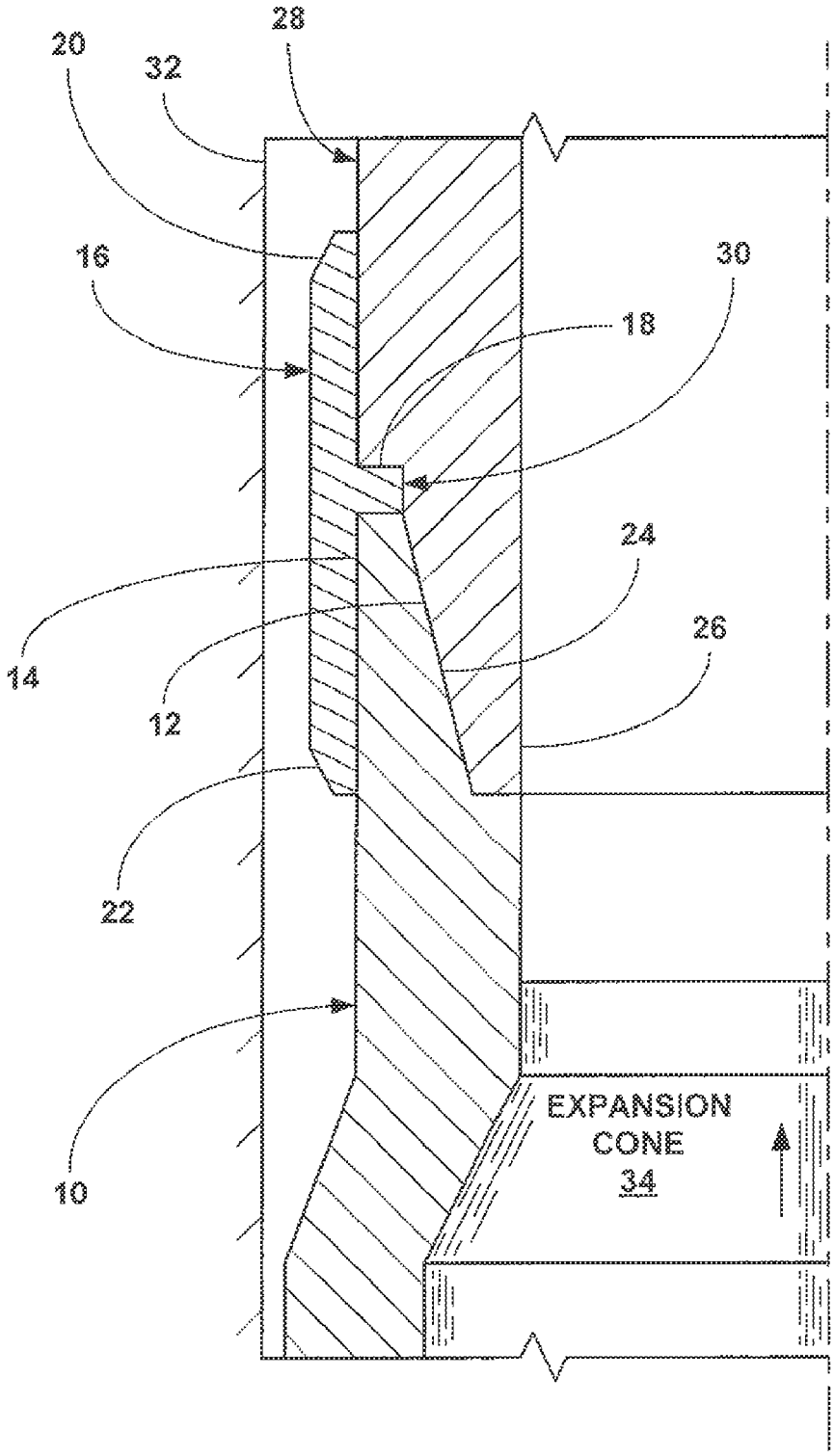
FIG. 1*d* is a fragmentary cross-sectional illustration of the radial expansion and plastic deformation of a portion of the first tubular member of FIG. 1*c*.
Figure 1E:
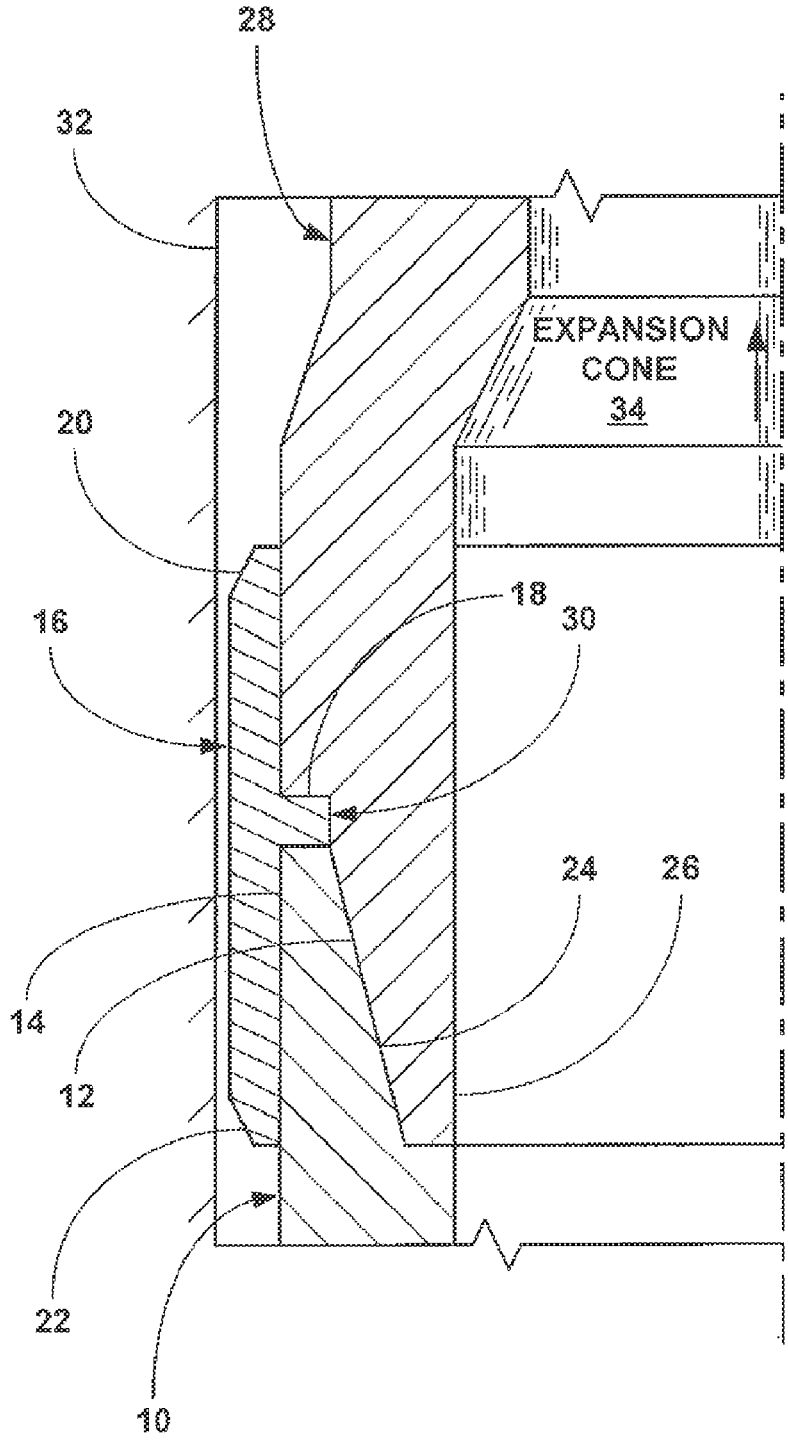
FIG. 1*e* is a fragmentary cross sectional of the continued radial expansion and plastic deformation of the threaded connection between the first and second tubular members and the tubular sleeve of FIG. 1*d*.

In an exemplary embodiment, as illustrated in FIGS. 1*d* and 1*e*, the first and second tubular members, 10 and 28, and the tubular sleeve 16 may then be positioned within another structure 32 such as, for example, a wellbore, and radially expanded and plastically deformed, for example, by moving an expansion cone 34 through the interiors of the first and second tubular members. The tapered portions, 20 and 22, of the tubular sleeve 16 facilitate the insertion and movement of the first and second tubular members within and through the structure 32, and the movement of the expansion cone 34 through the interiors of the first and second tubular members, 10 and 28, may be from top to bottom or from bottom to top.

In an exemplary embodiment, during the radial expansion and plastic deformation of the first and second tubular members, 10 and 28, the tubular sleeve 16 is also radially expanded and plastically deformed. In an exemplary embodiment, as a result, the tubular sleeve 16 may be maintained in circumferential tension and the end portions, 14 and 26, of the first and second tubular members, 10 and 28, may be maintained in circumferential compression.

In several exemplary embodiments, the first and second tubular members, 10 and 28, are radially expanded and plastically deformed using the expansion cone 32 in a conventional manner and/or using one or more of the methods and apparatus provided by Enventure Global Technology or disclosed in one or more of the published patent applications or patents in the name of Enventure Global Technology on the same subject matter.

In several alternative embodiments, the first and second tubular members, 10 and 28, are radially expanded and plastically deformed using other conventional methods for radially expanding and plastically deforming tubular members such as, for example, internal pressurization and/or roller expansion devices. In an exemplary embodiment, the roller expansion devices are the commercially available roller expansion devices available from Weatherford International and/or as disclosed in U.S. Pat. No. 6,457,532 B1, the disclosure of which is incorporated herein by reference.

The use of the tubular sleeve 16 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 16 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular member, 10 and 28, are prevented that could result in stress concentrations that could result in a catastrophic failure during subsequent radial expansion operations. Furthermore, the tubular sleeve 16 provides an alignment guide that facilitates the insertion and threaded coupling of the second tubular member 28 to the first tubular member 10. In this manner, misalignment that could result in damage to the threaded connections, 12 and 24, of the first and second tubular members, 10 and 28, may be avoided. In addition, during the relative rotation of the second tubular member with respect to the first tubular member, required during the threaded coupling of the first and second tubular members, the tubular sleeve 16 provides an indication of to what degree the first and second tubular members are threadably coupled. For example, if the tubular sleeve 16 can be easily rotated, that would indicate that the first and second tubular members, 10 and 28, are not fully threadably coupled and in intimate contact with the internal flange 18 of the tubular sleeve. Furthermore, the tubular sleeve 16 may prevent crack propagation during the radial expansion and plastic deformation of the first and second tubular members, 10 and 28. In this manner, failure modes such as, for example, longitudinal cracks in the end portions, 14 and 26, of the first and second tubular members may be limited in severity or eliminated all together. In addition, after completing the radial expansion and plastic deformation of the first and second tubular members, 10 and 28, the tubular sleeve 16 may provide a fluid tight metal-to-metal seal between interior surface of the tubular sleeve and the exterior surfaces of the end portions, 14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 16 may be maintained in circumferential tension and the end portions, 14 and 26, of the first and second tubular members, 10 and 28, may be maintained in circumferential compression, axial loads and/or torque loads may be transmitted through the tubular sleeve.

Figure 2A:
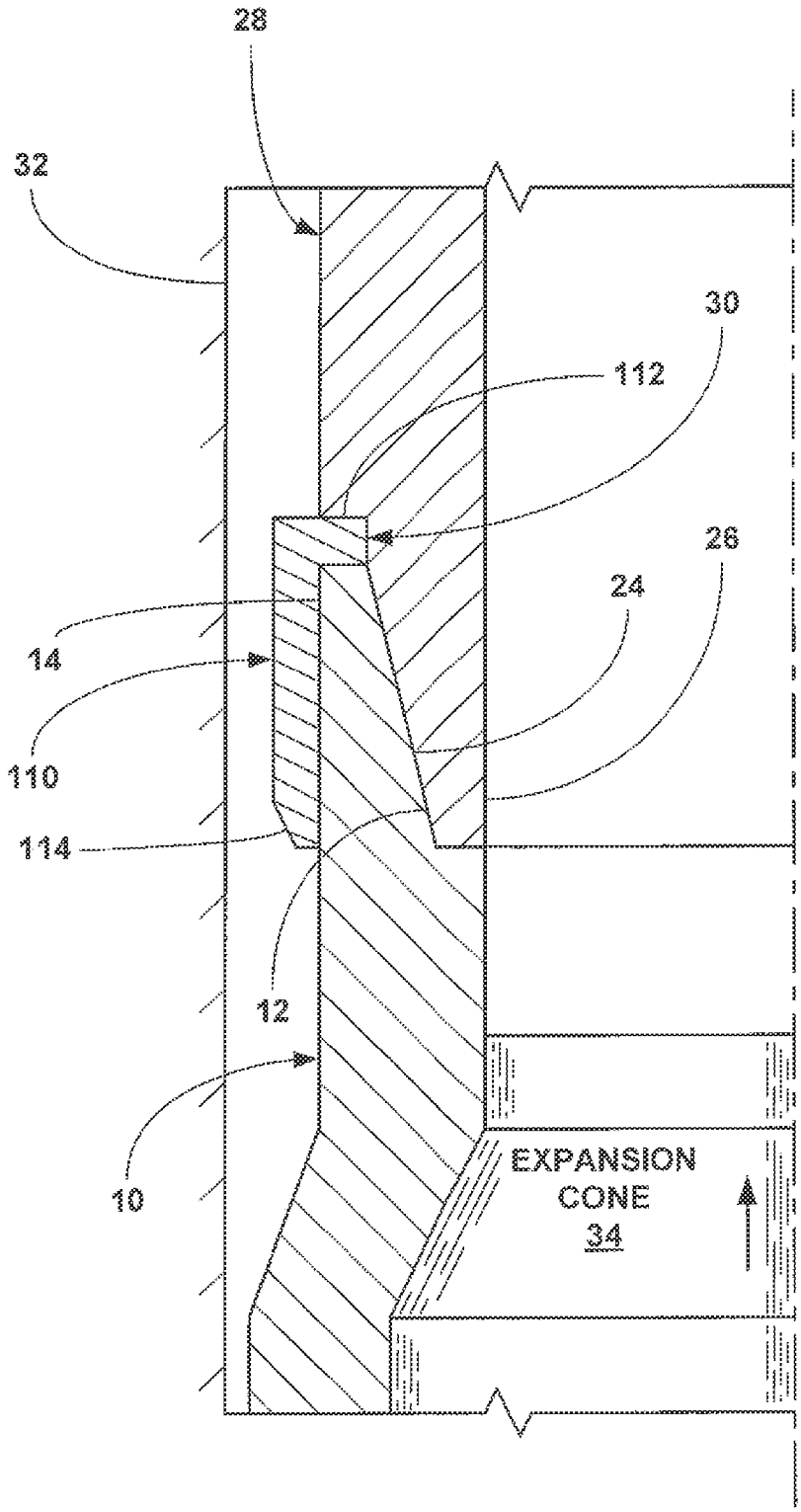
FIG. 2*a* is a fragmentary cross-sectional illustration of the radial expansion and plastic deformation of a portion of a first tubular member having an internally threaded connection at an end portion, an alternative embodiment of a tubular sleeve supported by the end portion of the first tubular member, and a second tubular member having an externally threaded portion coupled to the internally threaded portion of the first tubular member.
Figure 2B:
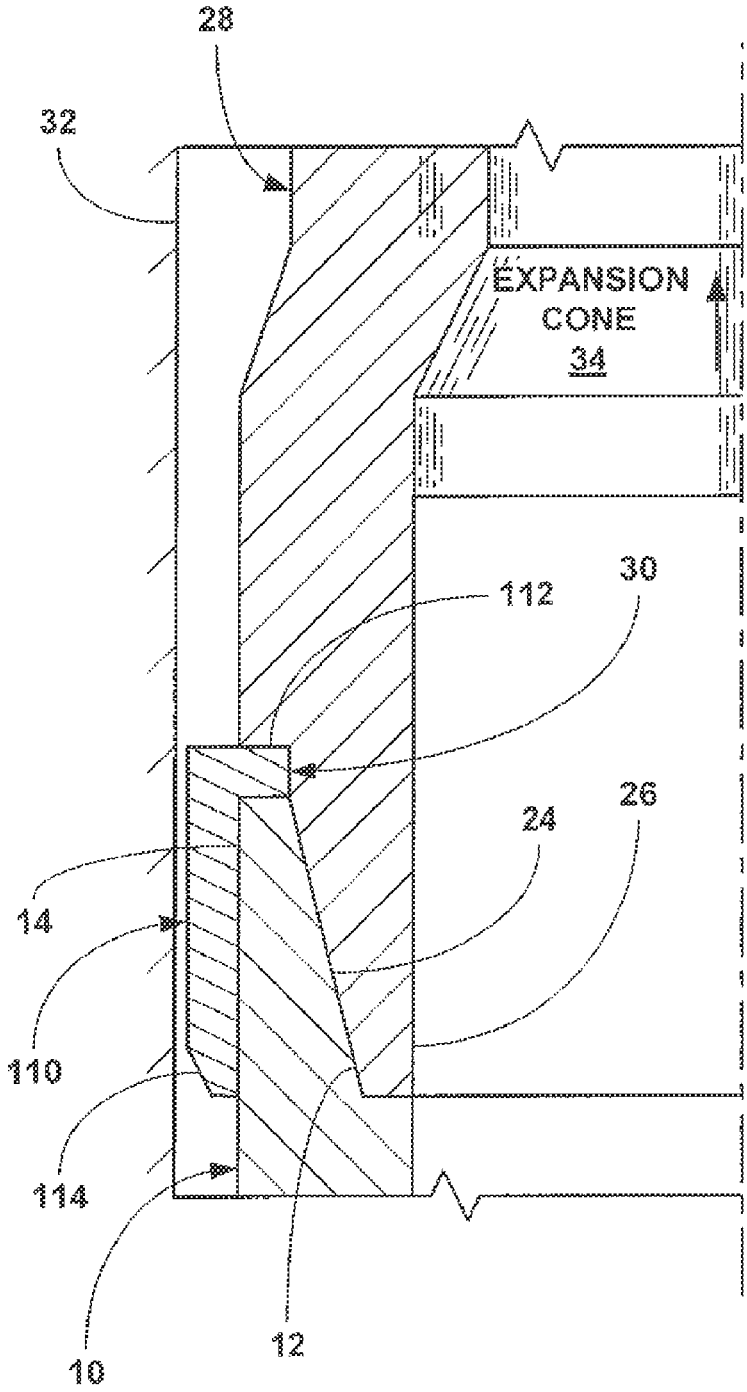
FIG. 2*b* is a fragmentary cross sectional of the continued radial expansion and plastic deformation of the threaded connection between the first and second tubular members and the tubular sleeve of FIG. 2*a*.

Referring to FIGS. 2*a* and 2*b*, in an alternative embodiment, a tubular sleeve 110 having an internal flange 112 and a tapered portion 114 is coupled to the first and second tubular members, 10 and 28. In particular, the tubular sleeve 110 receives and mates with the end portion 14 of the first tubular member 10, and the internal flange 112 of the tubular sleeve is received within the annular recess 30 of the second tubular member 28 proximate the end of the first tubular member. In this manner, the tubular sleeve 110 is coupled to the end portions, 14 and 26, of the first and second tubular members, 10 and 28, and the tubular sleeve covers the end portion 14 of the first tubular member 10.

In an exemplary embodiment, the first and second tubular members, 10 and 28, and the tubular sleeve 110 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 110 may be maintained in circumferential tension and the end portions, 14 and 26, of the first and second tubular members, 10 and 28, may be maintained in circumferential compression.

The use of the tubular sleeve 110 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 110 protects the exterior surface of the end portion 14 of the first tubular member 10 during handling and insertion of the tubular members within the structure 32. In this manner, damage to the exterior surfaces of the end portion 14 of the first tubular member 10 is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 110 provides an indication of to what degree the first and second tubular members are threadably coupled. For example, if the tubular sleeve 110 can be easily rotated, that would indicate that the first and second tubular members, 10 and 28, are not fully threadably coupled and in intimate contact with the internal flange 112 of the tubular sleeve. Furthermore, the tubular sleeve 110 may prevent crack propagation during the radial expansion and plastic deformation of the first and second tubular members, 10 and 28. In this manner, failure modes such as, for example, longitudinal cracks in the end portions, 14 and 26, of the first and second tubular members may be limited in severity or eliminated all together. In addition, after completing the radial expansion and plastic deformation of the first and second tubular members, 10 and 28, the tubular sleeve 110 may provide a fluid tight metal-to-metal seal between interior surface of the tubular sleeve and the exterior surface of the end portion 14 of the first tubular member. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 110 may be maintained in circumferential tension and the end portions, 14 and 26, of the first and second tubular members, 10 and 28, may be maintained in circumferential compression, axial loads and/or torque loads may be transmitted through the tubular sleeve.

Figure 3A:
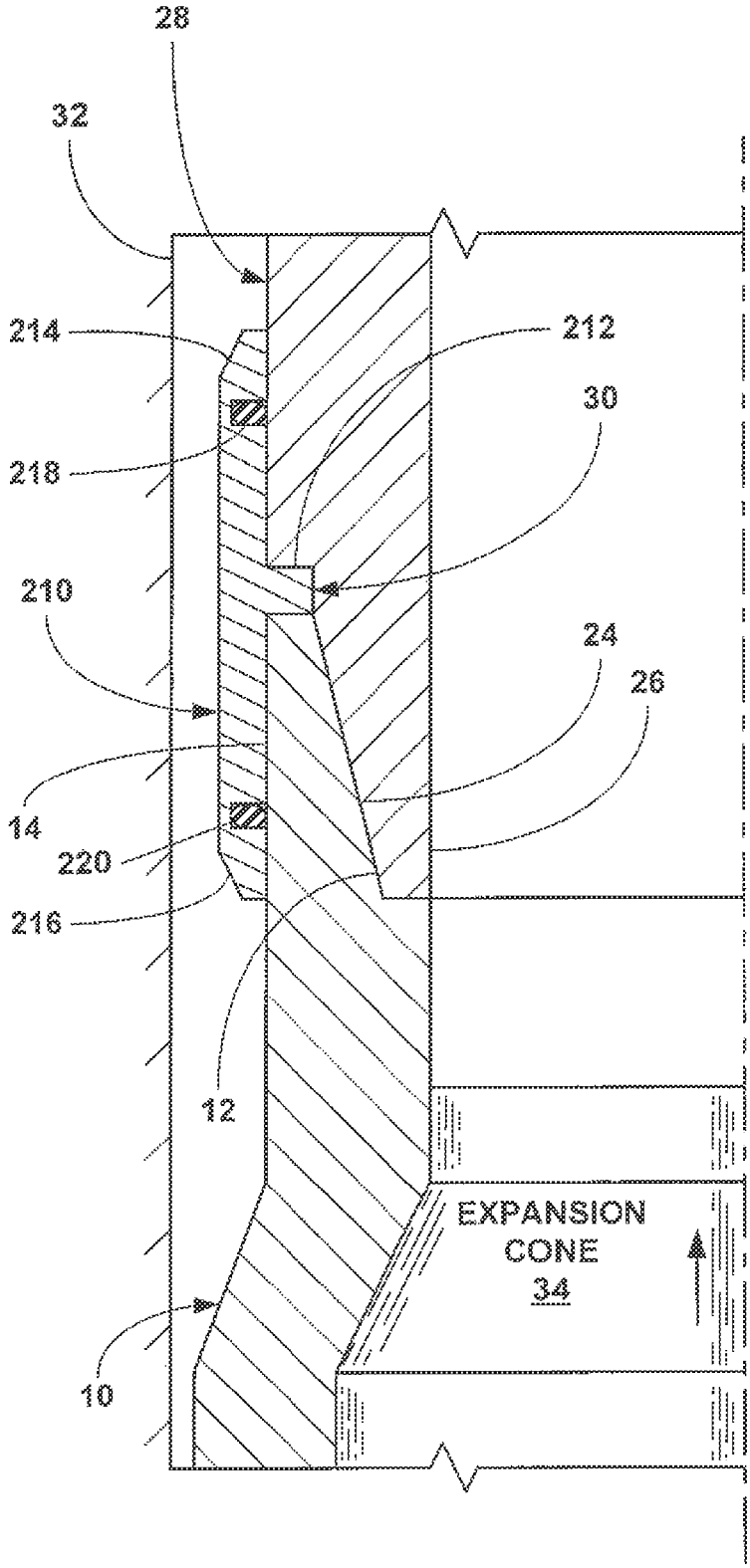
FIG. 3*a* is a fragmentary cross-sectional illustration of the radial expansion and plastic deformation of a portion of a first tubular member having an internally threaded connection at an end portion, an alternative embodiment of a tubular sleeve supported by the end portion of the first tubular member, and a second tubular member having an externally threaded portion coupled to the internally threaded portion of the first tubular member.
Figure 3B:
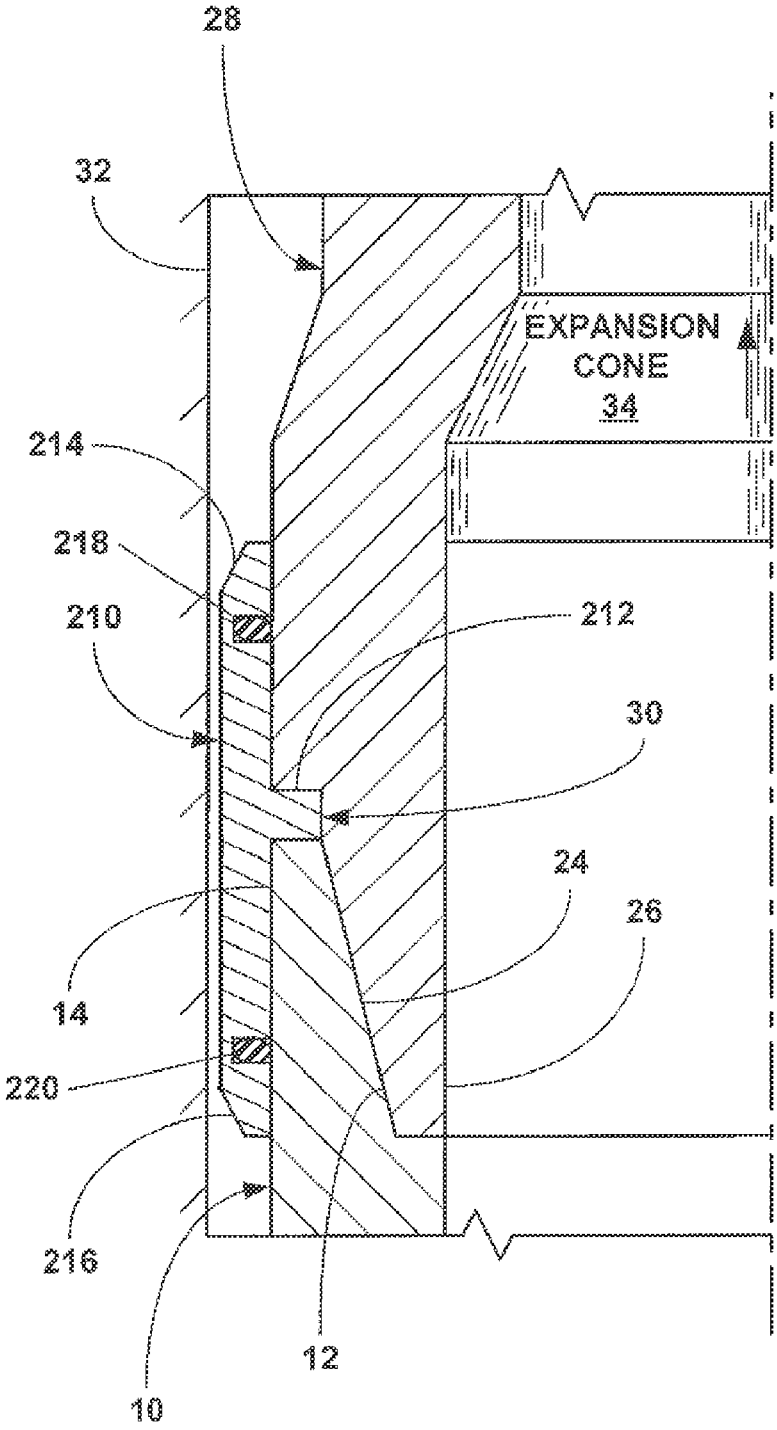
FIG. 3*b* is a fragmentary cross sectional of the continued radial expansion and plastic deformation of the threaded connection between the first and second tubular members and the tubular sleeve of FIG. 3*a*.

Referring to FIGS. 3*a* and 3*b*, in an alternative embodiment, a tubular sleeve 210 having an internal flange 212, tapered portions, 214 and 216, at opposite ends, and annular sealing members, 218 and 220, positioned on opposite sides of the internal flange, is coupled to the first and second tubular members, 10 and 28. In particular, the tubular sleeve 210 receives and mates with the end portions, 14 and 26, of the first and second tubular members, 10 and 28, and the internal flange 212 of the tubular sleeve is received within the annular recess 30 of the second tubular member 28 proximate the end of the first tubular member. Furthermore, the sealing members, 218 and 220, of the tubular sleeve 210 engage and fluidicly seal the interface between the tubular sleeve and the end portions, 14 and 26, of the first and second tubular members, 10 and 28. In this manner, the tubular sleeve 210 is coupled to the end portions, 14 and 26, of the first and second tubular members, 10 and 28, and the tubular sleeve covers the end portions, 14 and 26, of the first and second tubular members, 10 and 28.

In an exemplary embodiment, the first and second tubular members, 10 and 28, and the tubular sleeve 210 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 210 may be maintained in circumferential tension and the end portions, 14 and 26, of the first and second tubular members, 10 and 28, may be maintained in circumferential compression.

The use of the tubular sleeve 210 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 210 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular members, 10 and 28, is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 210 provides an indication of to what degree the first and second tubular members are threadably coupled. For example, if the tubular sleeve 210 can be easily rotated, that would indicate that the first and second tubular members, 10 and 28, are not fully threadably coupled and in intimate contact with the internal flange 212 of the tubular sleeve. Furthermore, the tubular sleeve 210 may prevent crack propagation during the radial expansion and plastic deformation of the first and second tubular members, 10 and 28. In this manner, failure modes such as, for example, longitudinal cracks in the end portions, 14 and 26, of the first and second tubular members, 10 and 28, may be limited in severity or eliminated all together. In addition, after completing the radial expansion and plastic deformation of the first and second tubular members, 10 and 28, the tubular sleeve 210 may provide a fluid tight metal-to-metal seal between interior surface of the tubular sleeve and the exterior surfaces of the end portions, 14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 210 may be maintained in circumferential tension and the end portions, 14 and 26, of the first and second tubular members, 10 and 28, may be maintained in circumferential compression, axial loads and/or torque loads may be transmitted through the tubular sleeve.

Figure 4A:
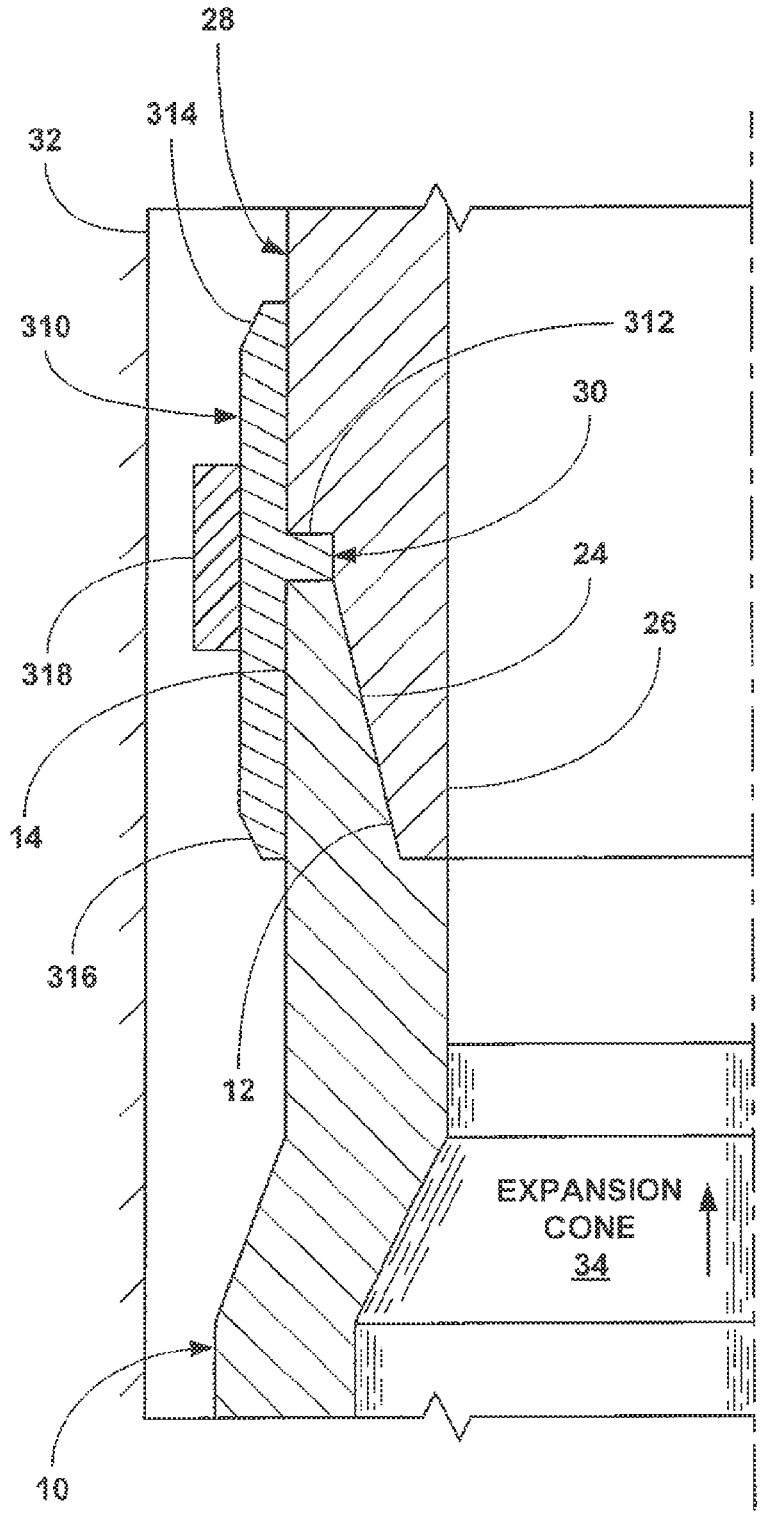
FIG. 4*a* is a fragmentary cross-sectional illustration of the radial expansion and plastic deformation of a portion of a first tubular member having an internally threaded connection at an end portion, an alternative embodiment of a tubular sleeve having an external sealing element supported by the end portion of the first tubular member, and a second tubular member having an externally threaded portion coupled to the internally threaded portion of the first tubular member.
Figure 4B:
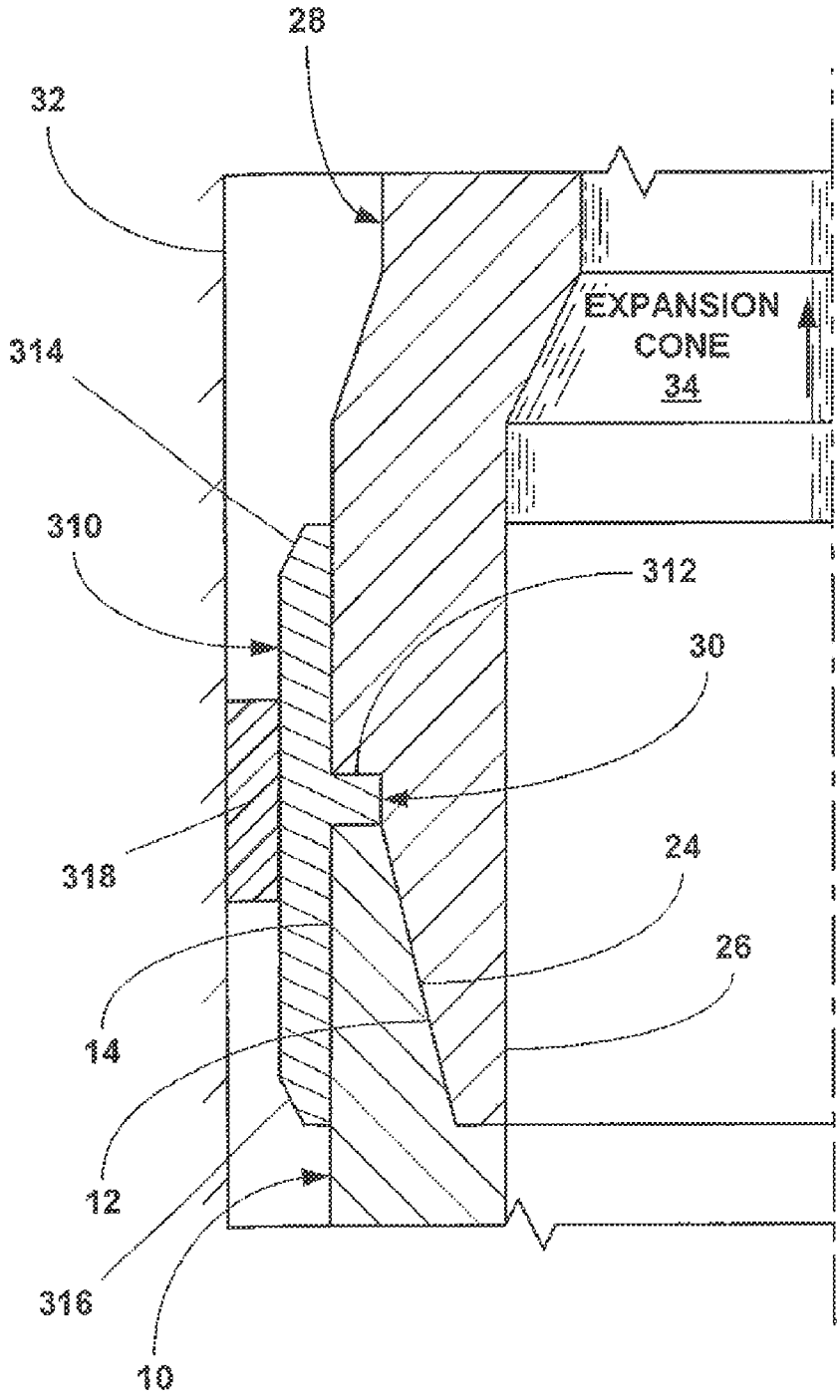
FIG. 4*b* is a fragmentary cross sectional of the continued radial expansion and plastic deformation of the threaded connection between the first and second tubular members and the tubular sleeve of FIG. 4*a*.

Referring to FIGS. 4*a* and 4*b*, in an alternative embodiment, a tubular sleeve 310 having an internal flange 312, tapered portions, 314 and 316, at opposite ends, and an annular sealing member 318 positioned on the exterior surface of the tubular sleeve, is coupled to the first and second tubular members, 10 and 28. In particular, the tubular sleeve 310 receives and mates with the end portions, 14 and 26, of the first and second tubular members, 10 and 28, and the internal flange 312 of the tubular sleeve is received within the annular recess 30 of the second tubular member 28 proximate the end of the first tubular member. In this manner, the tubular sleeve 310 is coupled to the end portions, 14 and 26, of the first and second tubular members, 10 and 28, and the tubular sleeve covers the end portions, 14 and 26, of the first and second tubular members, 10 and 28.

In an exemplary embodiment, the first and second tubular members, 10 and 28, and the tubular sleeve 310 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 310 may be maintained in circumferential tension and the end portions, 14 and 26, of the first and second tubular members, 10 and 28, may be maintained in circumferential compression. Furthermore, in an exemplary embodiment, following the radial expansion and plastic deformation of the first and second tubular members, 10 and 28, the annular sealing member 318 circumferentially engages the interior surface of the structure 32 thereby preventing the passage of fluidic materials through the annulus between the tubular sleeve 310 and the structure. In this manner, the tubular sleeve 310 may provide an expandable packer element.

The use of the tubular sleeve 310 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 310 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular members, 10 and 28, is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 310 provides an indication of to what degree the first and second tubular members are threadably coupled. For example, if the tubular sleeve 310 can be easily rotated, that would indicate that the first and second tubular members, 10 and 28, are not fully threadably coupled and in intimate contact with the internal flange 312 of the tubular sleeve. Furthermore, the tubular sleeve 310 may prevent crack propagation during the radial expansion and plastic deformation of the first and second tubular members, 10 and 28. In this manner, failure modes such as, for example, longitudinal cracks in the end portions, 14 and 26, of the first and second tubular members, 10 and 28, may be limited in severity or eliminated all together. In addition, after completing the radial expansion and plastic deformation of the first and second tubular members, 10 and 28, the tubular sleeve 310 may provide a fluid tight metal-to-metal seal between interior surface of the tubular sleeve and the exterior surfaces of the end portions,14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 310 may be maintained in circumferential tension and the end portions, 14 and 26, of the first and second tubular members, 10 and 28, may be maintained in circumferential compression, axial loads and/or torque loads may be transmitted through the tubular sleeve. In addition, because, following the radial expansion and plastic deformation of the first and second tubular members, 10 and 28, the annular sealing member 318 may circumferentially engage the interior surface of the structure 32, the tubular sleeve 310 may provide an expandable packer element.

Figure 5A:
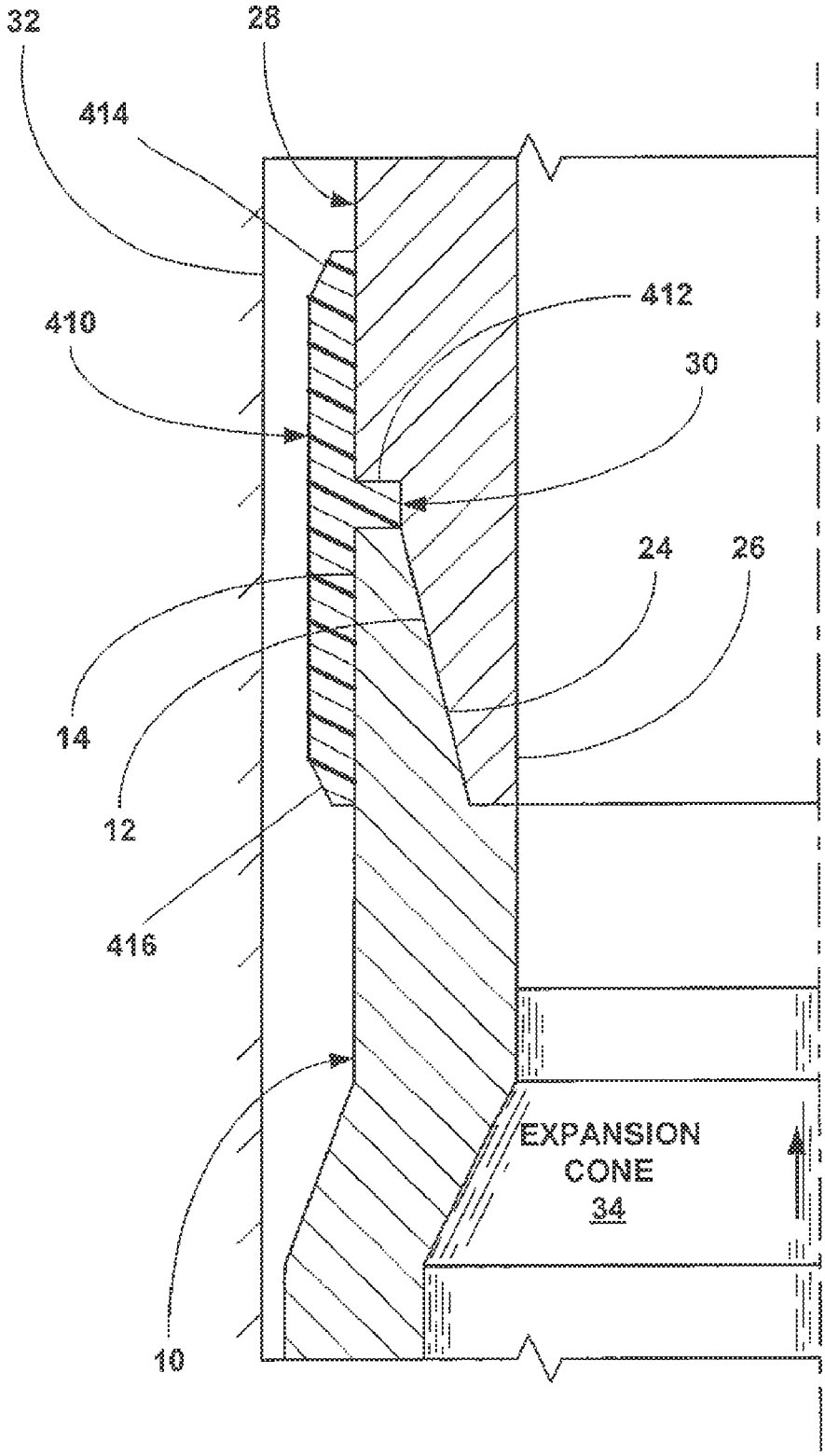
FIG. 5*a* is a fragmentary cross-sectional illustration of the radial expansion and plastic deformation of a portion of a first tubular member having an internally threaded connection at an end portion, an alternative embodiment of a tubular sleeve supported by the end portion of the first tubular member, and a second tubular member having an externally threaded portion coupled to the internally threaded portion of the first tubular member.
Figure 5B:
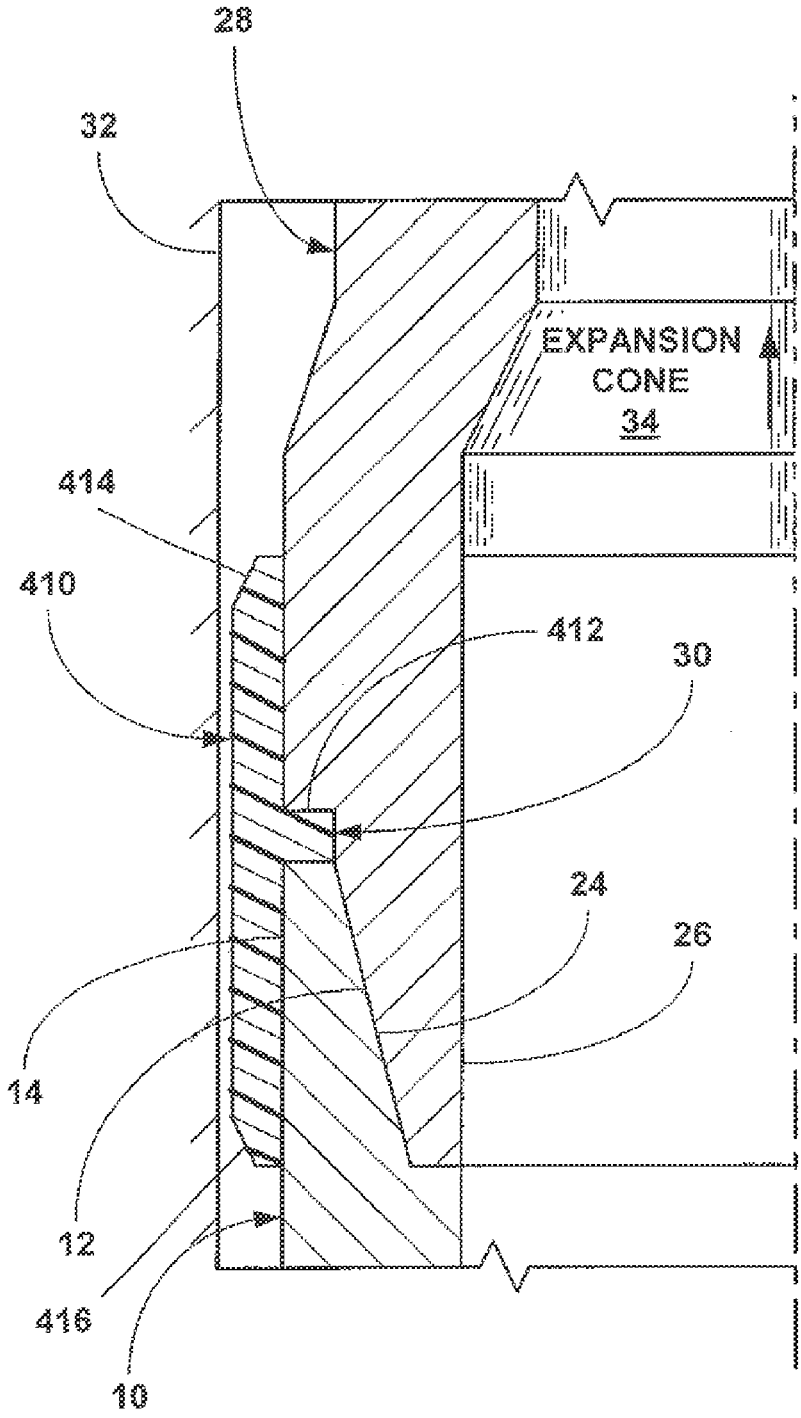
FIG. 5*b* is a fragmentary cross sectional of the continued radial expansion and plastic deformation of the threaded connection between the first and second tubular members and the tubular sleeve of FIG. 5*a*.

Referring to FIGS. 5*a* and 5*b*, in an alternative embodiment, a non-metallic tubular sleeve 410 having an internal flange 412, and tapered portions, 414 and 416, at opposite ends, is coupled to the first and second tubular members, 10 and 28. In particular, the tubular sleeve 410 receives and mates with the end portions, 14 and 26, of the first and second tubular members, 10 and 28, and the internal flange 412 of the tubular sleeve is received within the annular recess 30 of the second tubular member 28 proximate the end of the first tubular member. In this manner, the tubular sleeve 410 is coupled to the end portions, 14 and 26, of the first and second tubular members, 10 and 28, and the tubular sleeve covers the end portions, 14 and 26, of the first and second tubular members, 10 and 28.

In several exemplary embodiments, the tubular sleeve 410 may be plastic, ceramic, elastomeric, composite and/or a frangible material.

In an exemplary embodiment, the first and second tubular members, 10 and 28, and the tubular sleeve 410 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 410 may be maintained in circumferential tension and the end portions, 14 and 26, of the first and second tubular members, 10 and 28, may be maintained in circumferential compression. Furthermore, in an exemplary embodiment, during the radial expansion and plastic deformation of the first and second tubular members, 10 and 28, the tubular sleeve 310 may be broken off of the first and second tubular members.

The use of the tubular sleeve 410 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 410 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular members, 10 and 28, is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 410 provides an indication of to what degree the first and second tubular members are threadably coupled. For example, if the tubular sleeve 410 can be easily rotated, that would indicate that the first and second tubular members, 10 and 28, are not fully threadably coupled and in intimate contact with the internal flange 412 of the tubular sleeve. Furthermore, the tubular sleeve 410 may prevent crack propagation during the radial expansion and plastic deformation of the first and second tubular members, 10 and 28. In this manner, failure modes such as, for example, longitudinal cracks in the end portions, 14 and 26, of the first and second tubular members, 10 and 28, may be limited in severity or eliminated all together. In addition, after completing the radial expansion and plastic deformation of the first and second tubular members, 10 and 28, the tubular sleeve 410 may provide a fluid tight metal-to-metal seal between interior surface of the tubular sleeve and the exterior surfaces of the end portions, 14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 410 may be maintained in circumferential tension and the end portions, 14 and 26, of the first and second tubular members, 10 and 28, may be maintained in circumferential compression, axial loads and/or torque loads may be transmitted through the tubular sleeve. In addition, because, during the radial expansion and plastic deformation of the first and second tubular members, 10 and 28, the tubular sleeve 410 may be broken off of the first and second tubular members, the final outside diameter of the first and second tubular members may more closely match the inside diameter of the structure 32.

Figure 6A:
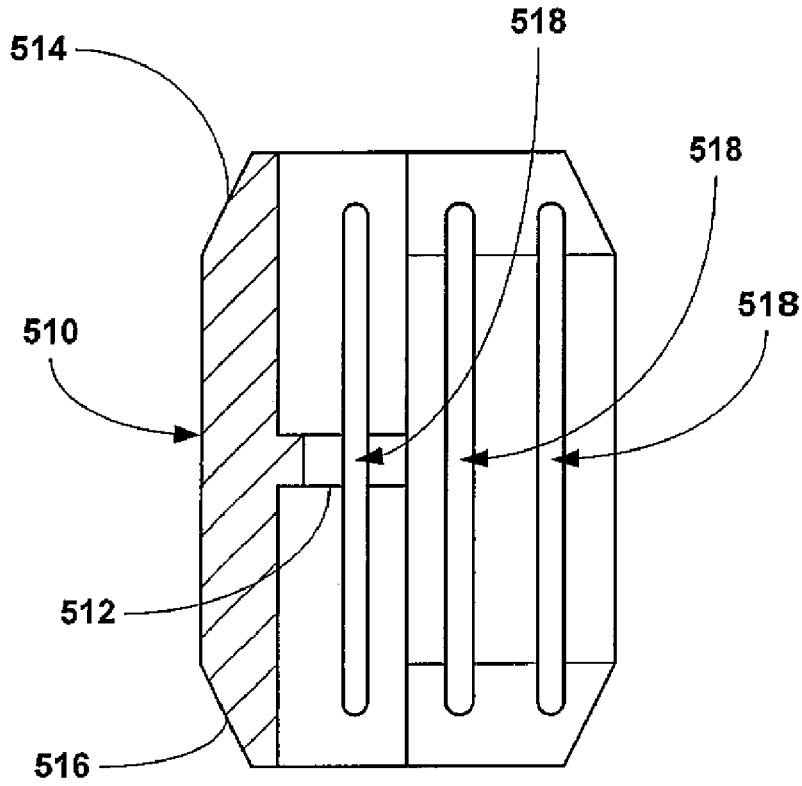
FIG. 6*a* is a fragmentary cross sectional illustration of an alternative embodiment of a tubular sleeve.

Referring to FIG. 6*a*, in an exemplary embodiment, a tubular sleeve 510 includes an internal flange 512, tapered portions, 514 and 516, at opposite ends, and defines one or more axial slots 518. In an exemplary embodiment, during the radial expansion and plastic deformation of the first and second tubular members, 10 and 28, the axial slots 518 reduce the required radial expansion forces.

Figure 6B:
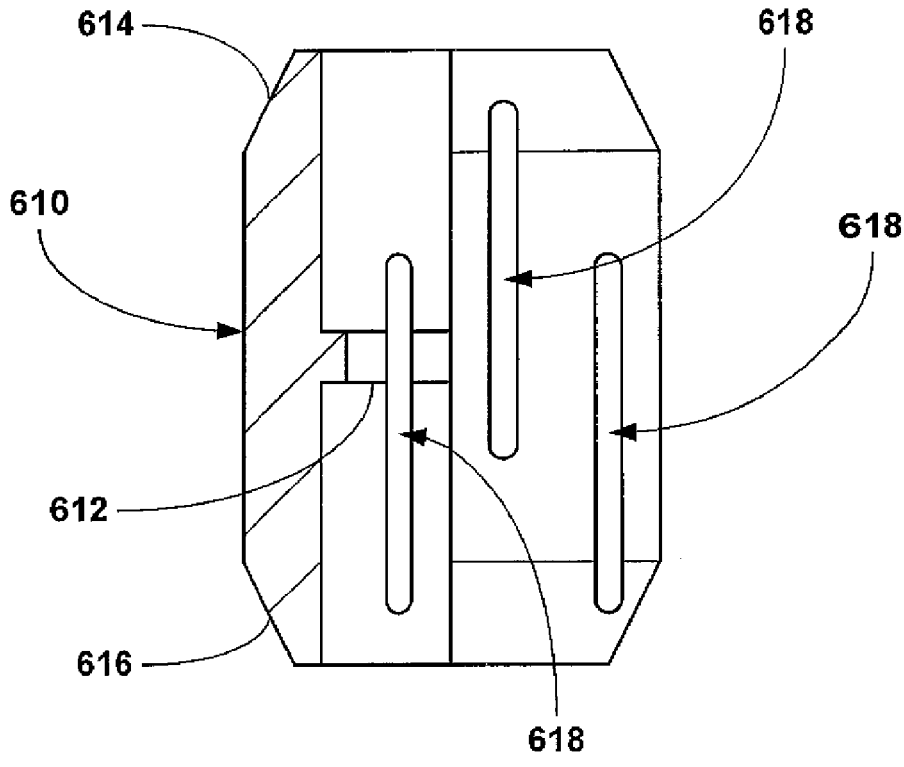
FIG. 6*b* is a fragmentary cross sectional illustration of an alternative embodiment of a tubular sleeve.

Referring to FIG. 6*b*, in an exemplary embodiment, a tubular sleeve 610 includes an internal flange 612, tapered portions, 614 and 616, at opposite ends, and defines one or more offset axial slots 618. In an exemplary embodiment, during the radial expansion and plastic deformation of the first and second tubular members, 10 and 28, the axial slots 618 reduce the required radial expansion forces.

Figure 6C:
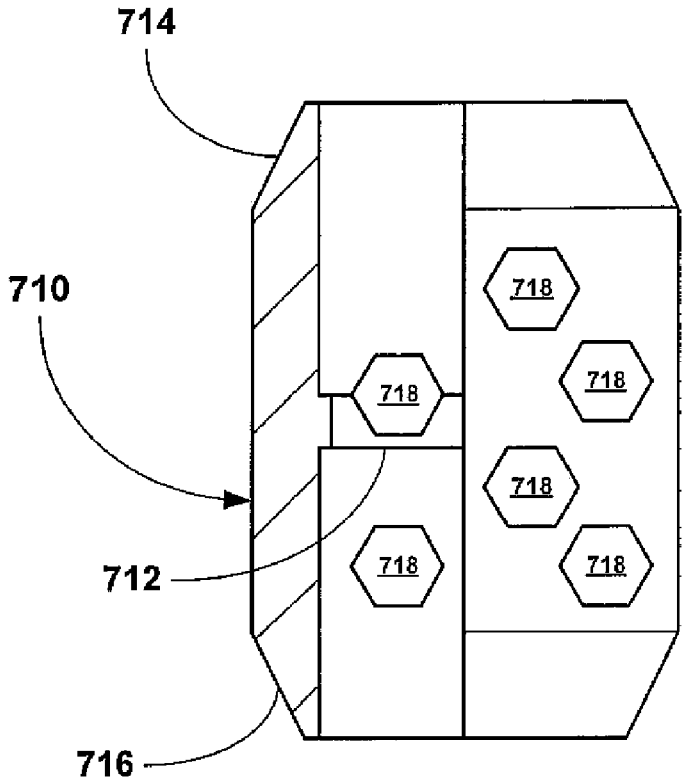
FIG. 6*c* is a fragmentary cross sectional illustration of an alternative embodiment of a tubular sleeve.

Referring to FIG. 6*c*, in an exemplary embodiment, a tubular sleeve 710 includes an internal flange 712, tapered portions, 714 and 716, at opposite ends, and defines one or more radial openings 718. In an exemplary embodiment, during the radial expansion and plastic deformation of the first and second tubular members, 10 and 28, the radial openings 718 reduce the required radial expansion forces.

Figure 6D:
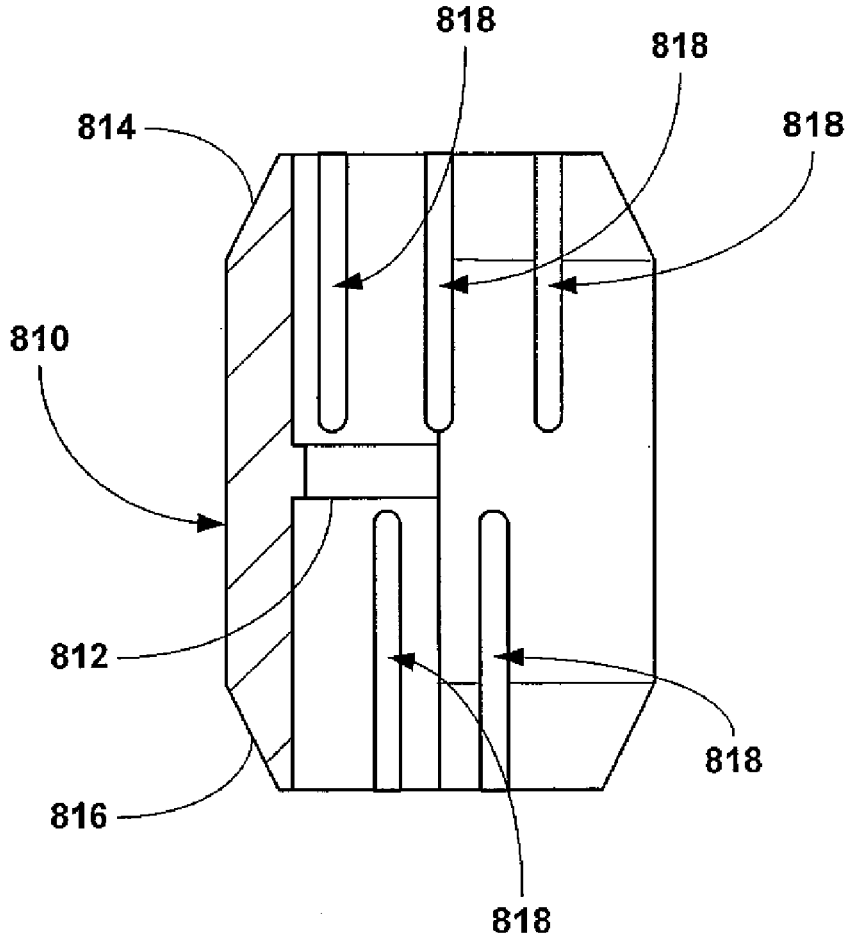
FIG. 6*d* is a fragmentary cross sectional illustration of an alternative embodiment of a tubular sleeve.

Referring to FIG. 6*d*, in an exemplary embodiment, a tubular sleeve 810 includes an internal flange 812, tapered portions, 814 and 816, at opposite ends, and defines one or more axial slots 818 that extend from the ends of the tubular sleeve. In an exemplary embodiment, during the radial expansion and plastic deformation of the first and second tubular members, 10 and 28, the axial slots 818 reduce the required radial expansion forces.

Figure 7A:
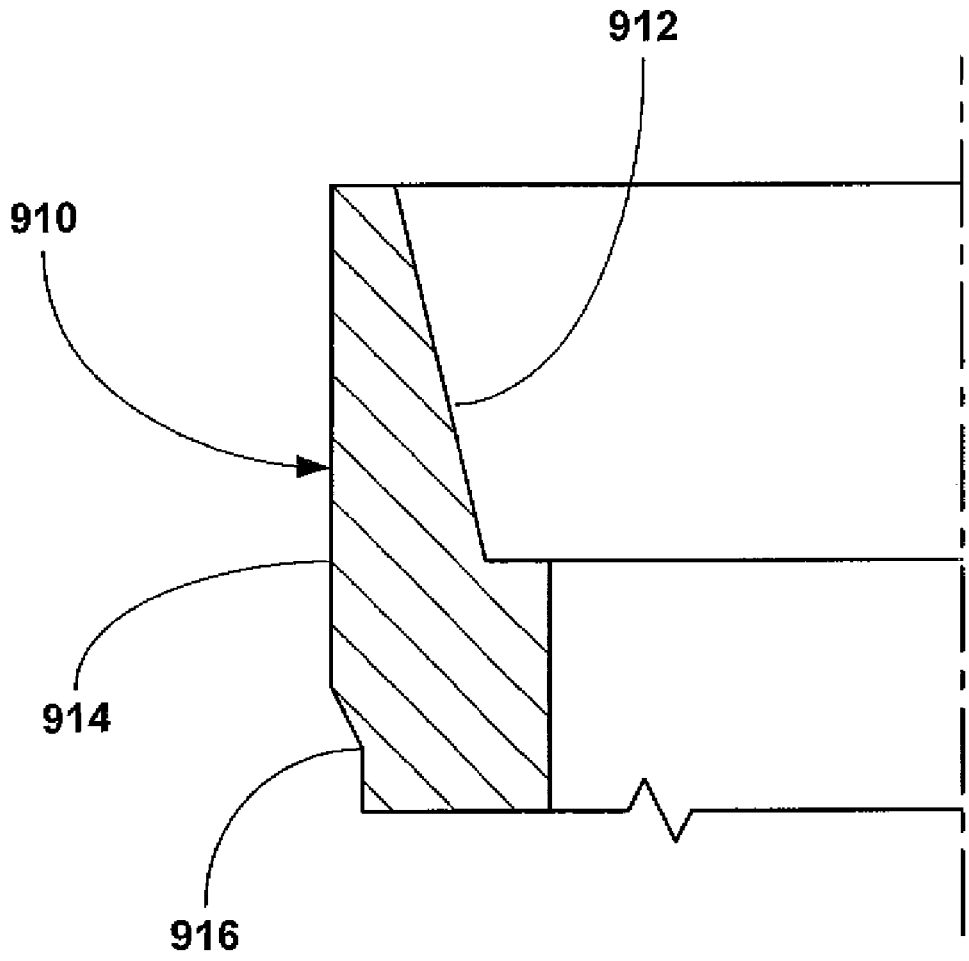
FIG. 7*a* is a fragmentary cross-sectional illustration of a first tubular member having an internally threaded connection at an end portion.
Figure 7B:
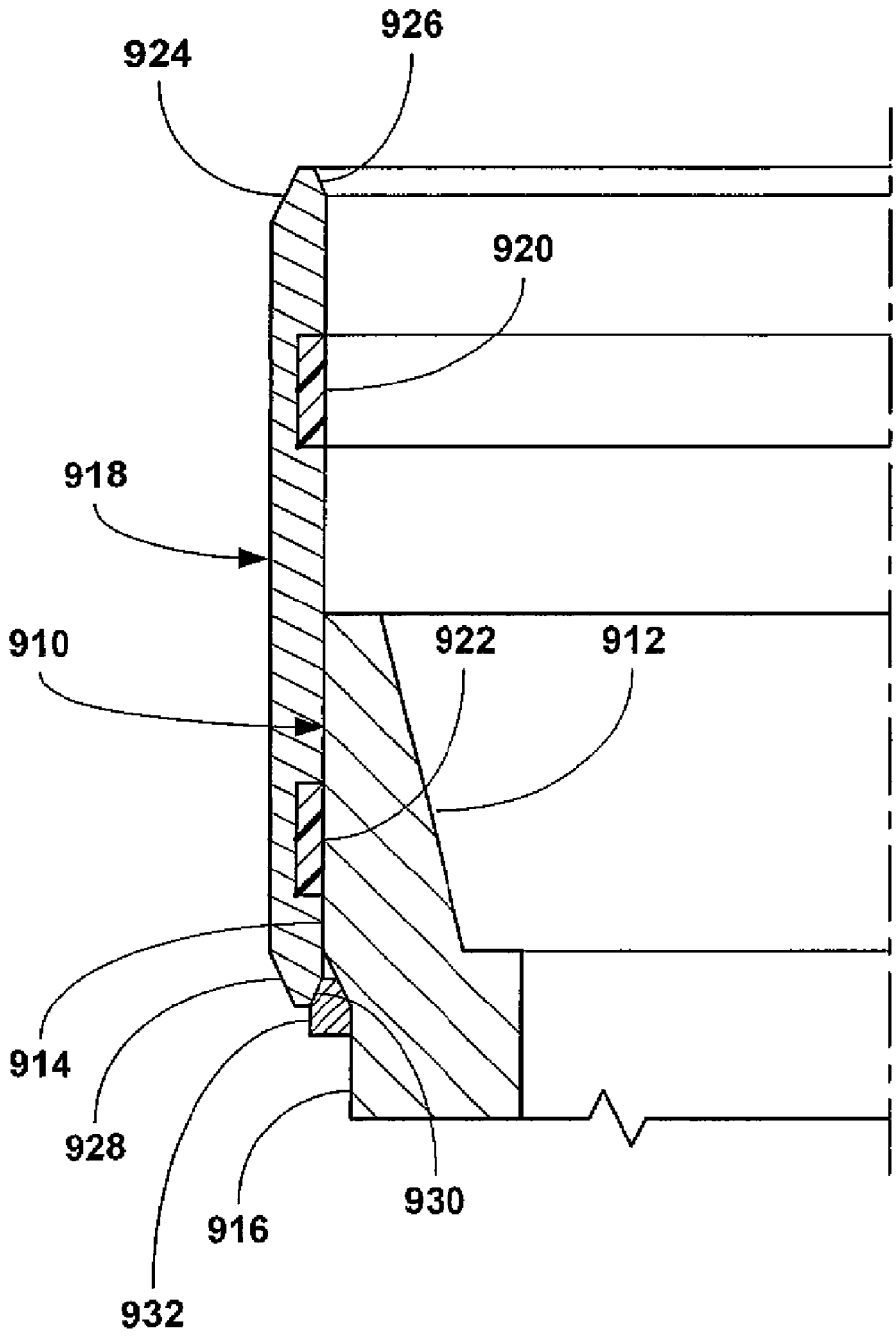
FIG. 7*b* is a fragmentary cross-sectional illustration of the placement of an alternative embodiment of a tubular sleeve onto the end portion of the first tubular member of FIG. 7*a*.

Referring to FIG. 7*a*, a first tubular member 910 includes an internally threaded connection 912 at an end portion 914 and a recessed portion 916 having a reduced outside diameter. As illustrated in FIG. 7*b*, a first end of a tubular sleeve 918 that includes annular sealing members, 920 and 922, at opposite ends, tapered portions, 924 and 926, at one end, and tapered portions, 928 and 930, at another end is then mounted upon and receives the end portion 914 of the first tubular member 910. In an exemplary embodiment, a resilient retaining ring 932 is positioned between the lower end of the tubular sleeve 918 and the recessed portion 916 of the first tubular member 910 in order to couple the tubular sleeve to the first tubular member. In an exemplary embodiment, the resilient retaining ring 932 is a split ring having a toothed surface in order to lock the tubular sleeve 918 in place.

Figure 7C:
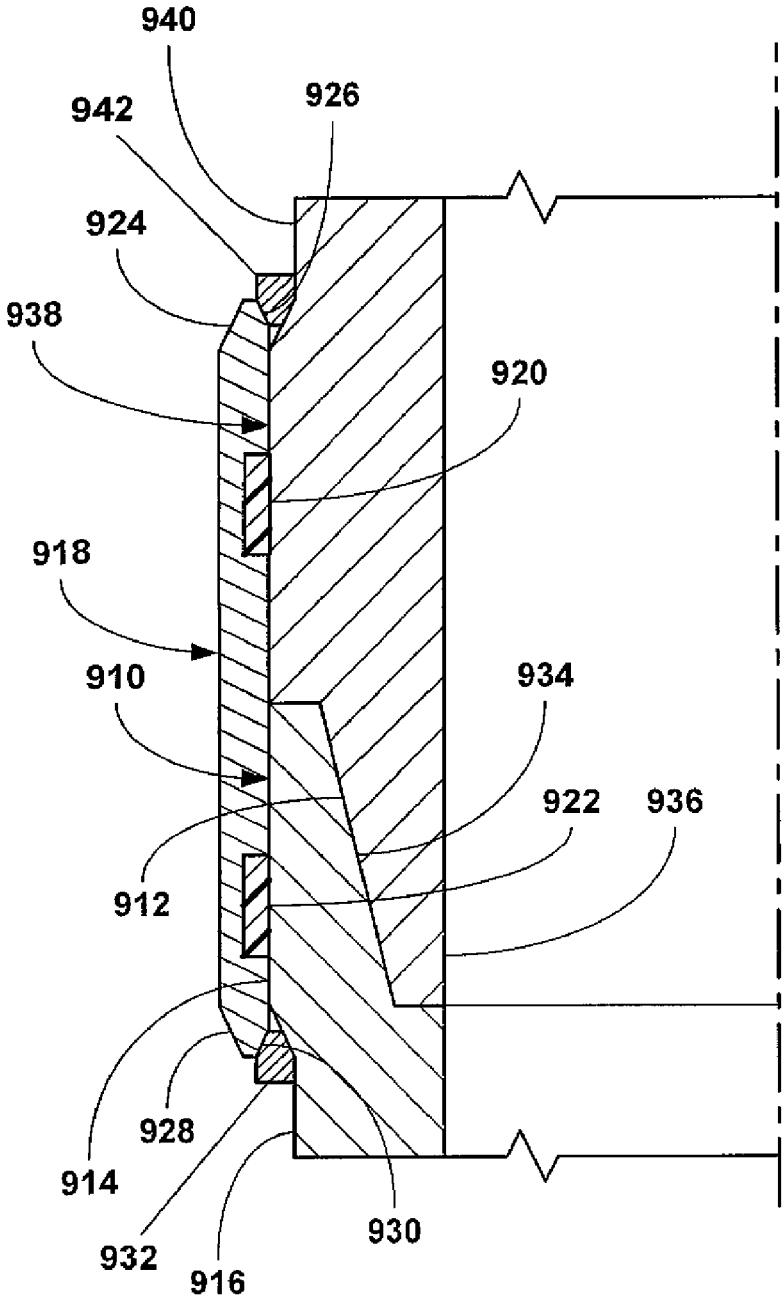
FIG. 7*c* is a fragmentary cross-sectional illustration of the coupling of an externally threaded connection at an end portion of a second tubular member to the internally threaded connection at the end portion of the first tubular member of FIG. 7*b*.

As illustrated in FIG. 7*c*, an externally threaded connection 934 of an end portion 936 of a second tubular member 938 having a recessed portion 940 having a reduced outside diameter is then positioned within the tubular sleeve 918 and threadably coupled to the internally threaded connection 912 of the end portion 914 of the first tubular member 910. In an exemplary embodiment, a resilient retaining ring 942 is positioned between the upper end of the tubular sleeve 918 and the recessed portion 940 of the second tubular member 938 in order to couple the tubular sleeve to the second tubular member. In an exemplary embodiment, the resilient retaining ring 942 is a split ring having a toothed surface in order to lock the tubular sleeve 918 in place.

In an exemplary embodiment, the internally threaded connection 912 of the end portion 914 of the first tubular member 910 is a box connection, and the externally threaded connection 934 of the end portion 936 of the second tubular member 938 is a pin connection. In an exemplary embodiment, the internal diameter of the tubular sleeve 918 is at least approximately 0.020" greater than the outside diameters of the end portions, 914 and 936, of the first and second tubular members, 910 and 938. In this manner, during the threaded coupling of the first and second tubular members, 910 and 938, fluidic materials within the first and second tubular members may be vented from the tubular members.

Figure 7D:
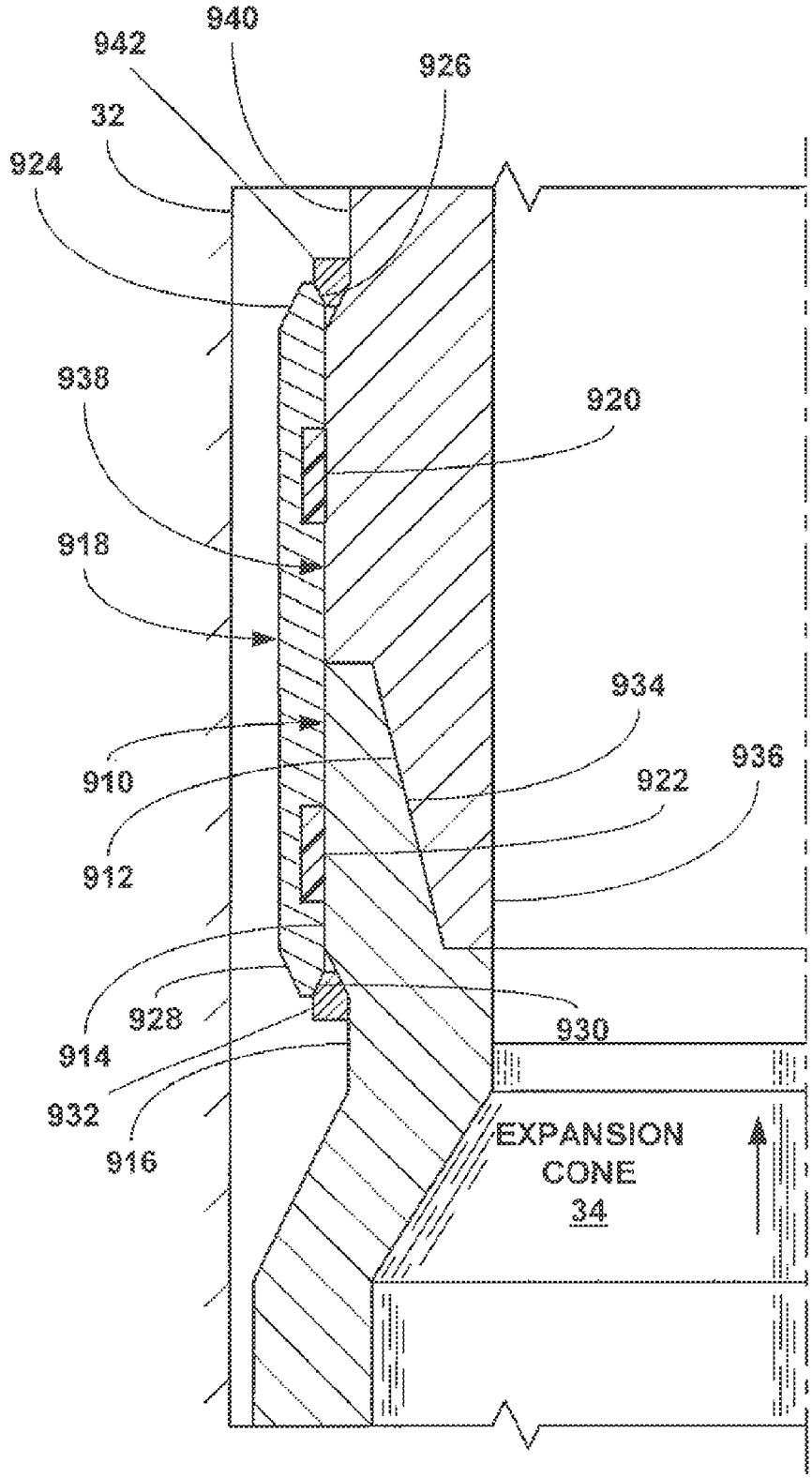
FIG. 7*d* is a fragmentary cross-sectional illustration of the radial expansion and plastic deformation of a portion of the first tubular member of FIG. 1*c*.
Figure 7E:
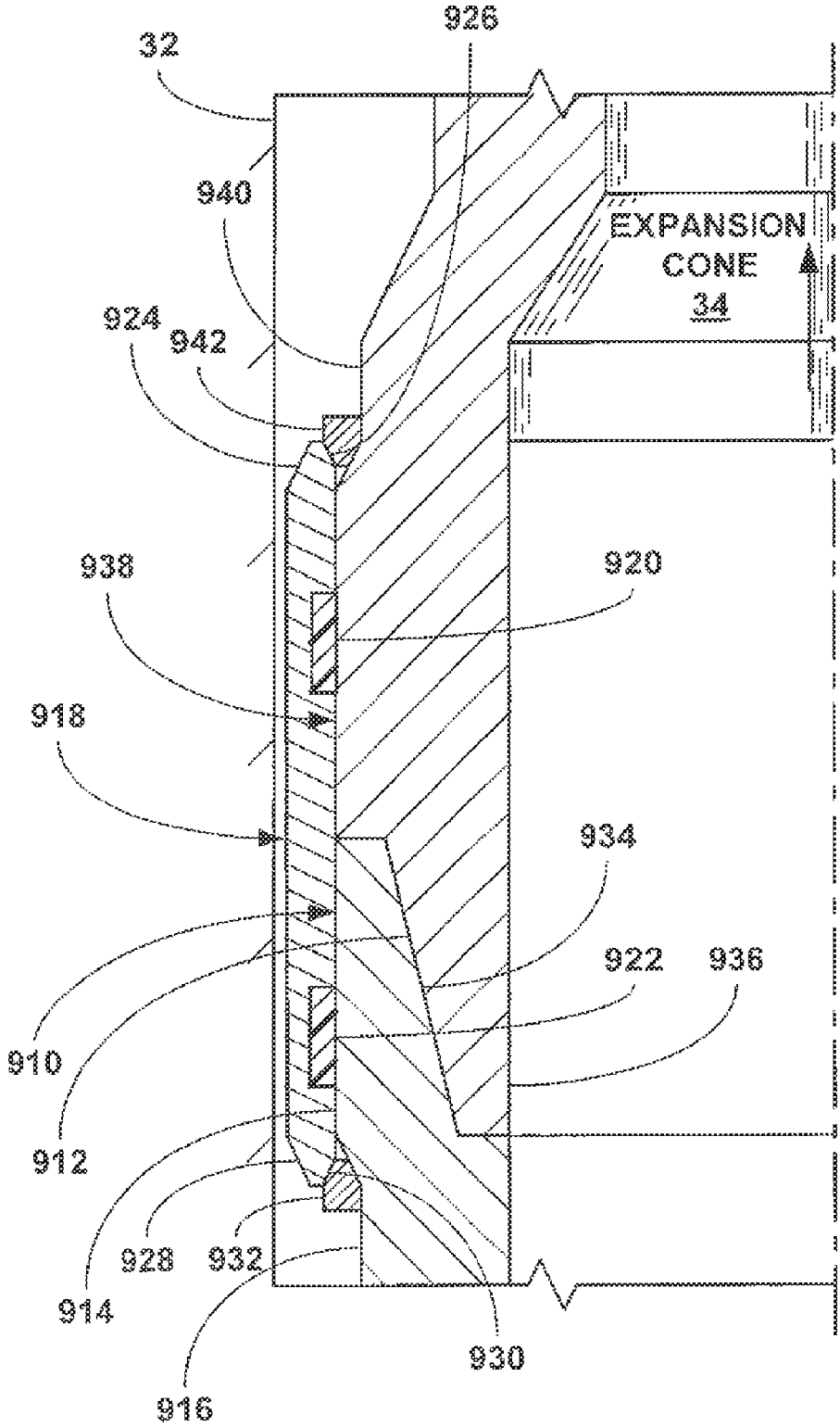
FIG. 7*e* is a fragmentary cross sectional of the continued radial expansion and plastic deformation of the threaded connection between the first and second tubular members and the tubular sleeve of FIG. 7*d*.

In an exemplary embodiment, as illustrated in FIGS. 7*d* and 7*e*, the first and second tubular members, 910 and 938, and the tubular sleeve 918 may then be positioned within another structure 32 such as, for example, a wellbore, and radially expanded and plastically deformed, for example, by moving an expansion cone 34 through the interiors of the first and second tubular members. The tapered portions, 924 and 928, of the tubular sleeve 918 facilitate the insertion and movement of the first and second tubular members within and through the structure 32, and the movement of the expansion cone 34 through the interiors of the first and second tubular members, 910 and 938, may be from top to bottom or from bottom to top.

In an exemplary embodiment, during the radial expansion and plastic deformation of the first and second tubular members, 910 and 938, the tubular sleeve 918 is also radially expanded and plastically deformed. In an exemplary embodiment, as a result, the tubular sleeve 918 may be maintained in circumferential tension and the end portions, 914 and 936, of the first and second tubular members, 910 and 938, may be maintained in circumferential compression.

The use of the tubular sleeve 918 during (a) the coupling of the first tubular member 910 to the second tubular member 938, (b) the placement of the first and second tubular members in the structure 32, and (c) the radial expansion and plastic deformation of the first and second tubular members provides a number of significant benefits. For example, the tubular sleeve 918 protects the exterior surfaces of the end portions, 914 and 936, of the first and second tubular members, 910 and 938, during handling and insertion of the tubular members within the structure 32. In this manner, damage to the exterior surfaces of the end portions, 914 and 936, of the first and second tubular member, 910 and 938, are prevented that could result in stress concentrations that could result in a catastrophic failure during subsequent radial expansion operations. Furthermore, the tubular sleeve 918 provides an alignment guide that facilitates the insertion and threaded coupling of the second tubular member 938 to the first tubular member 910. In this manner, misalignment that could result in damage to the threaded connections, 912 and 934, of the first and second tubular members, 910 and 938, may be avoided. Furthermore, the tubular sleeve 918 may prevent crack propagation during the radial expansion and plastic deformation of the first and second tubular members, 910 and 938. In this manner, failure modes such as, for example, longitudinal cracks in the end portions, 914 and 936, of the first and second tubular members may be limited in severity or eliminated all together. In addition, after completing the radial expansion and plastic deformation of the first and second tubular members, 910 and 938, the tubular sleeve 918 may provide a fluid tight metal-to-metal seal between interior surface of the tubular sleeve and the exterior surfaces of the end portions, 914 and 936, of the first and second tubular members. In this manner, fluidic materials are prevented from passing through the threaded connections, 912 and 934, of the first and second tubular members, 910 and 938, into the annulus between the first and second tubular members and the structure 32. Furthermore, because, following the radial expansion and plastic deformation of the first and second tubular members, 910 and 938, the tubular sleeve 918 may be maintained in circumferential tension and the end portions, 914 and 936, of the first and second tubular members, 910 and 938, may be maintained in circumferential compression, axial loads and/or torque loads may be transmitted through the tubular sleeve. In addition, the annular sealing members, 920 and 922, of the tubular sleeve 918 may provide a fluid tight seal between the tubular sleeve and the end portions, 914 and 936, of the first and second tubular members, 910 and 938.

Figure 8A:
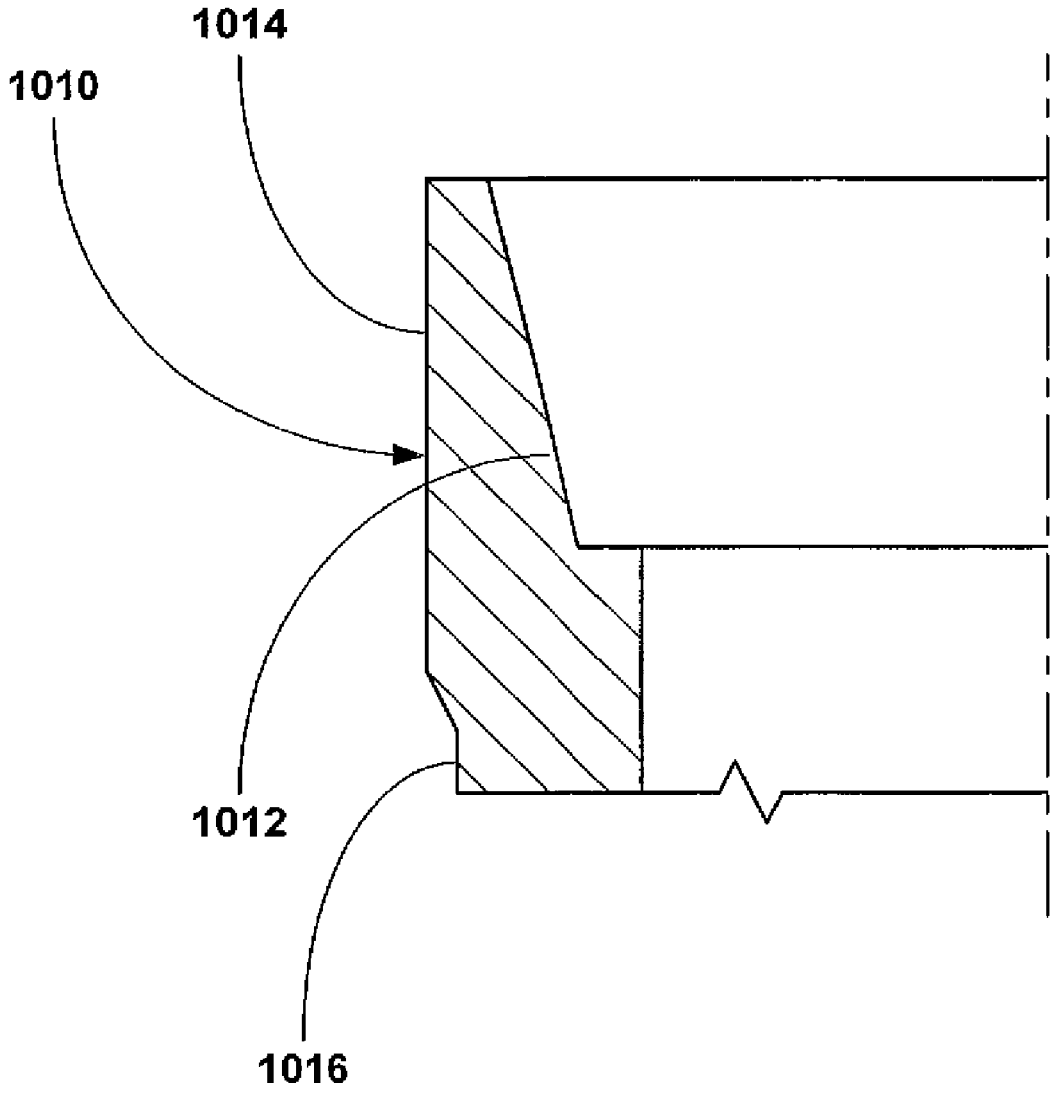
FIG. 8*a* is a fragmentary cross-sectional illustration of a first tubular member having an internally threaded connection at an end portion.
Figure 8B:
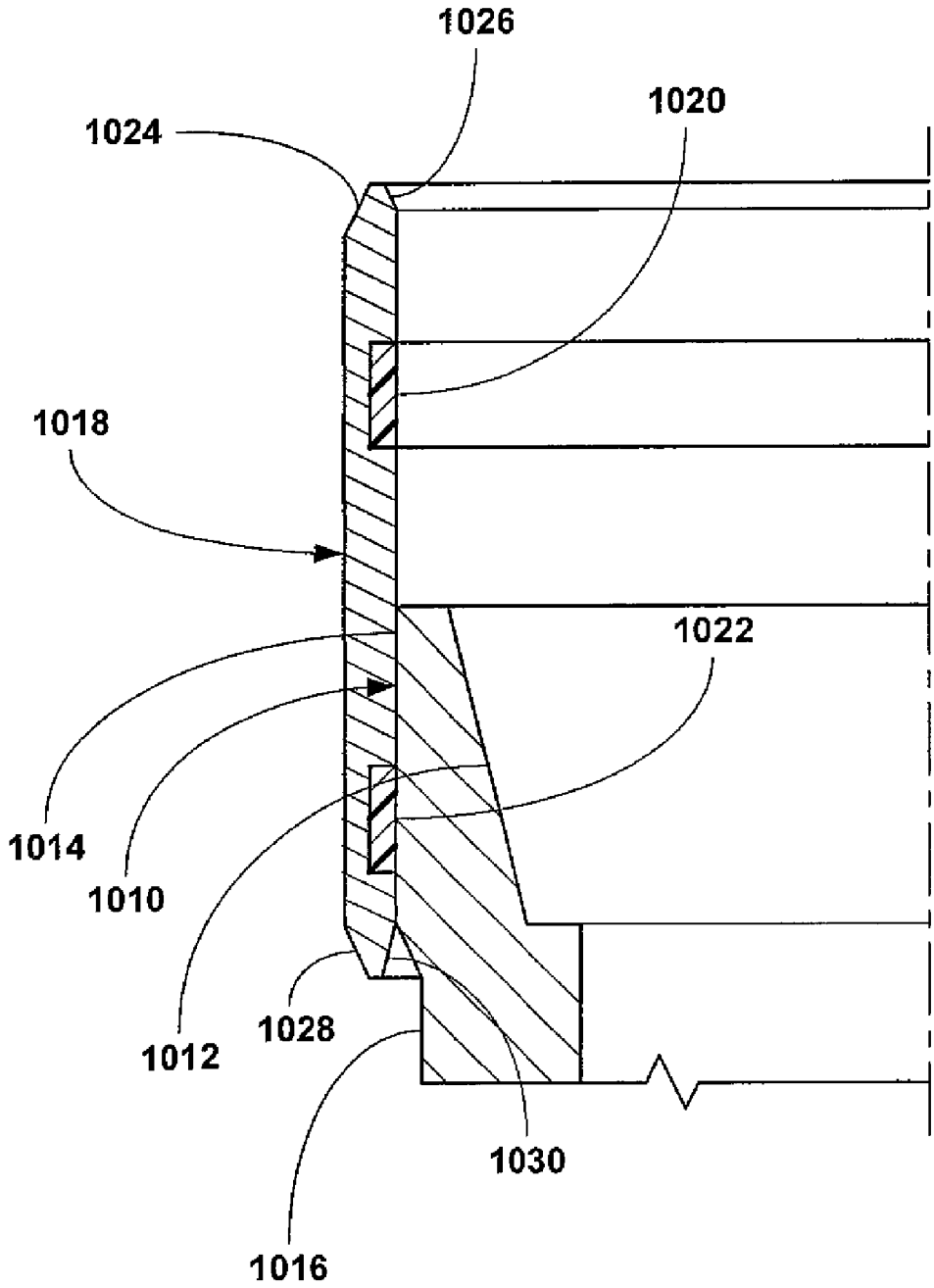
FIG. 8*b* is a fragmentary cross-sectional illustration of the placement of an alternative embodiment of a tubular sleeve onto the end portion of the first tubular member of FIG. 8*a*.
Figure 8C:
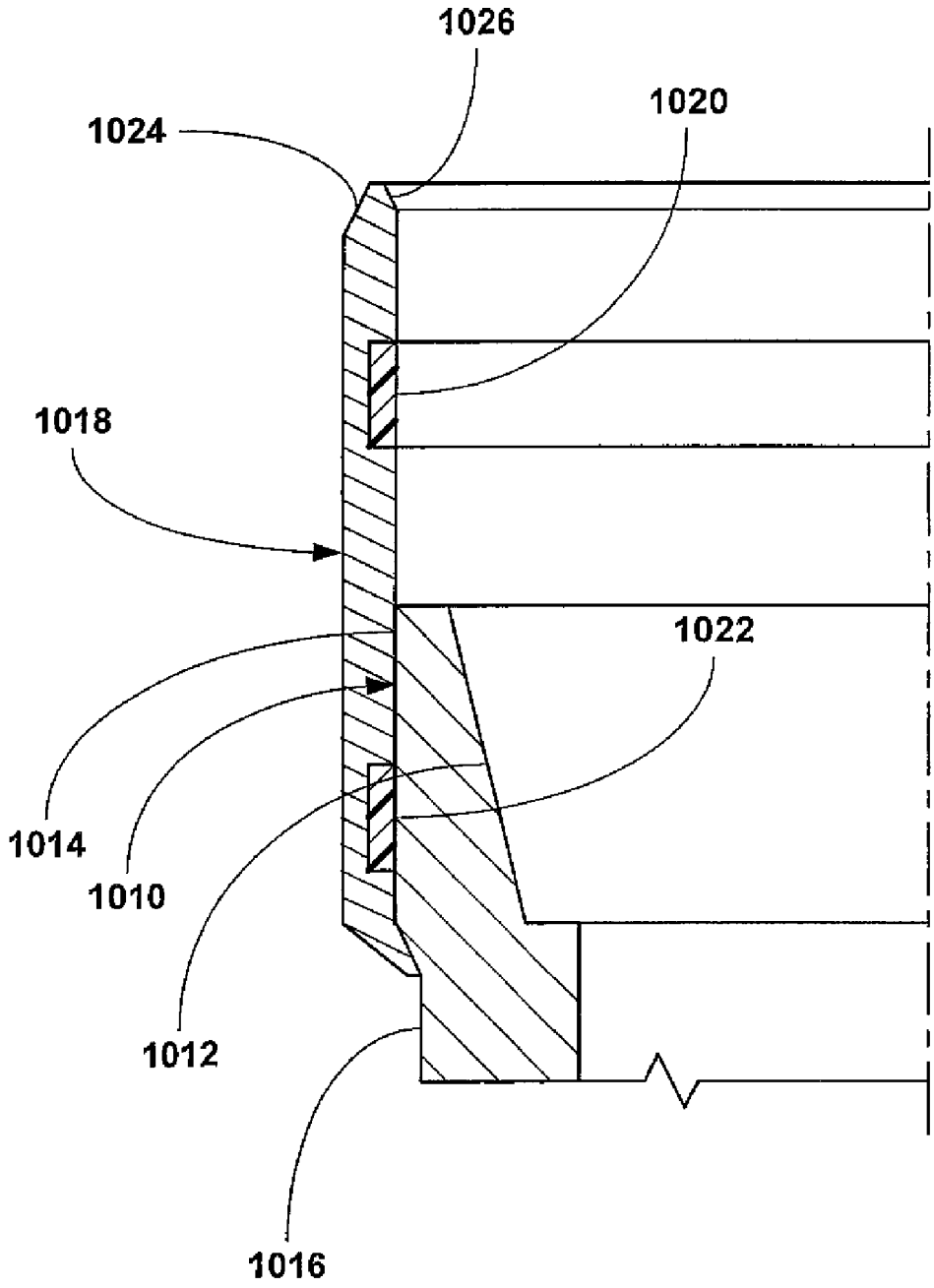
FIG. 8*c* is a fragmentary cross-sectional illustration of the coupling of the tubular sleeve of FIG. 8*b* to the end portion of the first tubular member.

Referring to FIG. 8*a*, a first tubular member 1010 includes an internally threaded connection 1012 at an end portion 1014 and a recessed portion 1016 having a reduced outside diameter. As illustrated in FIG. 8*b*, a first end of a tubular sleeve 1018 that includes annular sealing members, 1020 and 1022, at opposite ends, tapered portions, 1024 and 1026, at one end, and tapered portions, 1028 and 1030, at another end is then mounted upon and receives the end portion 1014 of the first tubular member 1010. In an exemplary embodiment, as illustrated in FIG. 8*c*, the end of the tubular sleeve 1018 is then crimped onto the recessed portion 1016 of the first tubular member 1010 in order to couple the tubular sleeve to the first tubular member.

Figure 8D:
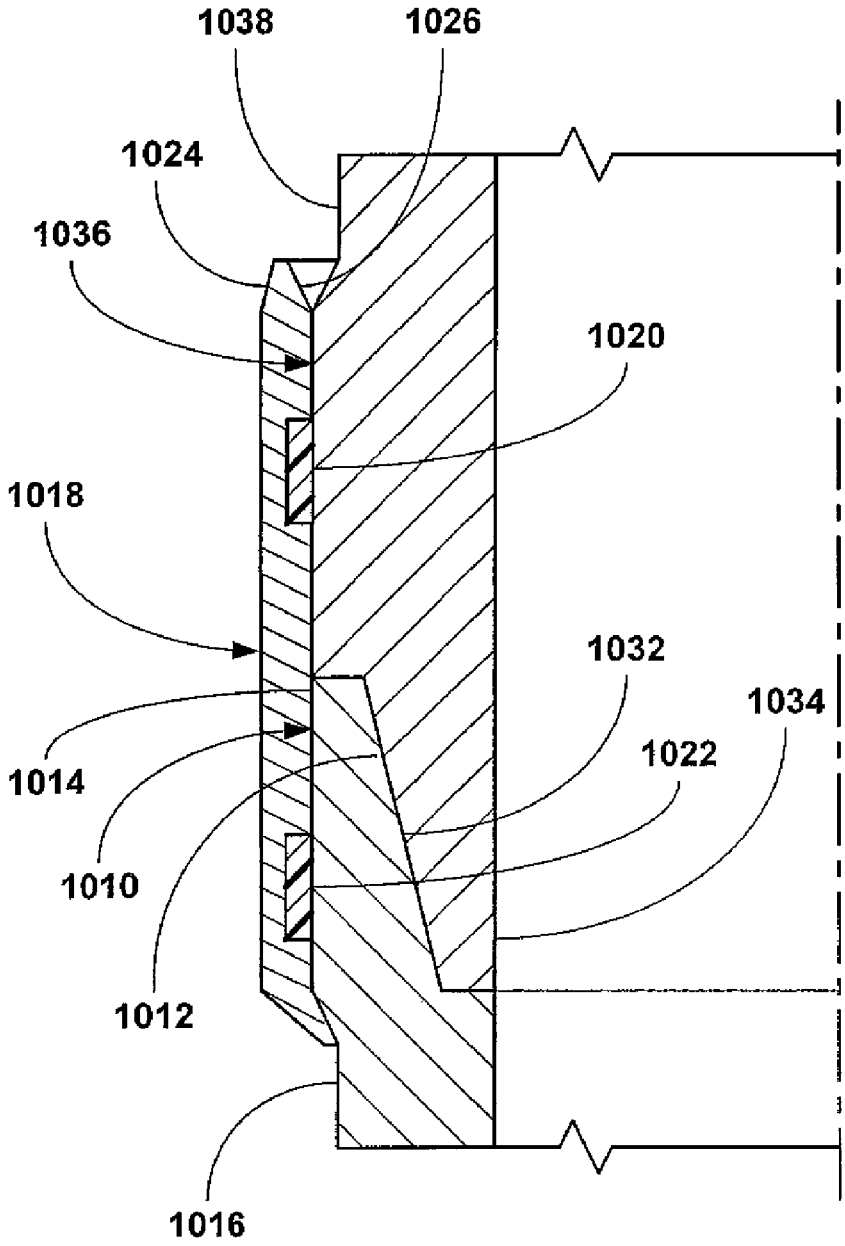
FIG. 8*d* is a fragmentary cross-sectional illustration of the coupling of an externally threaded connection at an end portion of a second tubular member to the internally threaded connection at the end portion of the first tubular member of FIG. 8*b*.
Figure 8E:
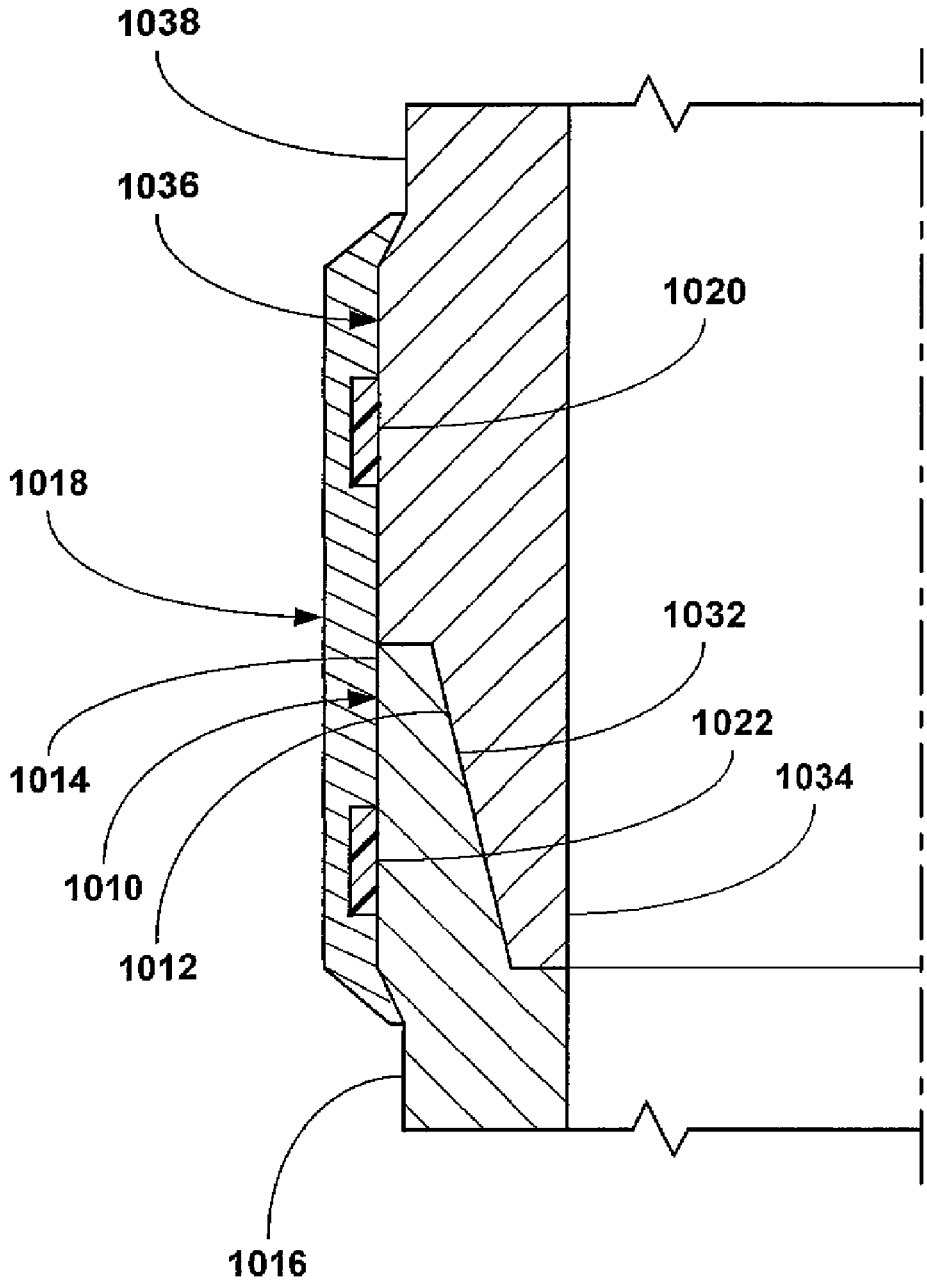
FIG. 8*e* is a fragmentary cross-sectional illustration of the coupling of the tubular sleeve of FIG. 8*d* to the end portion of the second tubular member.

As illustrated in FIG. 8*d*, an externally threaded connection 1032 of an end portion 1034 of a second tubular member 1036 having a recessed portion 1038 having a reduced external diameter is then positioned within the tubular sleeve 1018 and threadably coupled to the internally threaded connection 1012 of the end portion 1014 of the first tubular member 1010. In an exemplary embodiment, as illustrated in FIG. 8*e*, the other end of the tubular sleeve 1018 is then crimped into the recessed portion 1038 of the second tubular member 1036 in order to couple the tubular sleeve to the second tubular member.

In an exemplary embodiment, the internally threaded connection 1012 of the end portion 1014 of the first tubular member 1010 is a box connection, and the externally threaded connection 1032 of the end portion 1034 of the second tubular member 1036 is a pin connection. In an exemplary embodiment, the internal diameter of the tubular sleeve 1018 is at least approximately 0.020" greater than the outside diameters of the end portions, 1014 and 1034, of the first and second tubular members, 1010 and 1036. In this manner, during the threaded coupling of the first and second tubular members, 1010 and 1036, fluidic materials within the first and second tubular members may be vented from the tubular members.

Figure 8F:
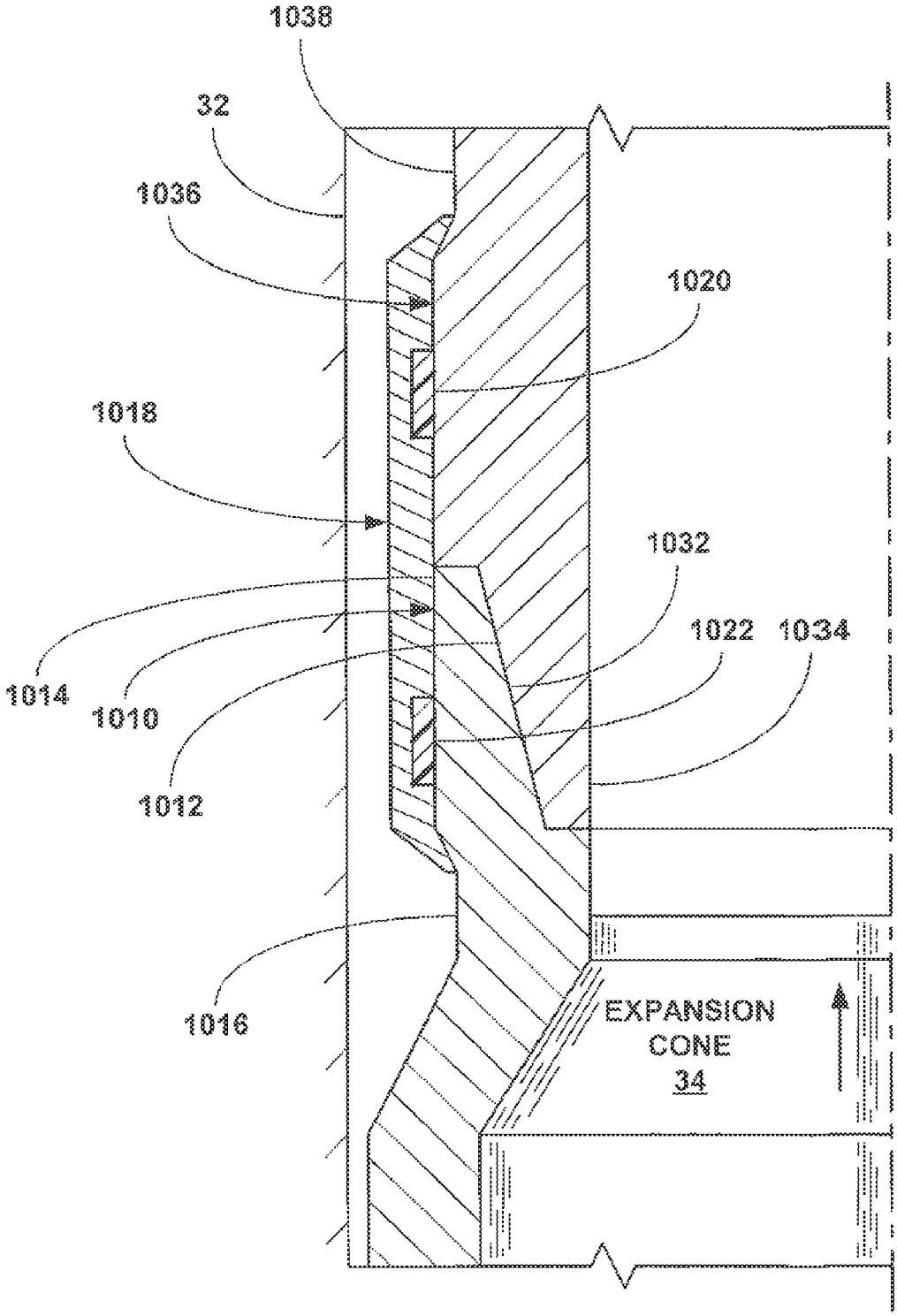
FIG. 8*f* is a fragmentary cross-sectional illustration of the radial expansion and plastic deformation of a portion of the first tubular member of FIG. 8*e*.
Figure 8G:
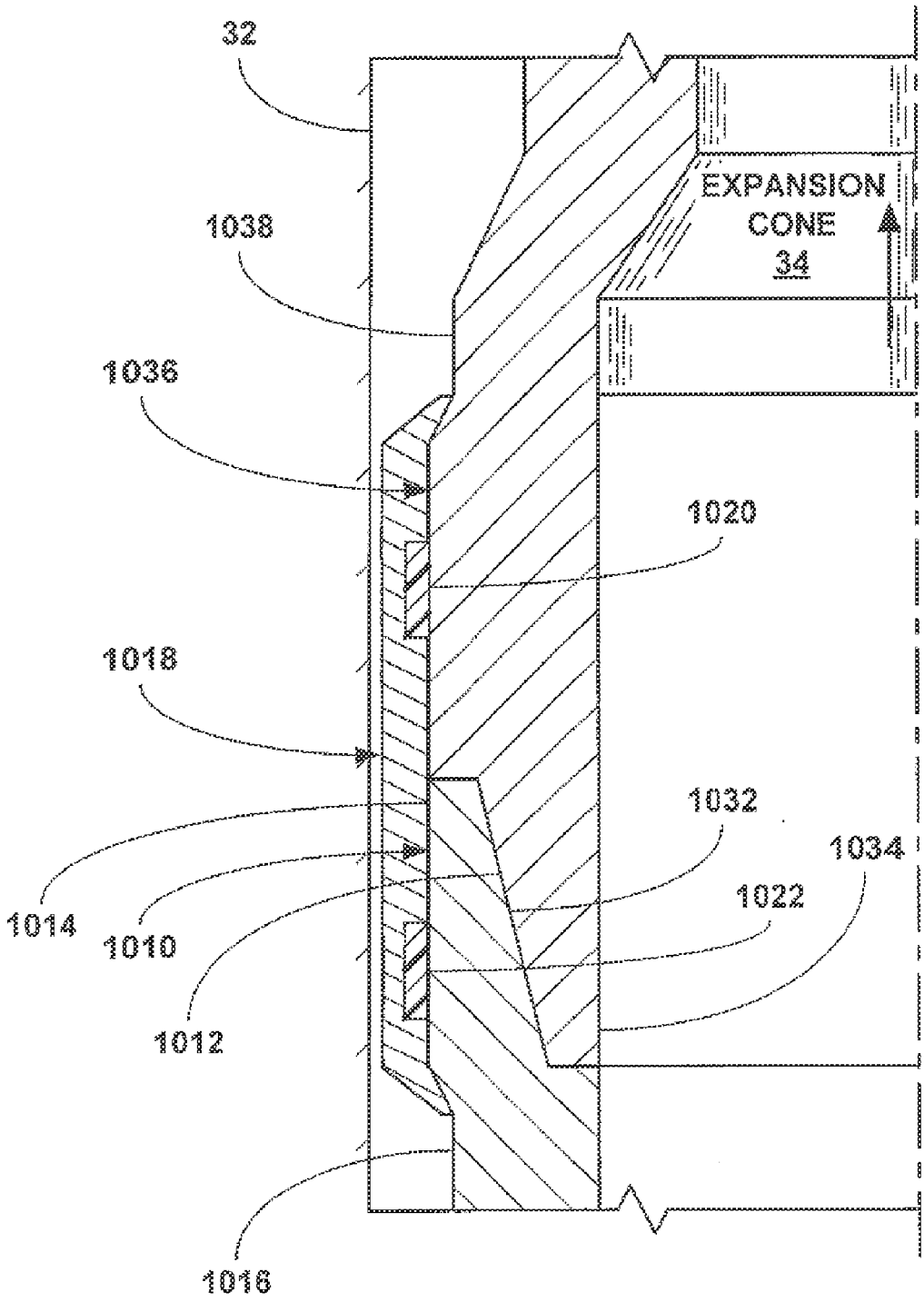
FIG. 8*g* is a fragmentary cross sectional of the continued radial expansion and plastic deformation of the threaded connection between the first and second tubular members and the tubular sleeve of FIG. 8*f*.

In an exemplary embodiment, as illustrated in FIGS. 8*f* and 8*g*, the first and second tubular members, 1010 and 1036, and the tubular sleeve 1018 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1010 and 1036, may be from top to bottom or from bottom to top.

In an exemplary embodiment, during the radial expansion and plastic deformation of the first and second tubular members, 1010 and 1036, the tubular sleeve 1018 is also radially expanded and plastically deformed. In an exemplary embodiment, as a result, the tubular sleeve 1018 may be maintained in circumferential tension and the end portions, 1014 and 1034, of the first and second tubular members, 1010 and 1036, may be maintained in circumferential compression.

The use of the tubular sleeve 1018 during (a) the coupling of the first tubular member 1010 to the second tubular member 1036, (b) the placement of the first and second tubular members in the structure 32, and (c) the radial expansion and plastic deformation of the first and second tubular members provides a number of significant benefits. For example, the tubular sleeve 1018 protects the exterior surfaces of the end portions, 1014 and 1034, of the first and second tubular members, 1010 and 1036, during handling and insertion of the tubular members within the structure 32. In this manner, damage to the exterior surfaces of the end portions, 1014 and 1034, of the first and second tubular members, 1010 and 1036, are prevented that could result in stress concentrations that could result in a catastrophic failure during subsequent radial expansion operations. Furthermore, the tubular sleeve 1018 provides an alignment guide that facilitates the insertion and threaded coupling of the second tubular member 1036 to the first tubular member 1010. In this manner, misalignment that could result in damage to the threaded connections, 1012 and 1032, of the first and second tubular members, 1010 and 1036, may be avoided. Furthermore, the tubular sleeve 1018 may prevent crack propagation during the radial expansion and plastic deformation of the first and second tubular members, 1010 and 1036. In this manner, failure modes such as, for example, longitudinal cracks in the end portions, 1014 and 1034, of the first and second tubular members may be limited in severity or eliminated all together. In addition, after completing the radial expansion and plastic deformation of the first and second tubular members, 1010 and 1036, the tubular sleeve 1018 may provide a fluid tight metal-to-metal seal between interior surface of the tubular sleeve and the exterior surfaces of the end portions, 1014 and 1034, of the first and second tubular members. In this manner, fluidic materials are prevented from passing through the threaded connections, 1012 and 1032, of the first and second tubular members, 1010 and 1036, into the annulus between the first and second tubular members and the structure 32. Furthermore, because, following the radial expansion and plastic deformation of the first and second tubular members, 1010 and 1036, the tubular sleeve 1018 may be maintained in circumferential tension and the end portions, 1014 and 1034, of the first and second tubular members, 1010 and 1036, may be maintained in circumferential compression, axial loads and/or torque loads may be transmitted through the tubular sleeve. In addition, the annular sealing members, 1020 and 1022, of the tubular sleeve 1018 may provide a fluid tight seal between the tubular sleeve and the end portions, 1014 and 1034, of the first and second tubular members, 1010 and 1036.

Figure 9A:
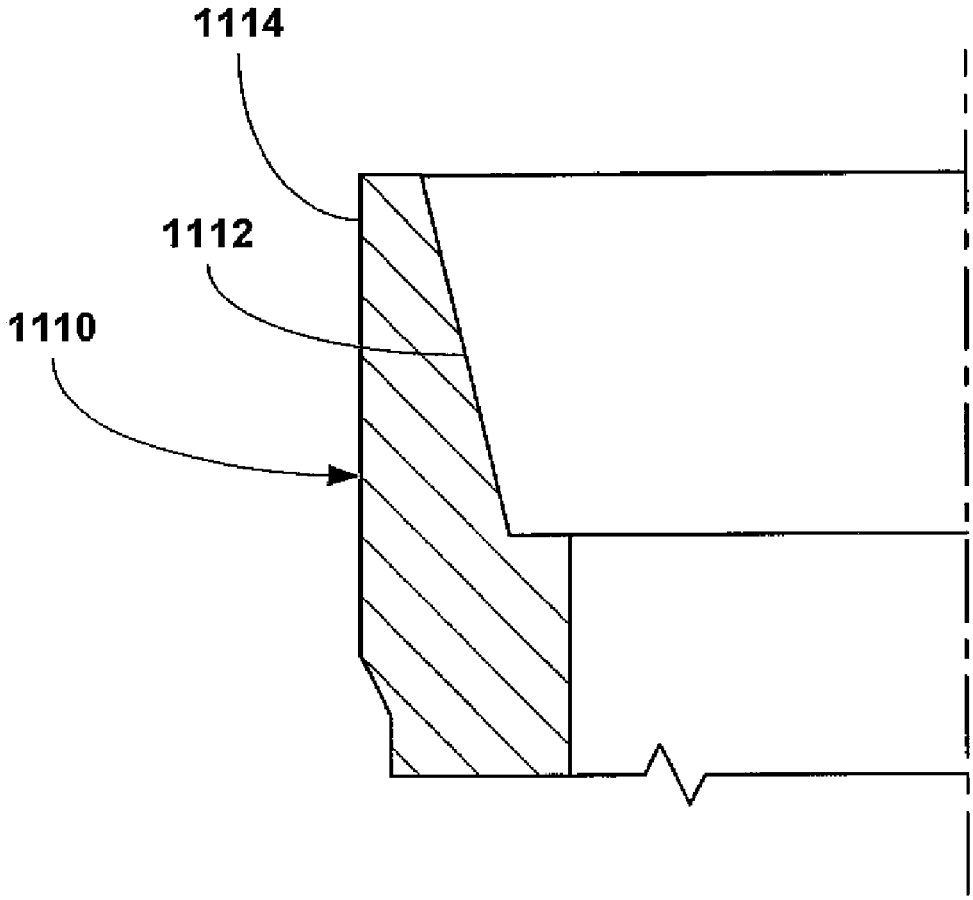
FIG. 9*a* is a fragmentary cross-sectional illustration of a first tubular member having an internally threaded connection at an end portion.
Figure 9B:
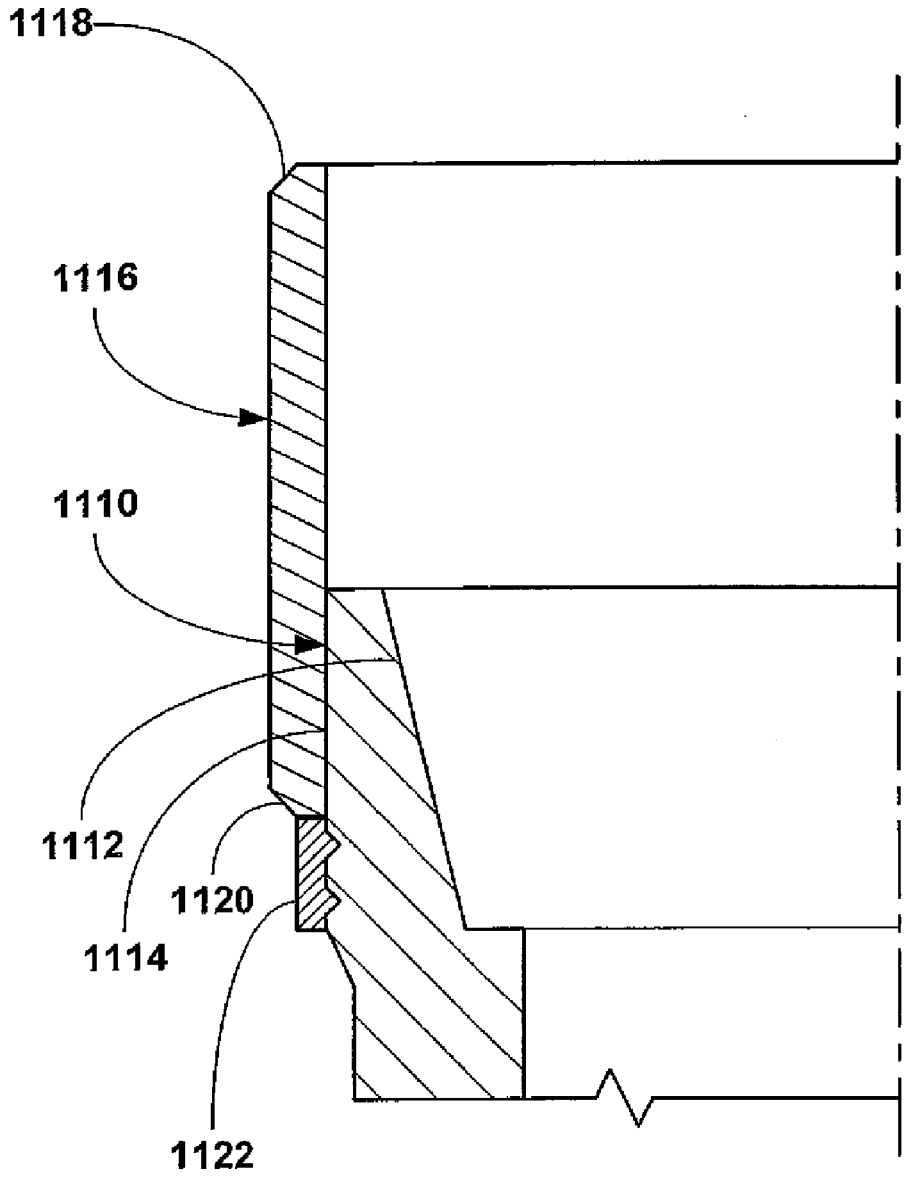
FIG. 9*b* is a fragmentary cross-sectional illustration of the placement of an alternative embodiment of a tubular sleeve onto the end portion of the first tubular member of FIG. 9*a*.

Referring to FIG. 9*a*, a first tubular member 1110 includes an internally threaded connection 1112 at an end portion 1114. As illustrated in FIG. 9*b*, a first end of a tubular sleeve 1116 having tapered portions, 1118 and 1120, at opposite ends, is then mounted upon and receives the end portion 1114 of the first tubular member 1110. In an exemplary embodiment, a toothed resilient retaining ring 1122 is then attached to first tubular member 1010 below the end of the tubular sleeve 1116 in order to couple the tubular sleeve to the first tubular member.

Figure 9C:
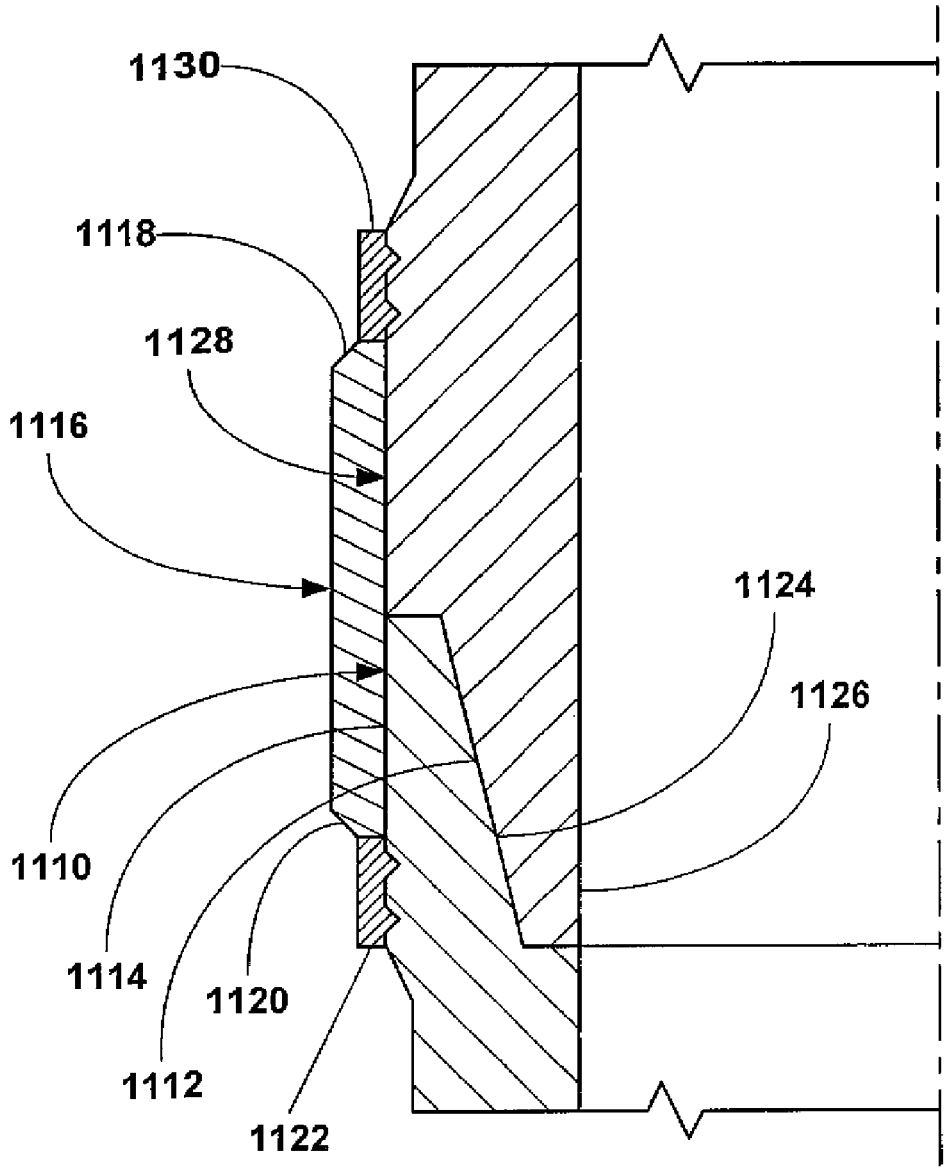
FIG. 9*c* is a fragmentary cross-sectional illustration of the coupling of an externally threaded connection at an end portion of a second tubular member to the internally threaded connection at the end portion of the first tubular member of FIG. 9*b*.

As illustrated in FIG. 9*c*, an externally threaded connection 1124 of an end portion 1126 of a second tubular member 1128 is then positioned within the tubular sleeve 1116 and threadably coupled to the internally threaded connection 1112 of the end portion 1114 of the first tubular member 1110. In an exemplary embodiment, a toothed resilient retaining ring 1130 is then attached to second tubular member 1128 above the end of the tubular sleeve 1116 in order to couple the tubular sleeve to the second tubular member.

In an exemplary embodiment, the internally threaded connection 1112 of the end portion 1114 of the first tubular member 1110 is a box connection, and the externally threaded connection 1124 of the end portion 1126 of the second tubular member 1128 is a pin connection. In an exemplary embodiment, the internal diameter of the tubular sleeve 1116 is at least approximately 0.020" greater than the outside diameters of the end portions, 1114 and 1126, of the first and second tubular members, 1110 and 1128. In this manner, during the threaded coupling of the first and second tubular members, 1110 and 1128, fluidic materials within the first and second tubular members may be vented from the tubular members.

Figure 9D:
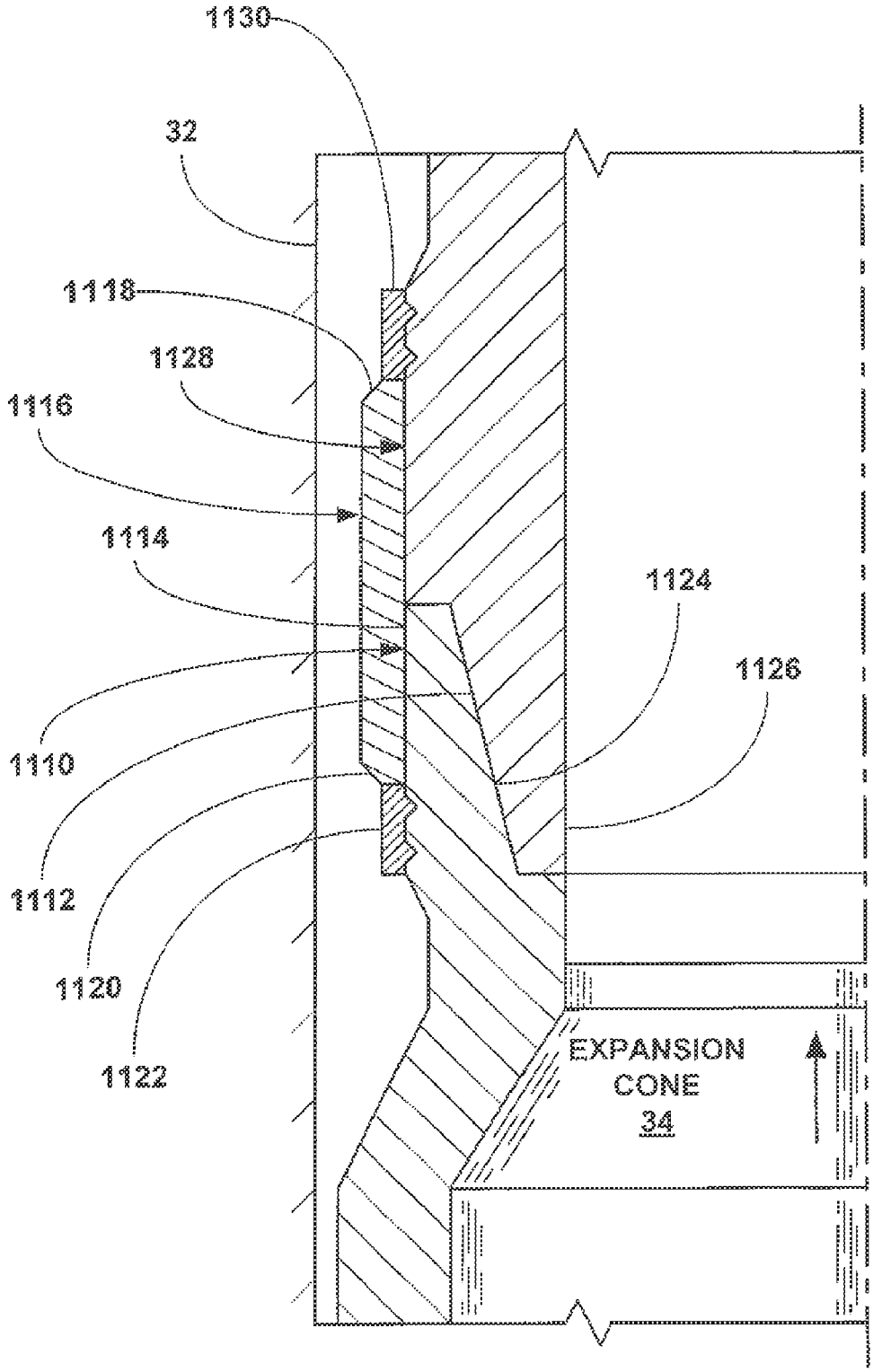
FIG. 9*d* is a fragmentary cross-sectional illustration of the radial expansion and plastic deformation of a portion of the first tubular member of FIG. 9*c*.
Figure 9E:
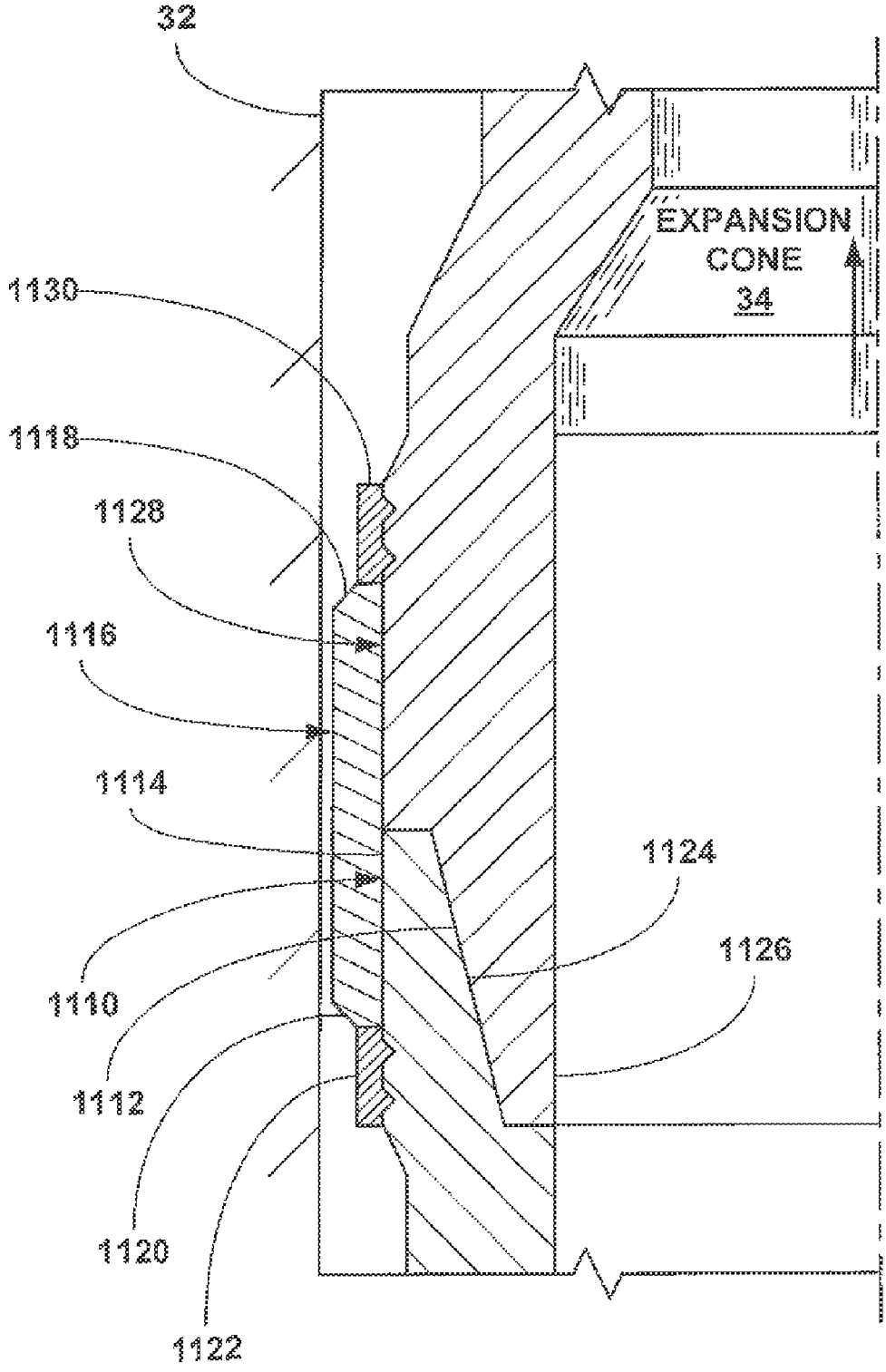
FIG. 9*e* is a fragmentary cross sectional of the continued radial expansion and plastic deformation of the threaded connection between the first and second tubular members and the tubular sleeve of FIG. 9*d*.

In an exemplary embodiment, as illustrated in FIGS. 9*d* and 9*e*, the first and second tubular members, 1110 and 1128, and the tubular sleeve 1116 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1110 and 1128, may be from top to bottom or from bottom to top.

In an exemplary embodiment, during the radial expansion and plastic deformation of the first and second tubular members, 1110 and 1128, the tubular sleeve 1116 is also radially expanded and plastically deformed. In an exemplary embodiment, as a result, the tubular sleeve 1116 may be maintained in circumferential tension and the end portions, 1114 and 1126, of the first and second tubular members, 1110 and 1128, may be maintained in circumferential compression.

The use of the tubular sleeve 1116 during (a) the coupling of the first tubular member 1110 to the second tubular member 1128, (b) the placement of the first and second tubular members in the structure 32, and (c) the radial expansion and plastic deformation of the first and second tubular members provides a number of significant benefits. For example, the tubular sleeve 1116 protects the exterior surfaces of the end portions, 1114 and 1126, of the first and second tubular members, 1110 and 1128, during handling and insertion of the tubular members within the structure 32. In this manner, damage to the exterior surfaces of the end portions, 1114 and 1126, of the first and second tubular members, 1110 and 1128, are prevented that could result in stress concentrations that could result in a catastrophic failure during subsequent radial expansion operations. Furthermore, the tubular sleeve 1116 provides an alignment guide that facilitates the insertion and threaded coupling of the second tubular member 1128 to the first tubular member 1110. In this manner, misalignment that could result in damage to the threaded connections, 1112 and 1124, of the first and second tubular members, 1110 and 1128, may be avoided. Furthermore, the tubular sleeve 1116 may prevent crack propagation during the radial expansion and plastic deformation of the first and second tubular members, 1110 and 1128. In this manner, failure modes such as, for example, longitudinal cracks in the end portions, 1114 and 1126, of the first and second tubular members may be limited in severity or eliminated all together. In addition, after completing the radial expansion and plastic deformation of the first and second tubular members, 1110 and 1128, the tubular sleeve 1116 may provide a fluid tight metal-to-metal seal between interior surface of the tubular sleeve and the exterior surfaces of the end portions, 1114 and 1128, of the first and second tubular members. In this manner, fluidic materials are prevented from passing through the threaded connections, 1112 and 1124, of the first and second tubular members, 1110 and 1128, into the annulus between the first and second tubular members and the structure 32. Furthermore, because, following the radial expansion and plastic deformation of the first and second tubular members, 1110 and 1128, the tubular sleeve 1116 may be maintained in circumferential tension and the end portions, 1114 and 1126, of the first and second tubular members, 1110 and 1128, may be maintained in circumferential compression, axial loads and/or torque loads may be transmitted through the tubular sleeve.

Figure 10A:
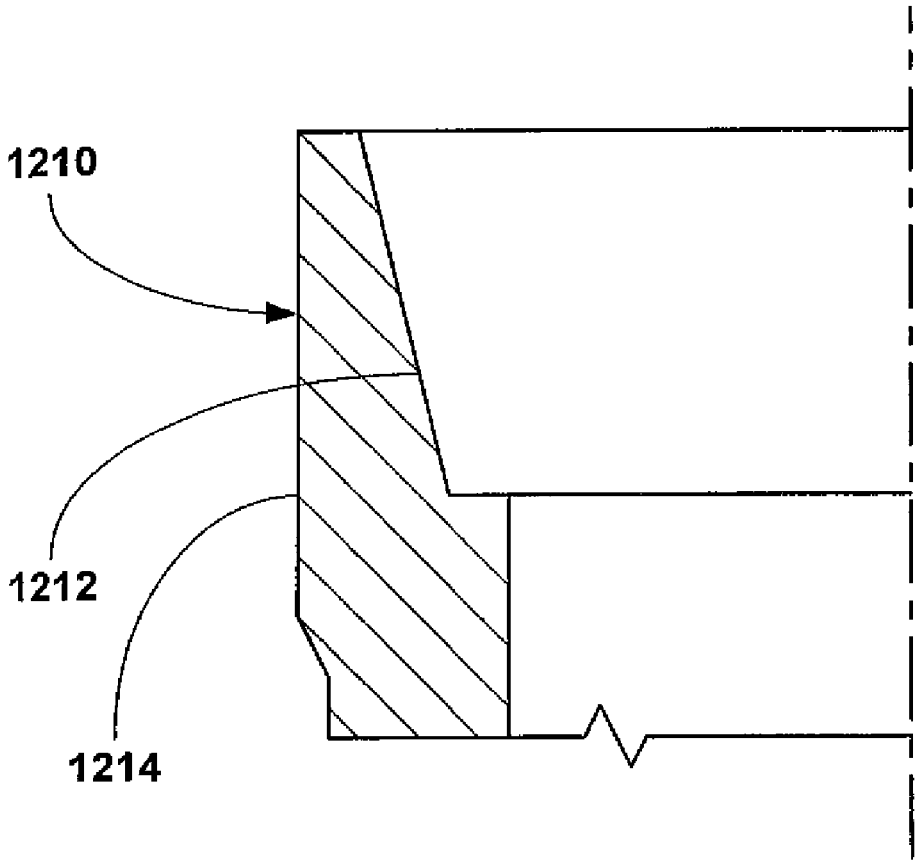
FIG. 10*a* is a fragmentary cross-sectional illustration of a first tubular member having an internally threaded connection at an end portion.
Figure 10B:
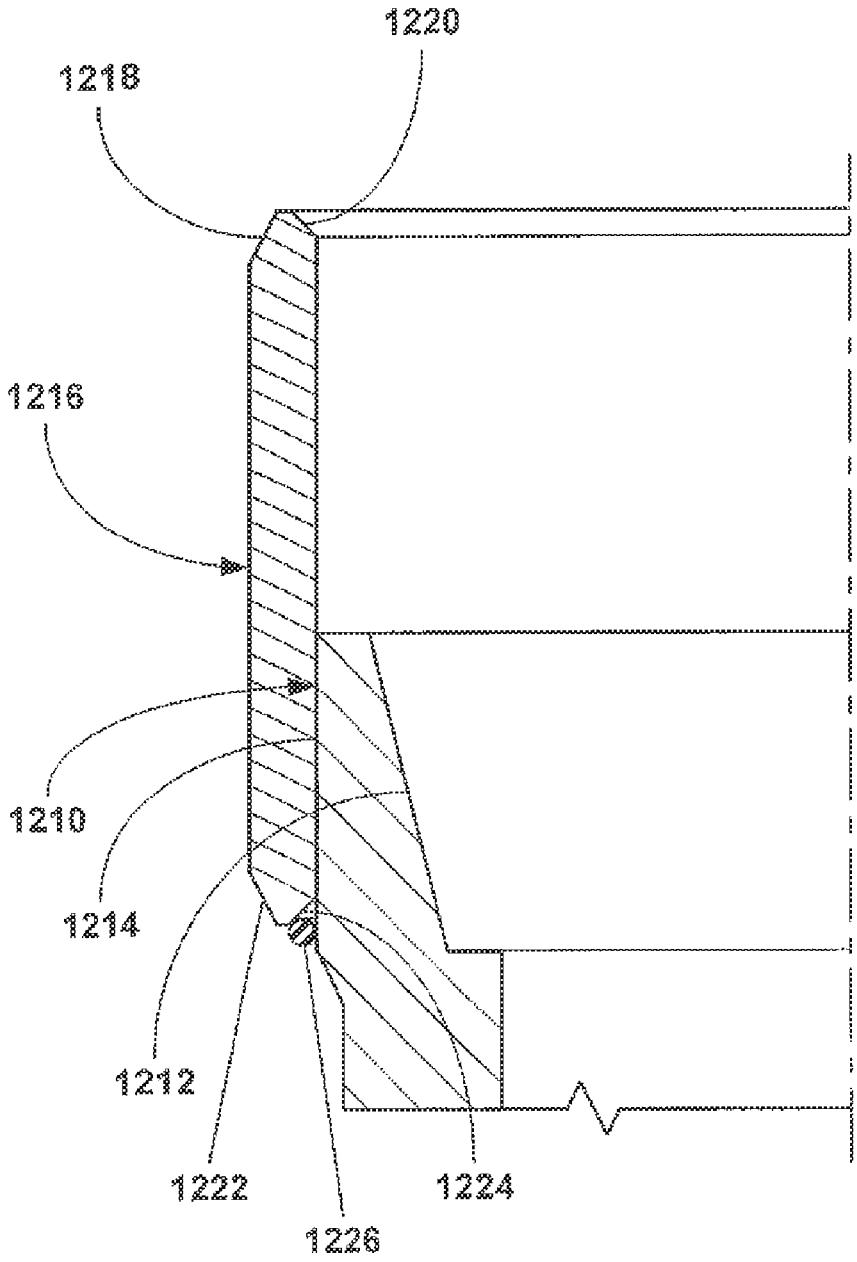
FIG. 10*b* is a fragmentary cross-sectional illustration of the placement of an alternative embodiment of a tubular sleeve onto the end portion of the first tubular member of FIG. 10*a*.

Referring to FIG. 10*a*, a first tubular member 1210 includes an internally threaded connection 1212 at an end portion 1214. As illustrated in FIG. 10*b*, a first end of a tubular sleeve 1216 having tapered portions, 1218 and 1220, at one end and tapered portions, 1222 and 1224, at another end, is then mounted upon and receives the end portion 1114 of the first tubular member 1110. In an exemplary embodiment, a resilient elastomeric O-ring 1226 is then positioned on the first tubular member 1210 below the tapered portion 1224 of the tubular sleeve 1216 in order to couple the tubular sleeve to the first tubular member.

Figure 10C:
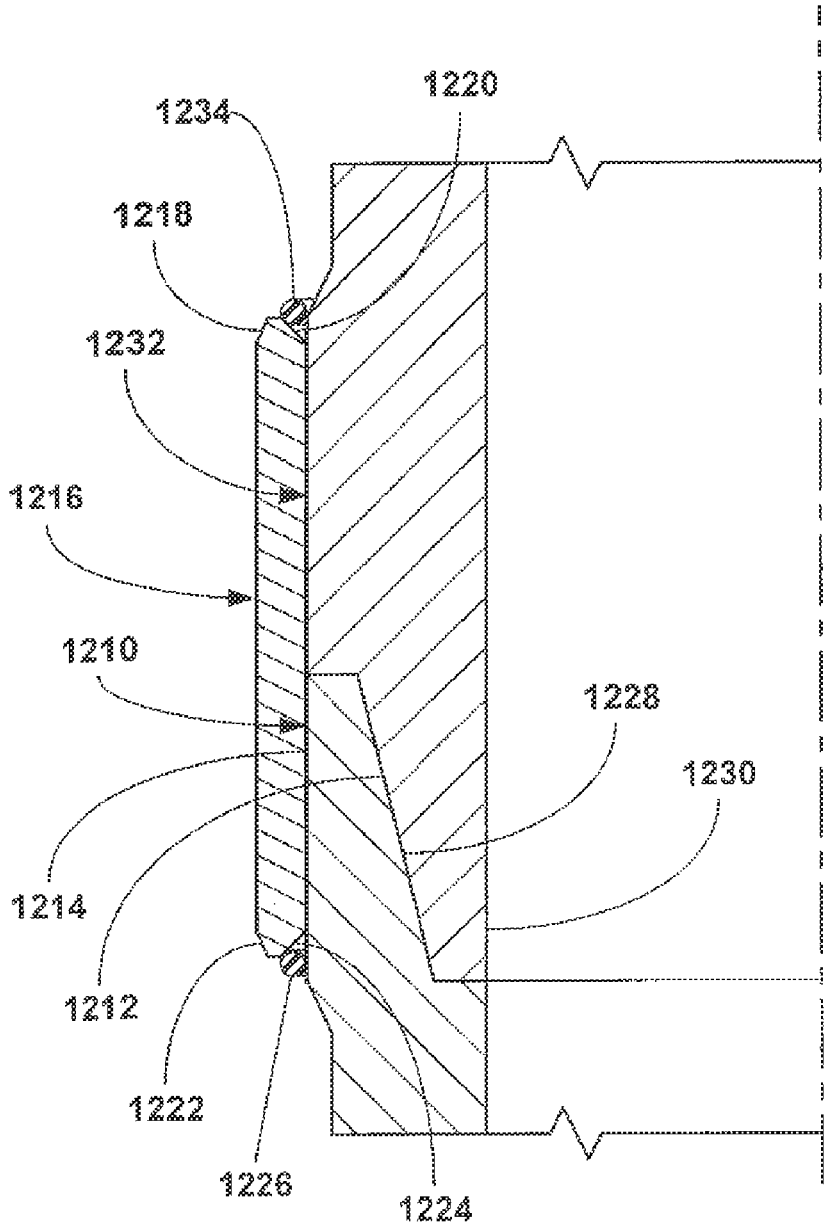
FIG. 10*c* is a fragmentary cross-sectional illustration of the coupling of an externally threaded connection at an end portion of a second tubular member to the internally threaded connection at the end portion of the first tubular member of FIG. 10*b*.

As illustrated in FIG. 10*c*, an externally threaded connection 1228 of an end portion 1230 of a second tubular member 1232 is then positioned within the tubular sleeve 1216 and threadably coupled to the internally threaded connection 1212 of the end portion 1214 of the first tubular member 1210. In an exemplary embodiment, a resilient elastomeric O-ring 1234 is then positioned on the second tubular member 1232 below the tapered portion 1220 of the tubular sleeve 1216 in order to couple the tubular sleeve to the first tubular member.

In an exemplary embodiment, the internally threaded connection 1212 of the end portion 1214 of the first tubular member 1210 is a box connection, and the externally threaded connection 1228 of the end portion 1230 of the second tubular member 1232 is a pin connection. In an exemplary embodiment, the internal diameter of the tubular sleeve 1216 is at least approximately 0.020" greater than the outside diameters of the end portions, 1214 and 1230, of the first and second tubular members, 1210 and 1232. In this manner, during the threaded coupling of the first and second tubular members, 1210 and 1232, fluidic materials within the first and second tubular members may be vented from the tubular members.

Figure 10D:
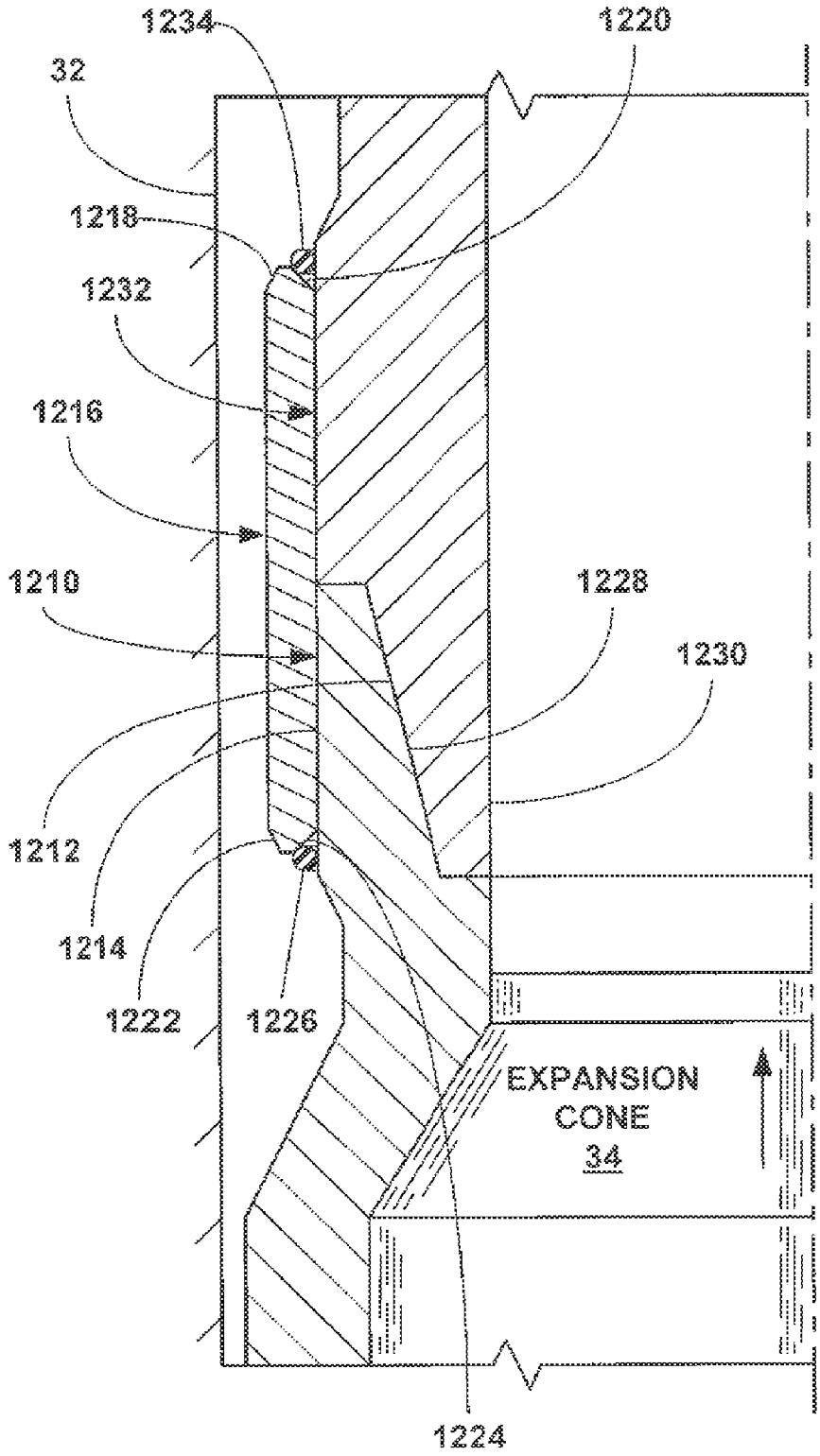
FIG. 10*d* is a fragmentary cross-sectional illustration of the radial expansion and plastic deformation of a portion of the first tubular member of FIG. 10*c*.
Figure 10E:
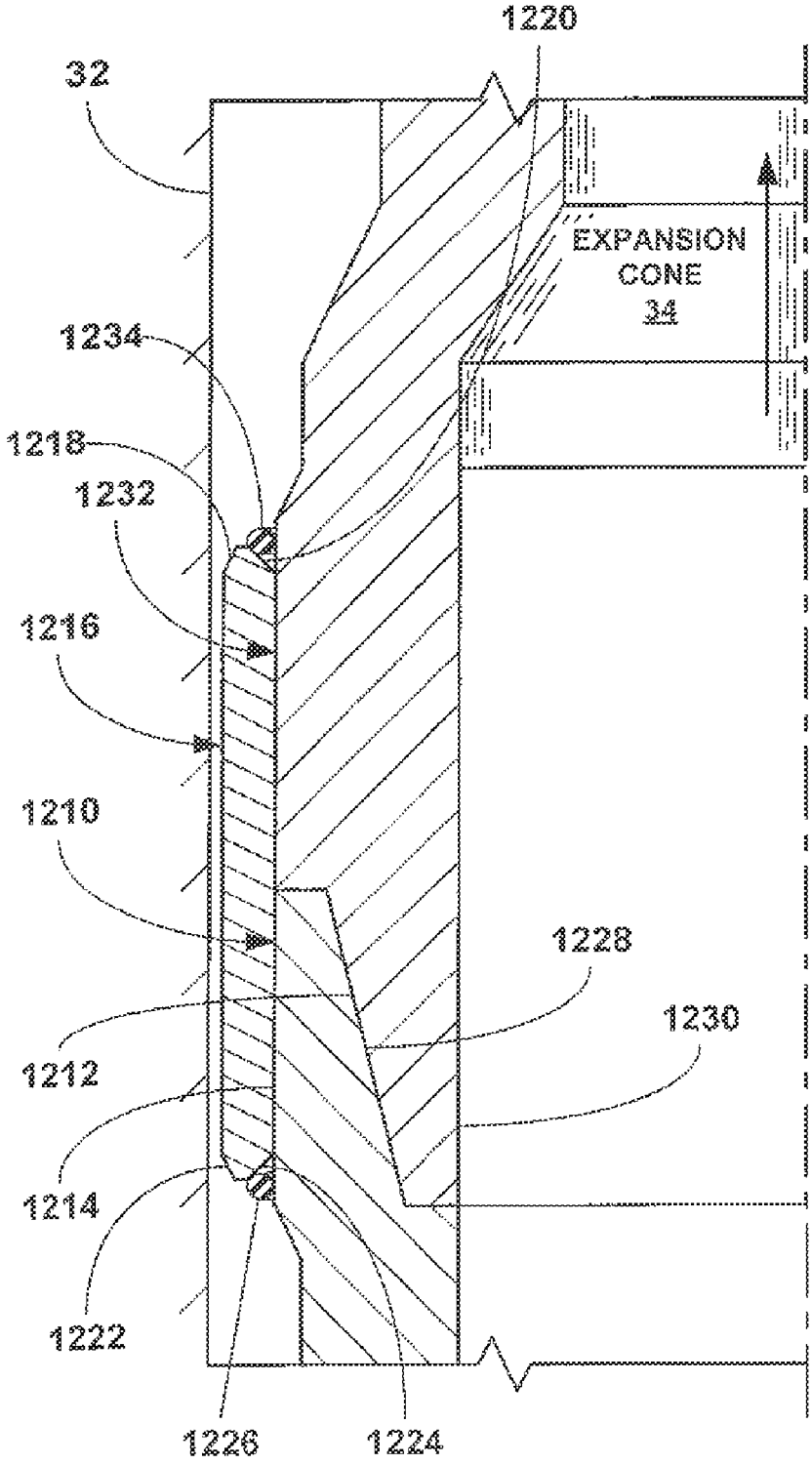
FIG. 10*e* is a fragmentary cross sectional of the continued radial expansion and plastic deformation of the threaded connection between the first and second tubular members and the tubular sleeve of FIG. 10*d*.

In an exemplary embodiment, as illustrated in FIGS. 10*d* and 10*e*, the first and second tubular members, 1210 and 1232, and the tubular sleeve 1216 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1210 and 1232, may be from top to bottom or from bottom to top.

In an exemplary embodiment, during the radial expansion and plastic deformation of the first and second tubular members, 1210 and 1232, the tubular sleeve 1216 is also radially expanded and plastically deformed. In an exemplary embodiment, as a result, the tubular sleeve 1216 may be maintained in circumferential tension and the end portions, 1214 and 1230, of the first and second tubular members, 1210 and 1232, may be maintained in circumferential compression.

The use of the tubular sleeve 1216 during (a) the coupling of the first tubular member 1210 to the second tubular member 1232, (b) the placement of the first and second tubular members in the structure 32, and (c) the radial expansion and plastic deformation of the first and second tubular members provides a number of significant benefits. For example, the tubular sleeve 1216 protects the exterior surfaces of the end portions, 1214 and 1230, of the first and second tubular members, 1210 and 1232, during handling and insertion of the tubular members within the structure 32. In this manner, damage to the exterior surfaces of the end portions, 1214 and 1230, of the first and second tubular members, 1210 and 1232, are prevented that could result in stress concentrations that could result in a catastrophic failure during subsequent radial expansion operations. Furthermore, the tubular sleeve 1216 provides an alignment guide that facilitates the insertion and threaded coupling of the second tubular member 1232 to the first tubular member 1210. In this manner, misalignment that could result in damage to the threaded connections, 1212 and 1228, of the first and second tubular members, 1210 and 1232, may be avoided. Furthermore, the tubular sleeve 1216 may prevent crack propagation during the radial expansion and plastic deformation of the first and second tubular members, 1210 and 1232. In this manner, failure modes such as, for example, longitudinal cracks in the end portions, 1214 and 1230, of the first and second tubular members may be limited in severity or eliminated all together. In addition, after completing the radial expansion and plastic deformation of the first and second tubular members, 1210 and 1232, the tubular sleeve 1216 may provide a fluid tight metal-to-metal seal between interior surface of the tubular sleeve and the exterior surfaces of the end portions, 1214 and 1230, of the first and second tubular members. In this manner, fluidic materials are prevented from passing through the threaded connections, 1212 and 1228, of the first and second tubular members, 1210 and 1232, into the annulus between the first and second tubular members and the structure 32. Furthermore, because, following the radial expansion and plastic deformation of the first and second tubular members, 1210 and 1232, the tubular sleeve 1216 may be maintained in circumferential tension and the end portions, 1214 and 1230, of the first and second tubular members, 1210 and 1232, may be maintained in circumferential compression, axial loads and/or torque loads may be transmitted through the tubular sleeve.

Figure 11A:
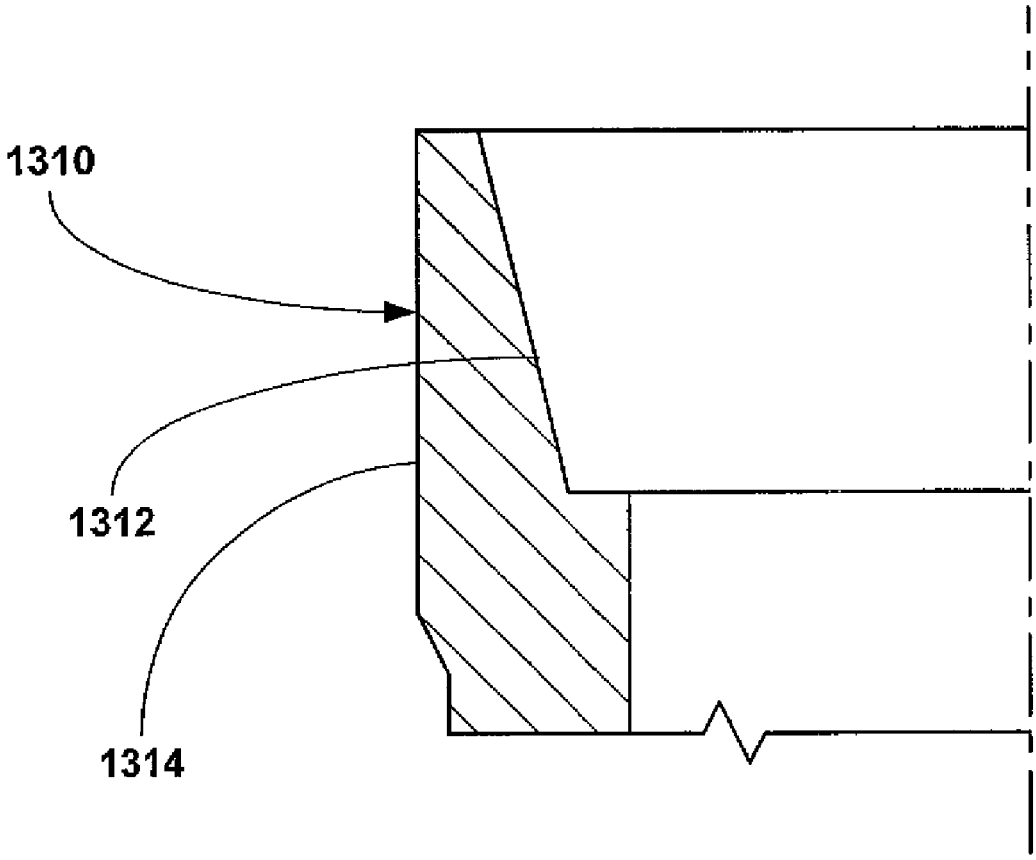
FIG. 11*a* is a fragmentary cross-sectional illustration of a first tubular member having an internally threaded connection at an end portion.
Figure 11B:
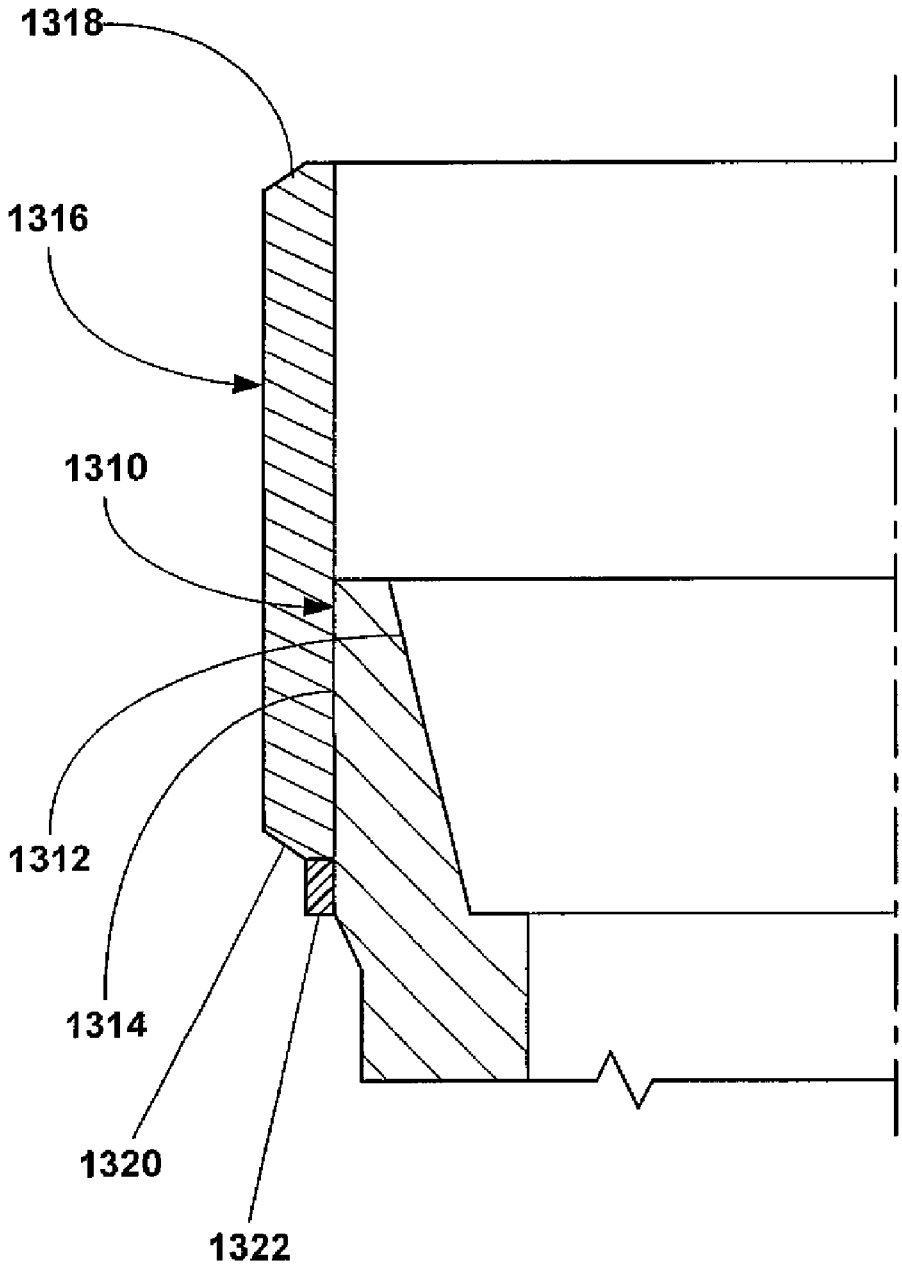
FIG. 11*b* is a fragmentary cross-sectional illustration of the placement of an alternative embodiment of a tubular sleeve onto the end portion of the first tubular member of FIG. 11*a*.

Referring to FIG. 11*a*, a first tubular member 1310 includes an internally threaded connection 1312 at an end portion 1314. As illustrated in FIG. 11*b*, a first end of a tubular sleeve 1316 having tapered portions, 1318 and 1320, at opposite ends is then mounted upon and receives the end portion 1314 of the first tubular member 1310. In an exemplary embodiment, an annular resilient retaining member 1322 is then positioned on the first tubular member 1310 below the bottom end of the tubular sleeve 1316 in order to couple the tubular sleeve to the first tubular member.

Figure 11C:
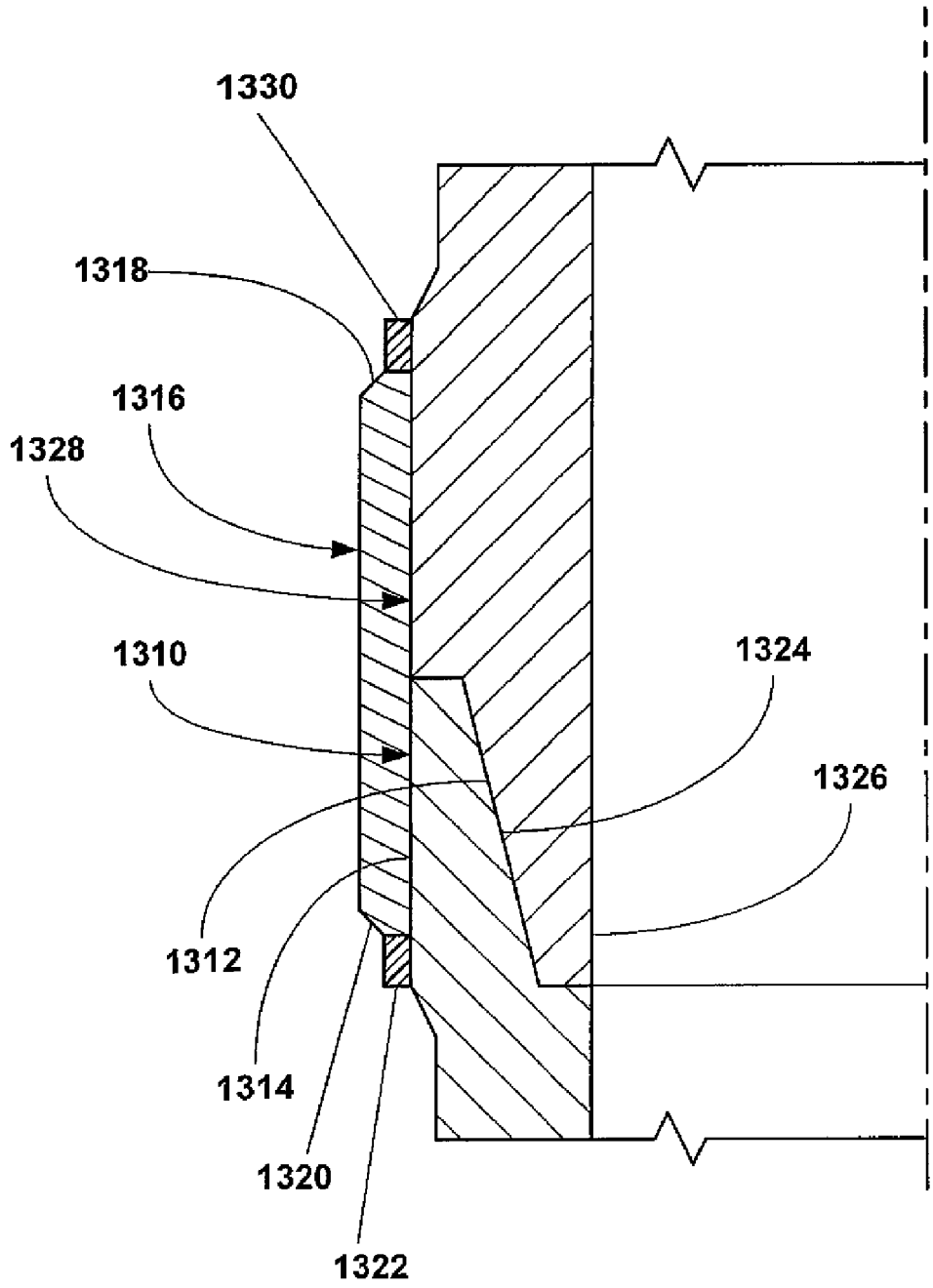
FIG. 11*c* is a fragmentary cross-sectional illustration of the coupling of an externally threaded connection at an end portion of a second tubular member to the internally threaded connection at the end portion of the first tubular member of FIG. 11*b*.

As illustrated in FIG. 11*c*, an externally threaded connection 1324 of an end portion 1326 of a second tubular member 1328 is then positioned within the tubular sleeve 1316 and threadably coupled to the internally threaded connection 1312 of the end portion 1314 of the first tubular member 1310. In an exemplary embodiment, an annular resilient retaining member 1330 is then positioned on the second tubular member 1328 above the top end of the tubular sleeve 1316 in order to couple the tubular sleeve to the second tubular member.

In an exemplary embodiment, the internally threaded connection 1312 of the end portion 1314 of the first tubular member 1310 is a box connection, and the externally threaded connection 1324 of the end portion 1326 of the second tubular member 1328 is a pin connection. In an exemplary embodiment, the internal diameter of the tubular sleeve 1316 is at least approximately 0.020" greater than the outside diameters of the end portions, 1314 and 1326, of the first and second tubular members, 1310 and 1328. In this manner, during the threaded coupling of the first and second tubular members, 1310 and 1328, fluidic materials within the first and second tubular members may be vented from the tubular members.

Figure 11D:
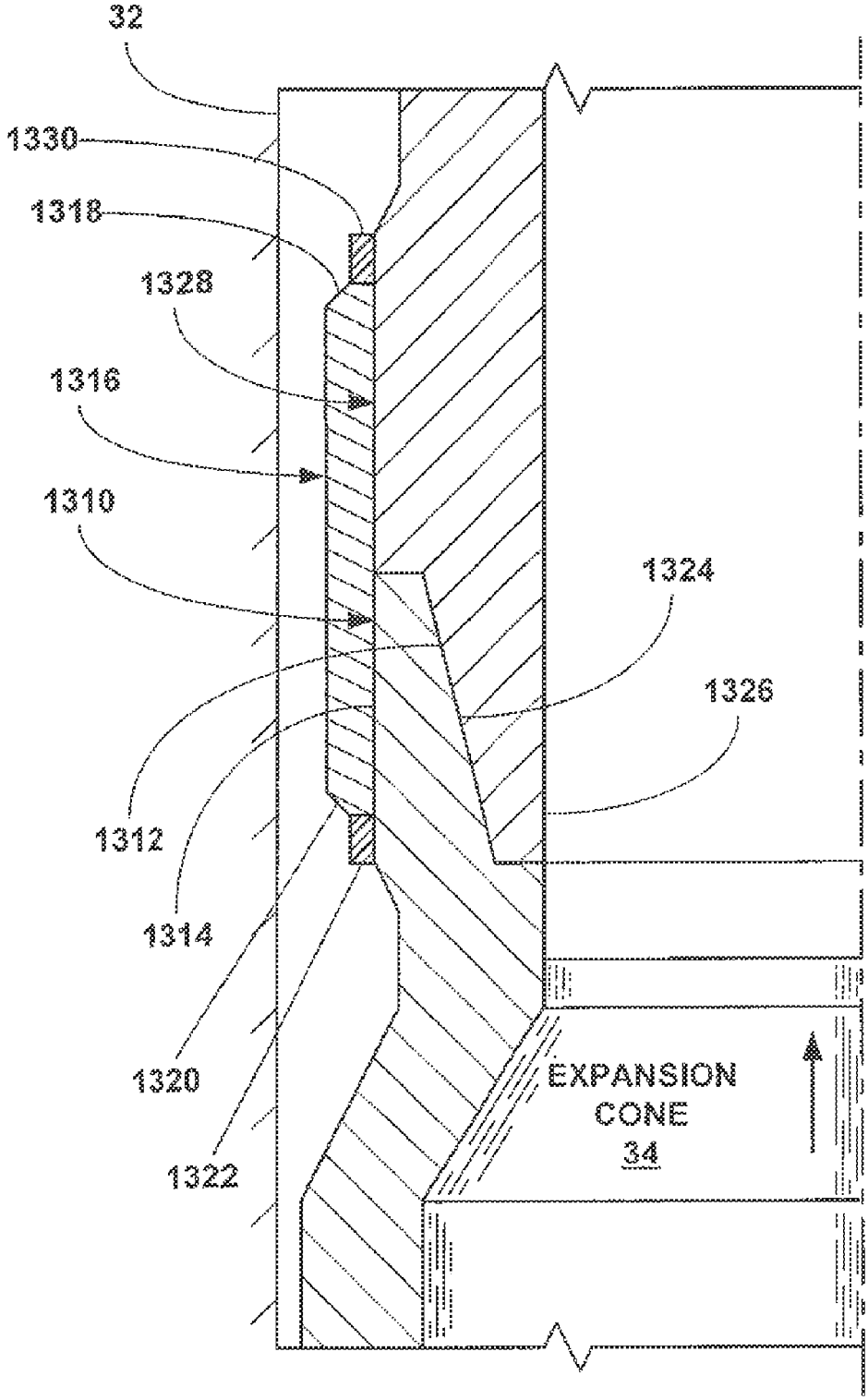
FIG. 11*d* is a fragmentary cross-sectional illustration of the radial expansion and plastic deformation of a portion of the first tubular member of FIG. 11*c*.
Figure 11E:
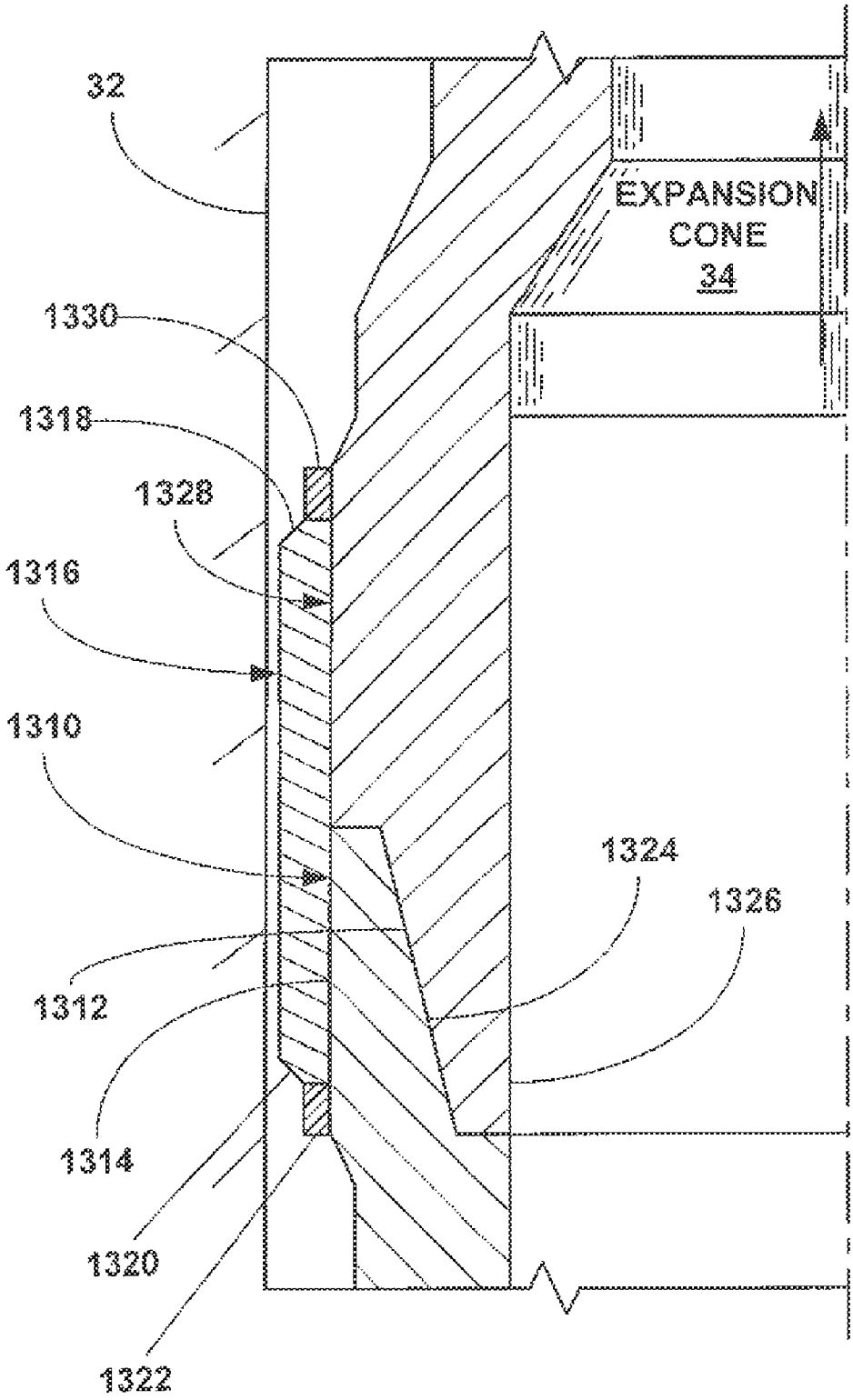
FIG. 11*e* is a fragmentary cross sectional of the continued radial expansion and plastic deformation of the threaded connection between the first and second tubular members and the tubular sleeve of FIG. 11*d*.

In an exemplary embodiment, as illustrated in FIGS. 11*d* and 11*e*, the first and second tubular members, 1310 and 1328, and the tubular sleeve 1316 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1310 and 1328, may be from top to bottom or from bottom to top.

In an exemplary embodiment, during the radial expansion and plastic deformation of the first and second tubular members, 1310 and 1328, the tubular sleeve 1316 is also radially expanded and plastically deformed. In an exemplary embodiment, as a result, the tubular sleeve 1316 may be maintained in circumferential tension and the end portions, 1314 and 1326, of the first and second tubular members, 1310 and 1328, may be maintained in circumferential compression.

The use of the tubular sleeve 1316 during (a) the coupling of the first tubular member 1310 to the second tubular member 1328, (b) the placement of the first and second tubular members in the structure 32, and (c) the radial expansion and plastic deformation of the first and second tubular members provides a number of significant benefits. For example, the tubular sleeve 1316 protects the exterior surfaces of the end portions, 1314 and 1326, of the first and second tubular members, 1310 and 1328, during handling and insertion of the tubular members within the structure 32. In this manner, damage to the exterior surfaces of the end portions, 1314 and 1326, of the first and second tubular members, 1310 and 1328, are prevented that could result in stress concentrations that could result in a catastrophic failure during subsequent radial expansion operations. Furthermore, the tubular sleeve 1316 provides an alignment guide that facilitates the insertion and threaded coupling of the second tubular member 1328 to the first tubular member 1310. In this manner, misalignment that could result in damage to the threaded connections, 1312 and 1324, of the first and second tubular members, 1310 and 1328, may be avoided. Furthermore, the tubular sleeve 1316 may prevent crack propagation during the radial expansion and plastic deformation of the first and second tubular members, 1310 and 1328. In this manner, failure modes such as, for example, longitudinal cracks in the end portions, 1314 and 1326, of the first and second tubular members may be limited in severity or eliminated all together. In addition, after completing the radial expansion and plastic deformation of the first and second tubular members, 1310 and 1328, the tubular sleeve 1316 may provide a fluid tight metal-to-metal seal between interior surface of the tubular sleeve and the exterior surfaces of the end portions, 1314 and 1326, of the first and second tubular members. In this manner, fluidic materials are prevented from passing through the threaded connections, 1312 and 1324, of the first and second tubular members, 1310 and 1328, into the annulus between the first and second tubular members and the structure 32. Furthermore, because, following the radial expansion and plastic deformation of the first and second tubular members, 1310 and 1328, the tubular sleeve 1316 may be maintained in circumferential tension and the end portions, 1314 and 1326, of the first and second tubular members, 1310 and 1328, may be maintained in circumferential compression, axial loads and/or torque loads may be transmitted through the tubular sleeve.

Figure 12A:
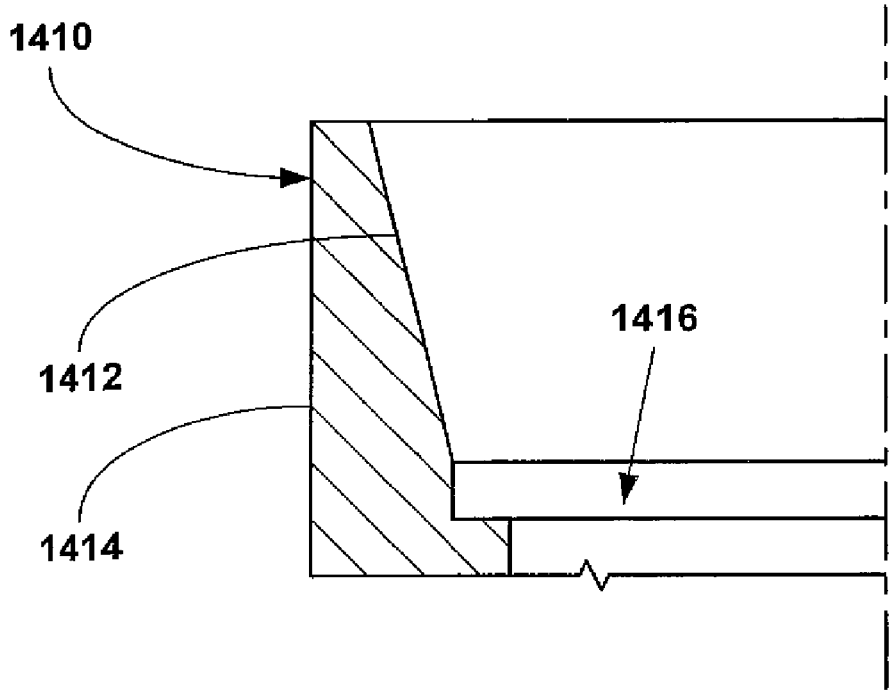
FIG. 12*a* is a fragmentary cross-sectional illustration of a first tubular member having an internally threaded connection at an end portion.
Figure 12B:
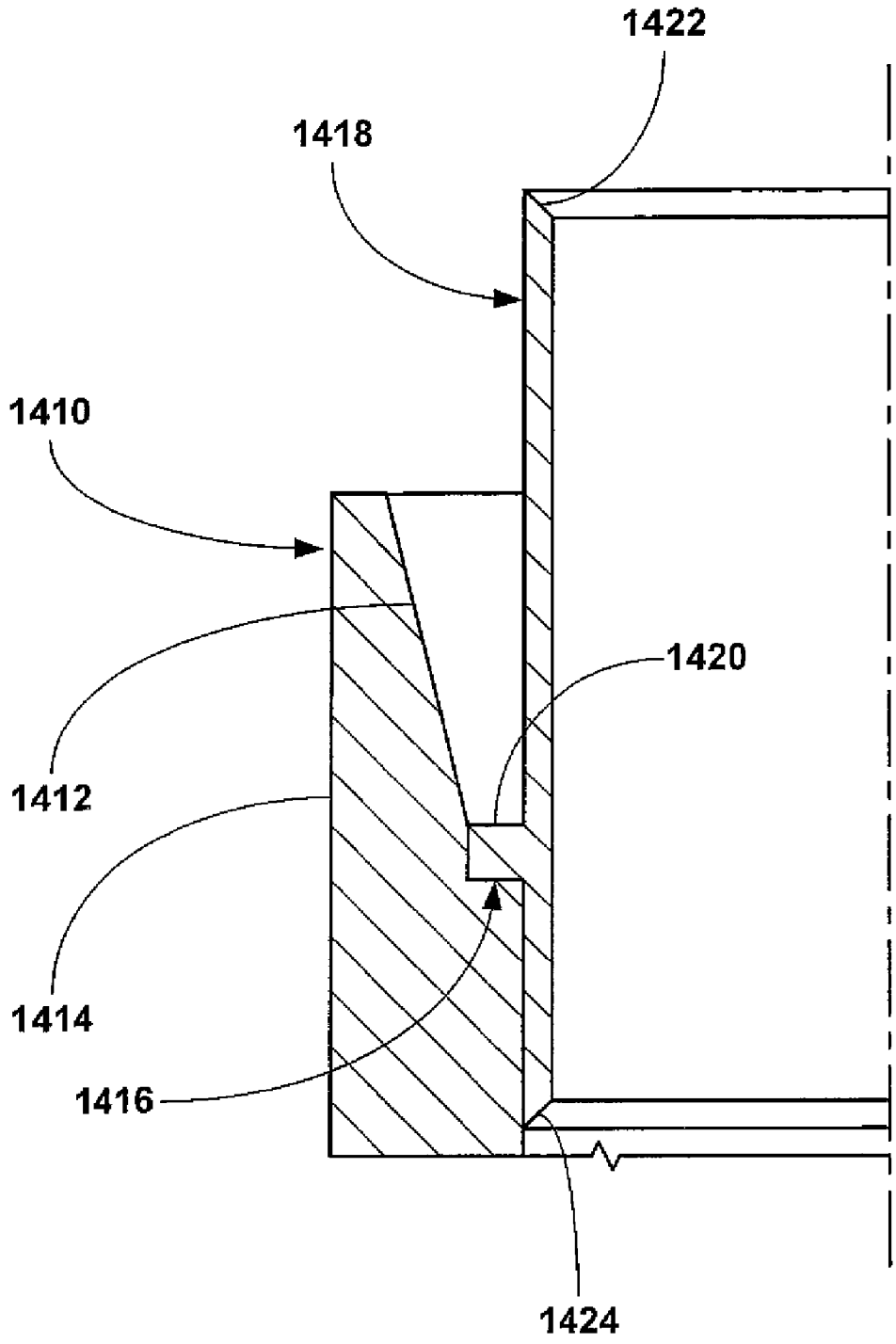
FIG. 12*b* is a fragmentary cross-sectional illustration of the placement of an alternative embodiment of a tubular sleeve onto the end portion of the first tubular member of FIG. 12*a*.
Figure 12C:
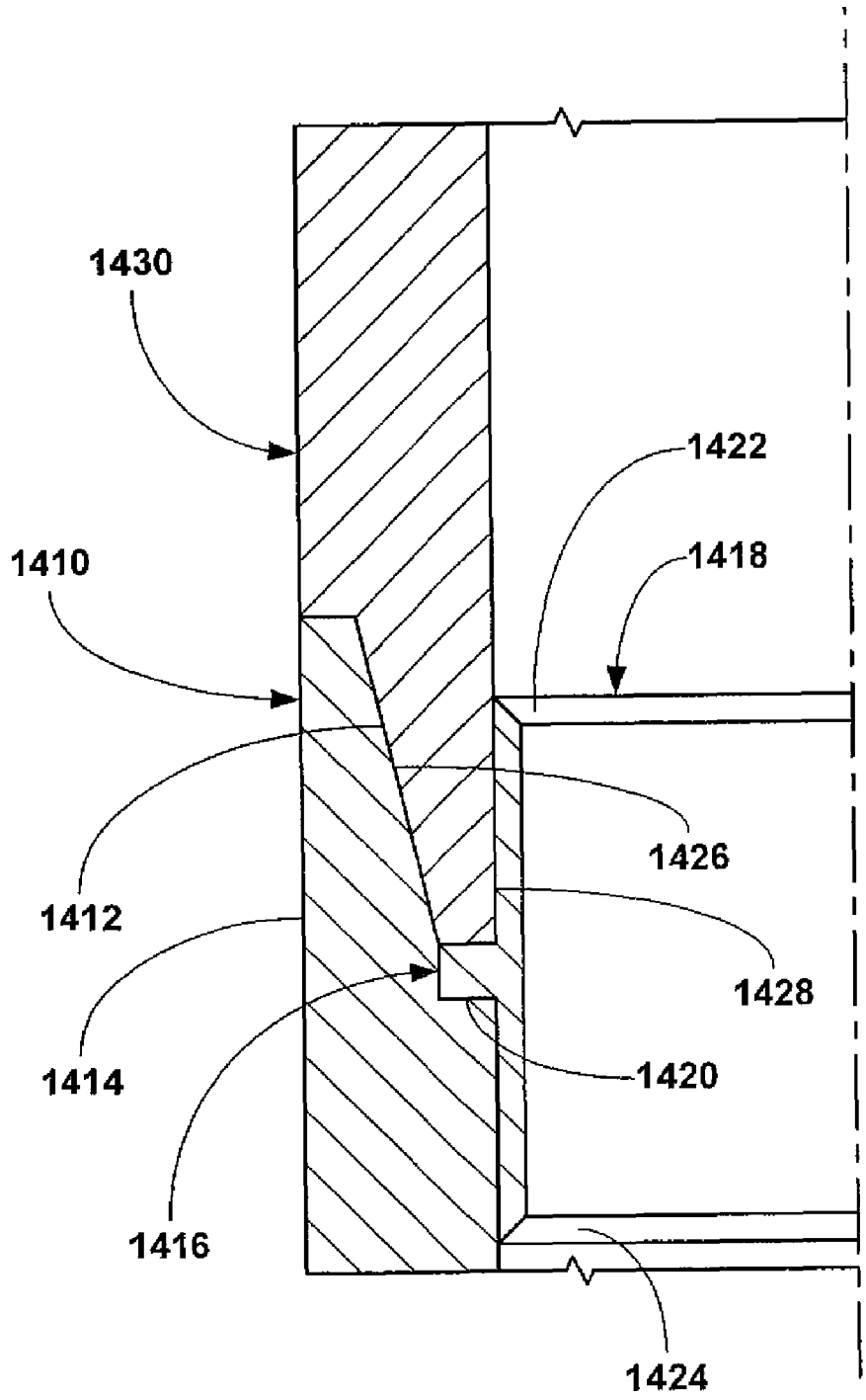
FIG. 12*c* is a fragmentary cross-sectional illustration of the coupling of an externally threaded connection at an end portion of a second tubular member to the internally threaded connection at the end portion of the first tubular member of FIG. 12*b*.

Referring to FIG. 12*a*, a first tubular member 1410 includes an internally threaded connection 1412 and an annular recess 1416 at an end portion 1414. As illustrated in FIG. 12*b*, a first end of a tubular sleeve 1418 that includes an external flange 1420 and tapered portions, 1422 and 1424, at opposite ends is then mounted within the end portion 1414 of the first tubular member 1410. In an exemplary embodiment, the external flange 1420 of the tubular sleeve 1418 is received within and is supported by the annular recess 1416 of the end portion 1414 of the first tubular member 1410. As illustrated in FIG. 12*c*, an externally threaded connection 1426 of an end portion 1428 of a second tubular member 1430 is then positioned around a second end of the tubular sleeve 1418 and threadably coupled to the internally threaded connection 1412 of the end portion 1414 of the first tubular member 1410. In an exemplary embodiment, the external flange 1420 of the tubular sleeve 1418 mates with and is received within the annular recess 1416 of the end portion 1414 of the first tubular member 1410, and the external flange of the tubular sleeve is retained in the annular recess by the end portion 1428 of the second tubular member 1430. Thus, the tubular sleeve 1418 is coupled to and is surrounded by the internal surfaces of the first and second tubular members, 1410 and 1430.

In an exemplary embodiment, the internally threaded connection 1412 of the end portion 1414 of the first tubular member 1410 is a box connection, and the externally threaded connection 1426 of the end portion 1428 of the second tubular member 1430 is a pin connection. In an exemplary embodiment, the external diameter of the tubular sleeve 1418 is at least approximately 0.020" less than the inside diameters of the first and second tubular members, 1410 and 1430. In this manner, during the threaded coupling of the first and second tubular members, 1410 and 1430, fluidic materials within the first and second tubular members may be vented from the tubular members.

Figure 12D:
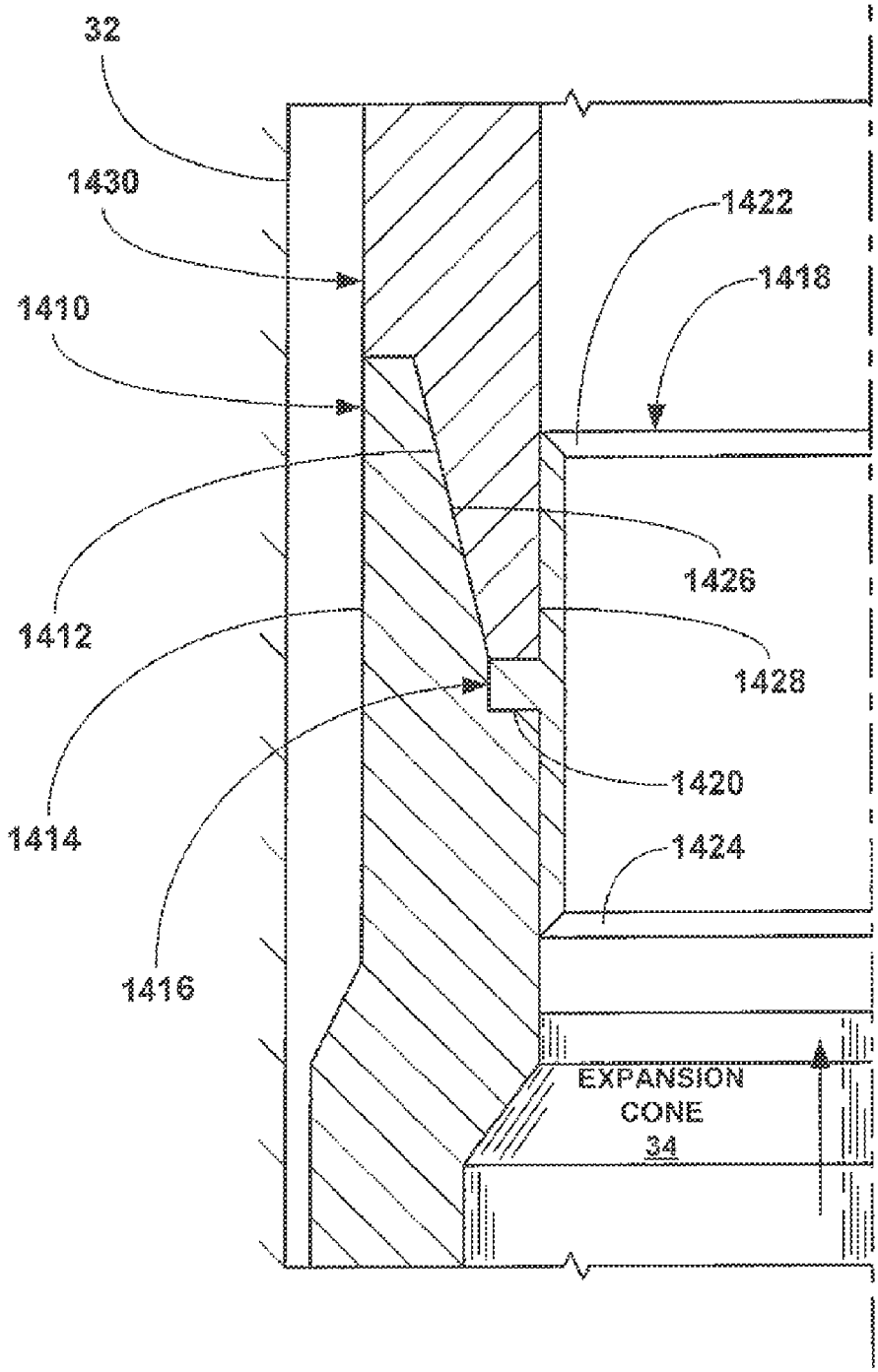
FIG. 12*d* is a fragmentary cross-sectional illustration of the radial expansion and plastic deformation of a portion of the first tubular member of FIG. 12*c*.
Figure 12E:
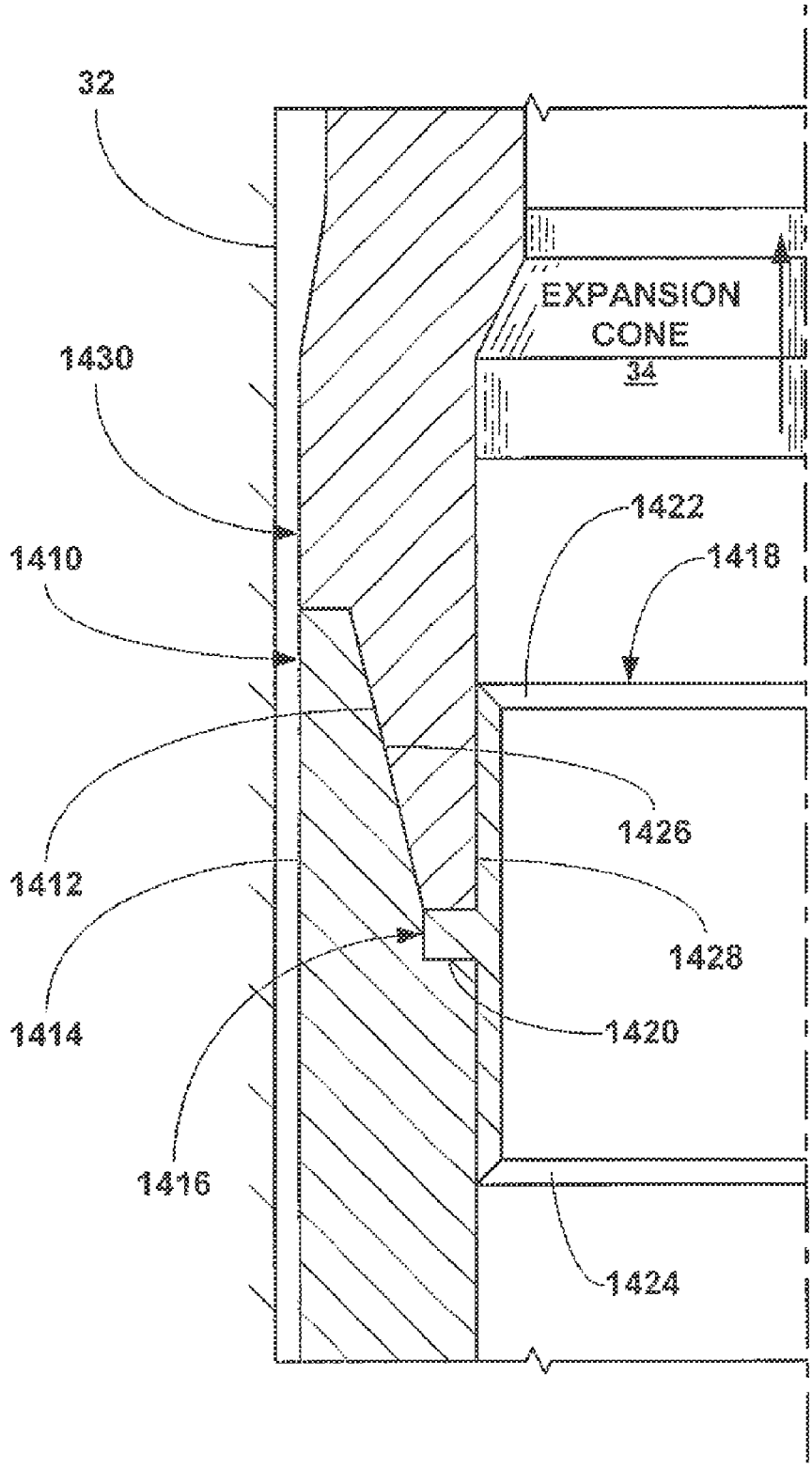
FIG. 12*e* is a fragmentary cross sectional of the continued radial expansion and plastic deformation of the threaded connection between the first and second tubular members and the tubular sleeve of FIG. 12*d*.

In an exemplary embodiment, as illustrated in FIGS. 12*d* and 12*e*, the first and second tubular members, 1410 and 1430, and the tubular sleeve 1418 may then be positioned within another structure 32 such as, for example, a wellbore, and radially expanded and plastically deformed, for example, by moving an expansion cone 34 through the interiors of the first and second tubular members. The tapered portions, 1422 and 1424, of the tubular sleeve 1418 facilitate the movement of the expansion cone 34 through the first and second tubular members, 1410 and 1430, and the movement of the expansion cone 34 through the interiors of the first and second tubular members, 1410 and 1430, may be from top to bottom or from bottom to top.

In an exemplary embodiment, during the radial expansion and plastic deformation of the first and second tubular members, 1410 and 1430, the tubular sleeve 1418 is also radially expanded and plastically deformed. In an exemplary embodiment, as a result, the tubular sleeve 1418 may be maintained in circumferential compression and the end portions, 1414 and 1428, of the first and second tubular members, 1410 and 1430, may be maintained in circumferential compression.

In several alternative embodiments, the first and second tubular members, 1410 and 1430, are radially expanded and plastically deformed using other conventional methods for radially expanding and plastically deforming tubular members such as, for example, internal pressurization and/or roller expansion devices.

The use of the tubular sleeve 1418 during (a) the coupling of the first tubular member 1410 to the second tubular member 1430, (b) the placement of the first and second tubular members in the structure 32, and (c) the radial expansion and plastic deformation of the first and second tubular members provides a number of significant benefits. For example, the tubular sleeve 1418 provides an alignment guide that facilitates the insertion and threaded coupling of the second tubular member 1430 to the first tubular member 1410. In this manner, misalignment that could result in damage to the threaded connections, 1412 and 1426, of the first and second tubular members, 1410 and 1430, may be avoided. In addition, during the relative rotation of the second tubular member with respect to the first tubular member, required during the threaded coupling of the first and second tubular members, the tubular sleeve 1418 provides an indication of to what degree the first and second tubular members are threadably coupled. For example, if the tubular sleeve 1418 can be easily rotated, that would indicate that the first and second tubular members, 1410 and 1430, are not fully threadably coupled and in intimate contact with the internal flange 1420 of the tubular sleeve. Furthermore, the tubular sleeve 1418 may prevent crack propagation during the radial expansion and plastic deformation of the first and second tubular members, 1410 and 1430. In this manner, failure modes such as, for example, longitudinal cracks in the end portions, 1414 and 1428, of the first and second tubular members may be limited in severity or eliminated all together. In addition, after completing the radial expansion and plastic deformation of the first and second tubular members, 1410 and 1430, the tubular sleeve 1418 may provide a fluid tight metal-to-metal seal between the exterior surface of the tubular sleeve and the interior surfaces of the end portions, 1414 and 1428, of the first and second tubular members. In this manner, fluidic materials are prevented from passing through the threaded connections, 1412 and 1426, of the first and second tubular members, 1410 and 1430, into the annulus between the first and second tubular members and the structure 32. Furthermore, because, following the radial expansion and plastic deformation of the first and second tubular members, 1410 and 1430, the tubular sleeve 1418 may be maintained in circumferential compression and the end portions, 1414 and 1428, of the first and second tubular members, 1410 and 1430, may be maintained in circumferential tension, axial loads and/or torque loads may be transmitted through the tubular sleeve.

Figure 13A:
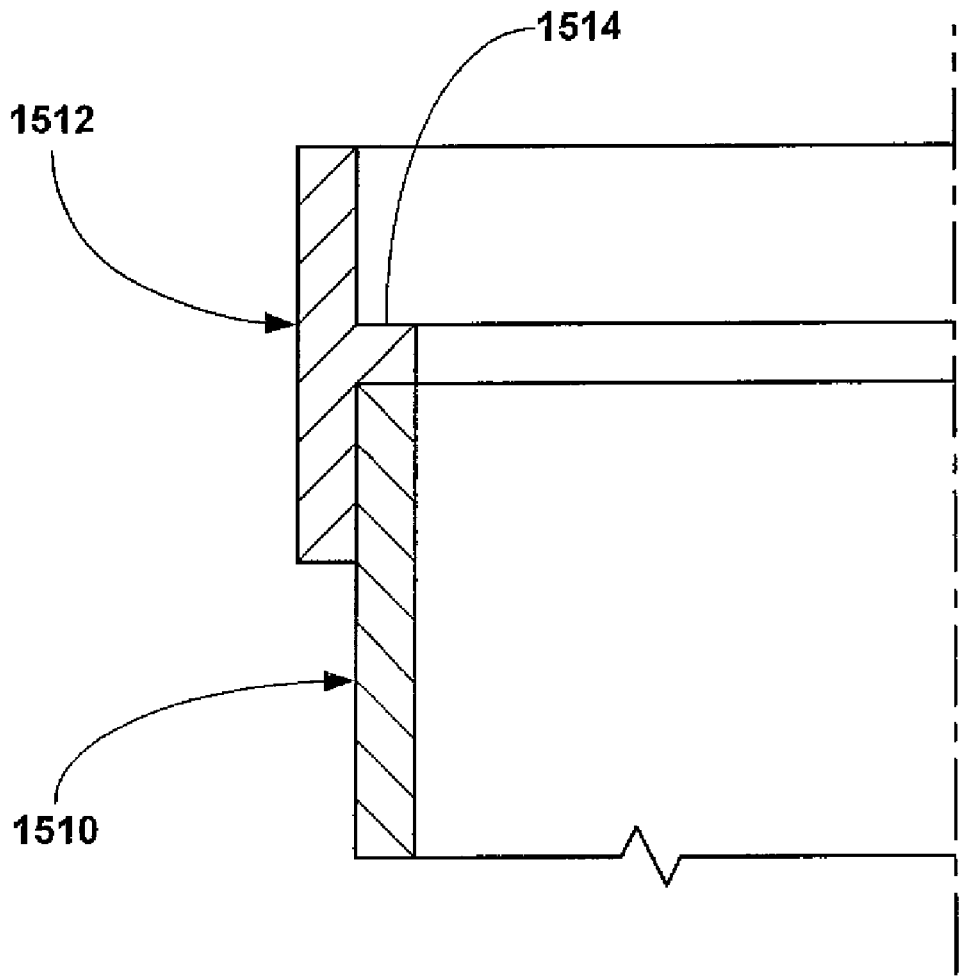
FIG. 13*a* is a fragmentary cross-sectional illustration of the coupling of an end portion of an alternative embodiment of a tubular sleeve onto the end portion of a first tubular member.
Figure 13B:
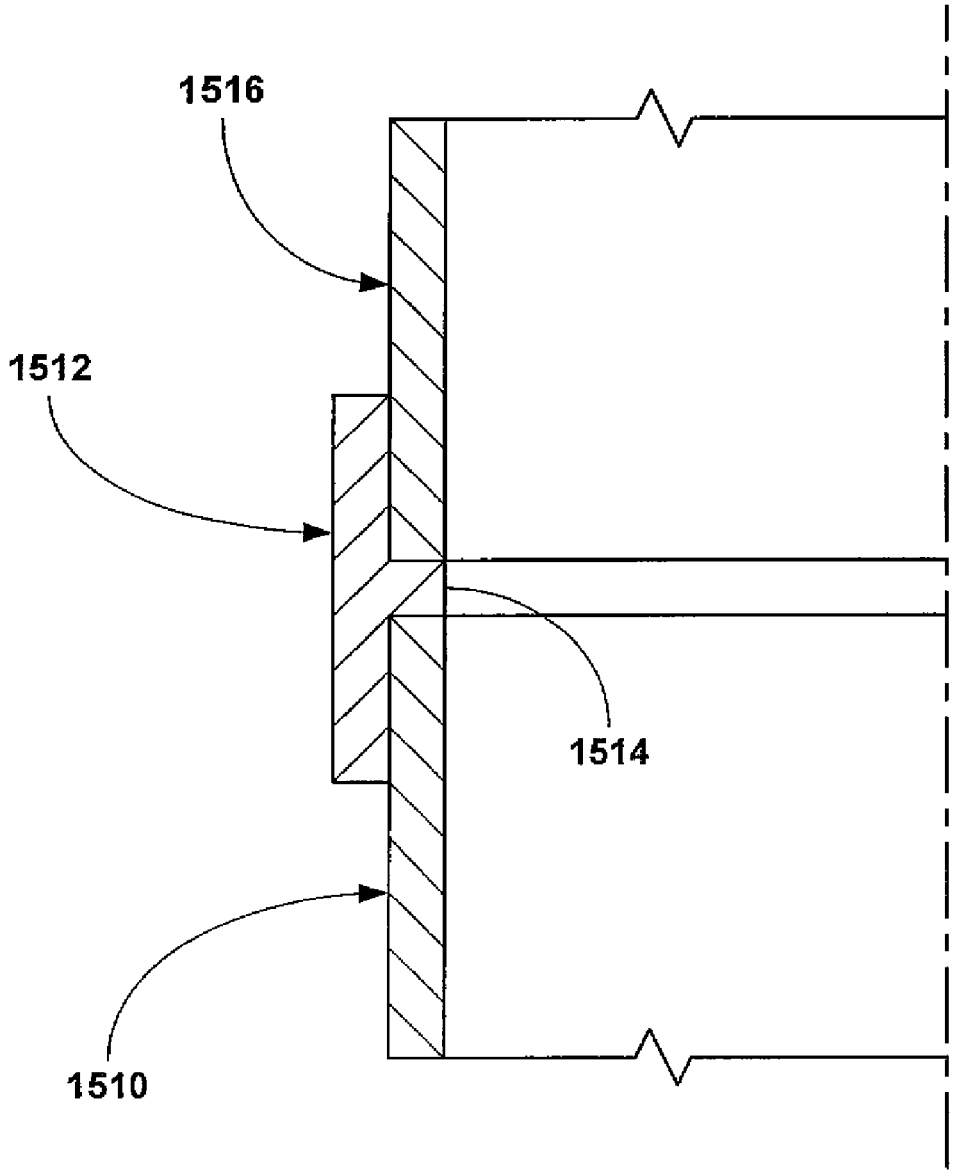
FIG. 13*b* is a fragmentary cross-sectional illustration of the coupling of an end portion of a second tubular member to the other end portion of the tubular sleeve of FIG. 13*a*.

Referring to FIG. 13*a*, an end of a first tubular member 1510 is positioned within and coupled to an end of a tubular sleeve 1512 having an internal flange 1514. In an exemplary embodiment, the end of the first tubular member 1510 abuts one side of the internal flange 1514. As illustrated in FIG. 13*b*, an end of second tubular member 1516 is then positioned within and coupled to another end of the tubular sleeve 1512. In an exemplary embodiment, the end of the second tubular member 1516 abuts another side of the internal flange 1514. In an exemplary embodiment, the tubular sleeve 1512 is coupled to the ends of the first and second tubular members, 1510 and 1516, by expanding the tubular sleeve 1512 using heat and then inserting the ends of the first and second tubular members into the expanded tubular sleeve 1512. After cooling the tubular sleeve 1512, the tubular sleeve is coupled to the ends of the first and second tubular members, 1510 and 1516.

Figure 13C:
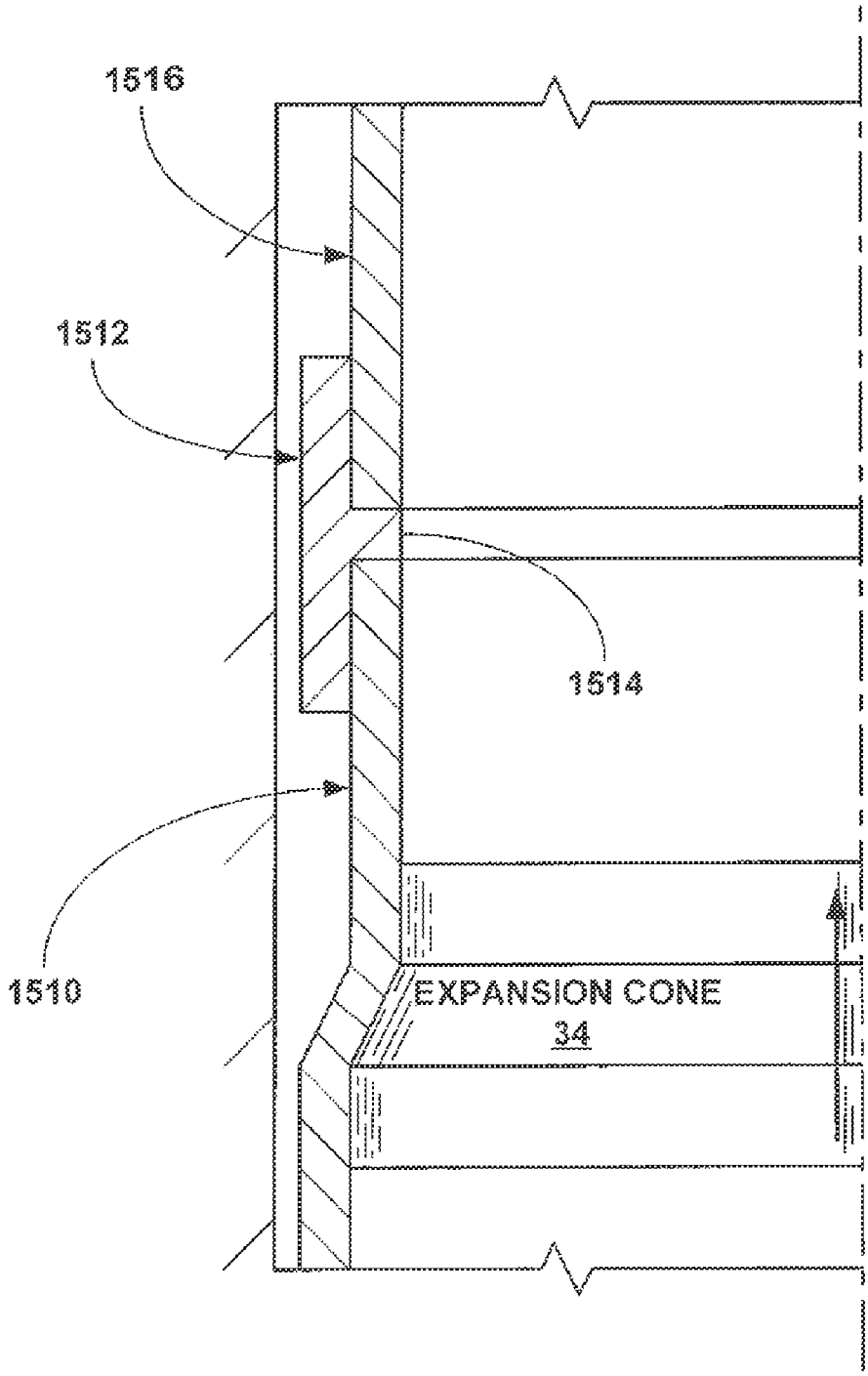
FIG. 13*c* is a fragmentary cross-sectional illustration of the radial expansion and plastic deformation of a portion of the first tubular member of FIG. 13*b*.
Figure 13D:
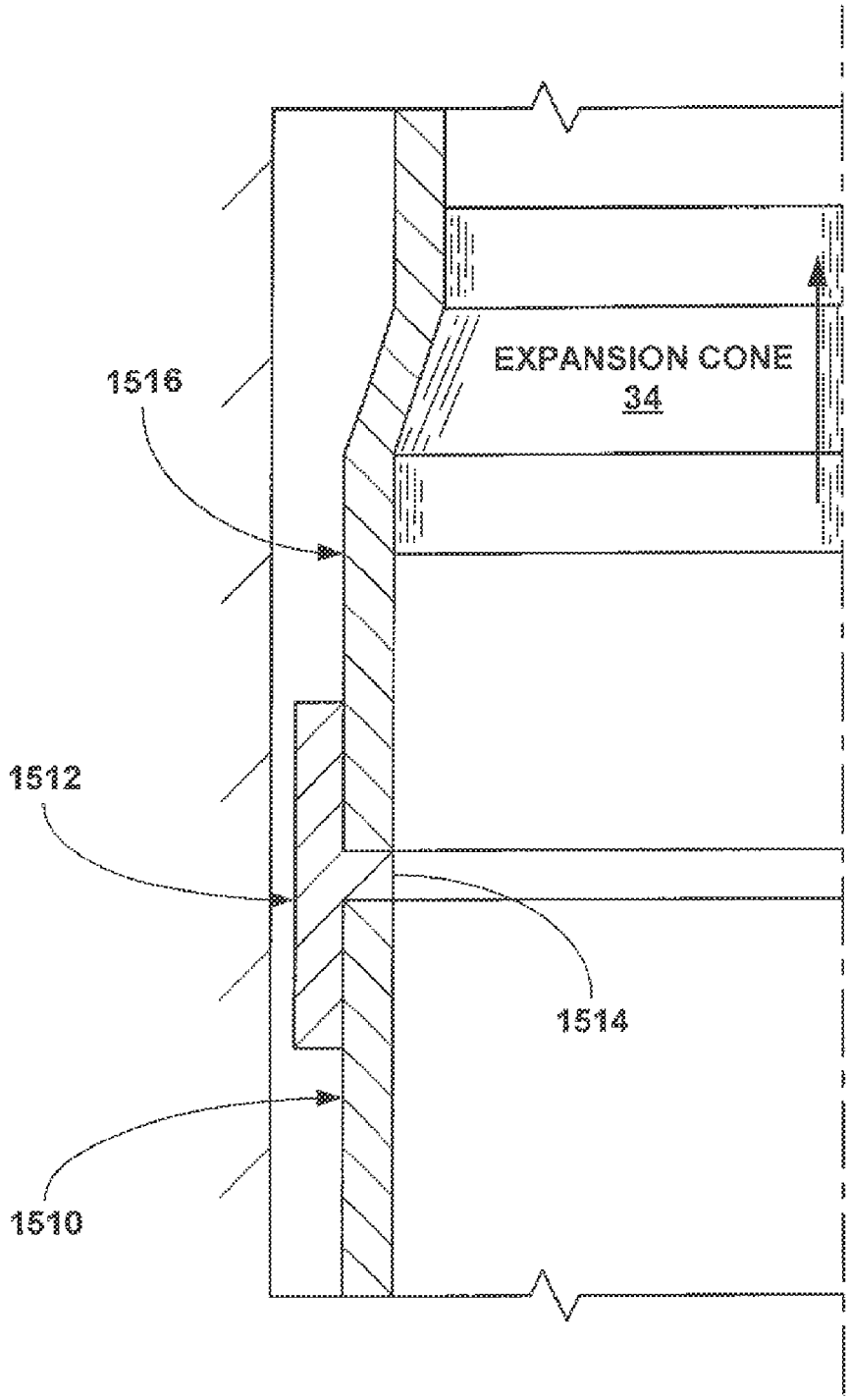
FIG. 13*d* is a fragmentary cross sectional of the continued radial expansion and plastic deformation of the threaded connection between the first and second tubular members and the tubular sleeve of FIG. 13*c*.

In an exemplary embodiment, as illustrated in FIGS. 13*c* and 13*d*, the first and second tubular members, 1510 and 1516, and the tubular sleeve 1512 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1510 and 1516, may be from top to bottom or from bottom to top.

In an exemplary embodiment, during the radial expansion and plastic deformation of the first and second tubular members, 1510 and 1516, the tubular sleeve 1512 is also radially expanded and plastically deformed. In an exemplary embodiment, as a result, the tubular sleeve 1512 may be maintained in circumferential compression and the ends of the first and second tubular members, 1510 and 1516, may be maintained in circumferential compression.

The use of the tubular sleeve 1512 during (a) the placement of the first and second tubular members, 1510 and 1516, in the structure 32 and (b) the radial expansion and plastic deformation of the first and second tubular members provides a number of significant benefits. For example, the tubular sleeve 1512 may prevent crack propagation during the radial expansion and plastic deformation of the first and second tubular members, 1510 and 1516. In this manner, failure modes such as, for example, longitudinal cracks in the ends of the first and second tubular members, 1510 and 1516, may be limited in severity or eliminated all together. In addition, after completing the radial expansion and plastic deformation of the first and second tubular members, 1510 and 1516, the tubular sleeve 1512 may provide a fluid tight metal-to-metal seal between the exterior surface of the tubular sleeve and the interior surfaces of the end of the first and second tubular members. Furthermore, because, following the radial expansion and plastic deformation of the first and second tubular members, 1510 and 1516, the tubular sleeve 1512 may be maintained in circumferential tension and the ends of the first and second tubular members, 1510 and 1516, may be maintained in circumferential compression, axial loads and/or torque loads may be transmitted through the tubular sleeve.

Figure 14A:
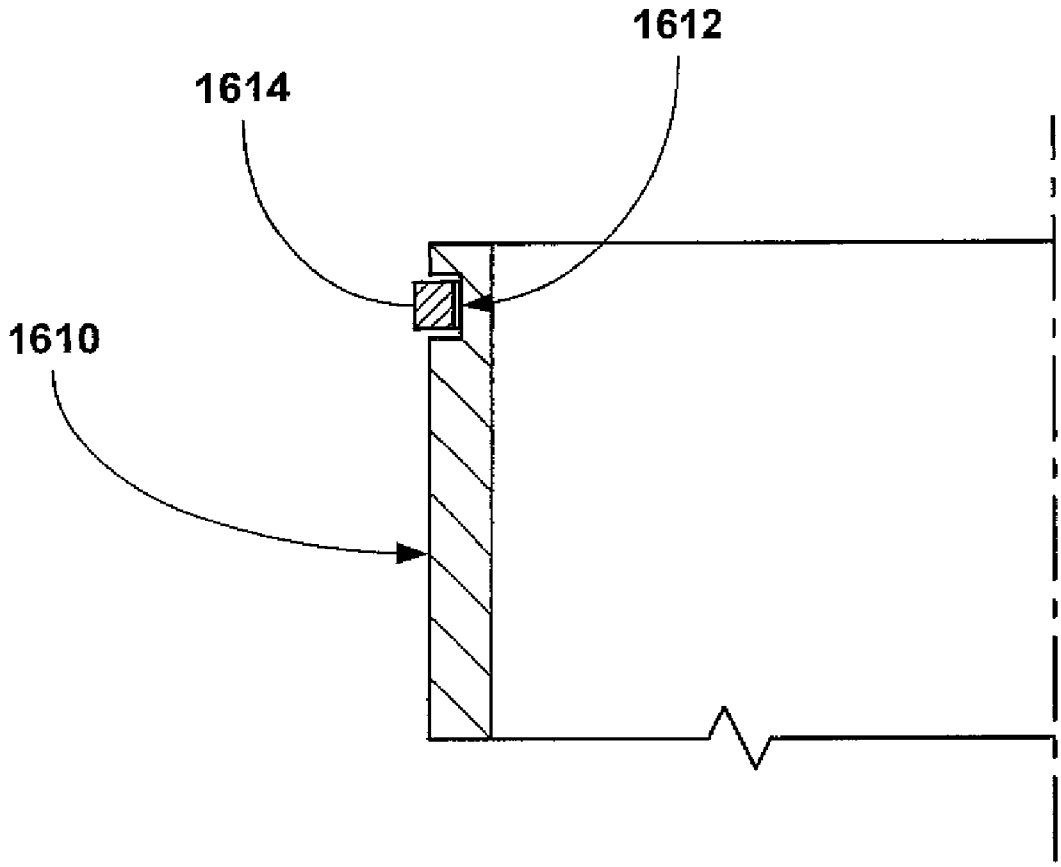
FIG. 14*a* is a fragmentary cross-sectional illustration of an end portion of a first tubular member.
Figure 14B:
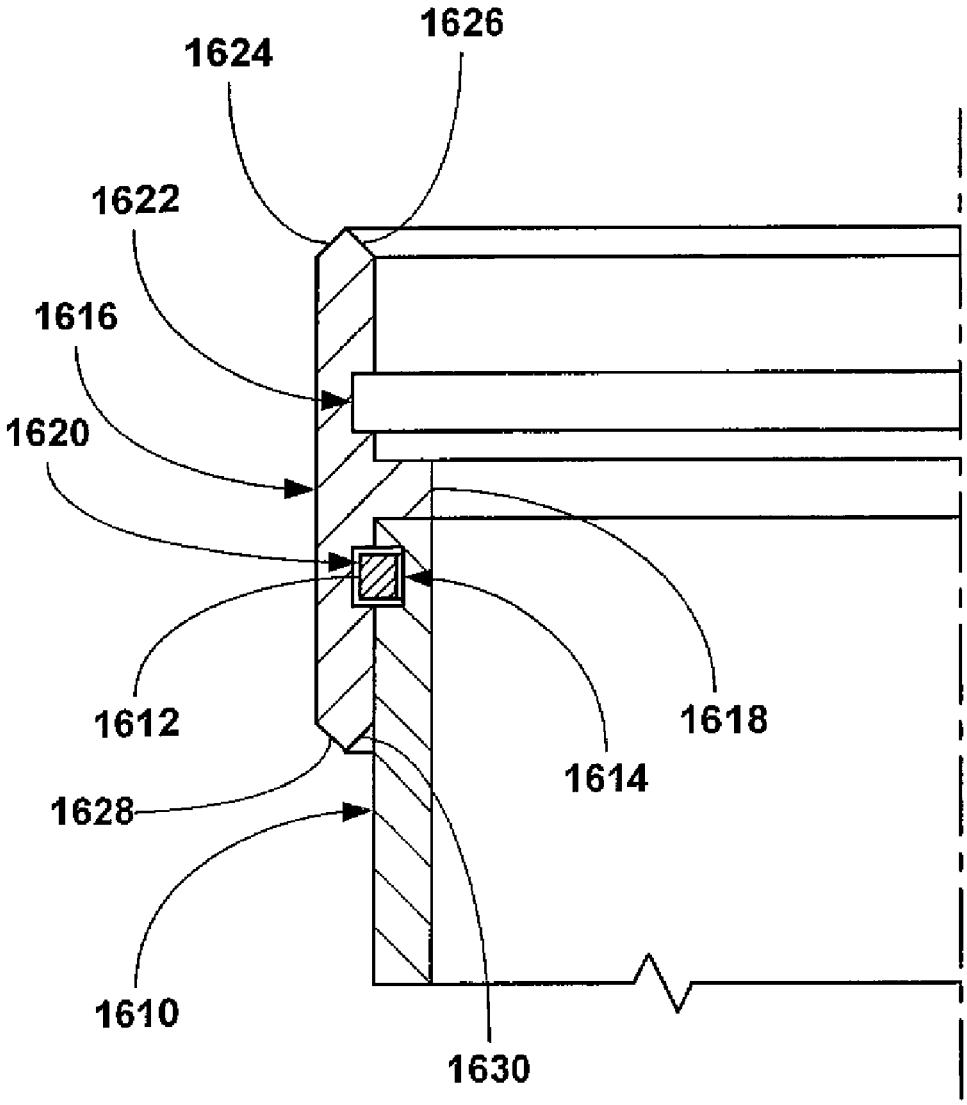
FIG. 14*b* is a fragmentary cross-sectional illustration of the coupling of an end portion of an alternative embodiment of a tubular sleeve onto the end portion of the first tubular member of FIG. 14*a*.

Referring to FIG. 14*a*, a first tubular member 1610 includes a resilient retaining ring 1612 mounted within an annular recess 1614. As illustrated in FIG. 14*b*, the end of the first tubular member 1610 is then inserted into and coupled to an end of a tubular sleeve 1616 including an internal flange 1618 and annular recesses, 1620 and 1622, positioned on opposite sides of the internal flange, tapered portions, 1624 and 1626, on one end of the tubular sleeve, and tapered portions, 1628 and 1630, on the other end of the tubular sleeve. In an exemplary embodiment, the resilient retaining ring 1612 is thereby positioned at least partially in the annular recesses, 1614 and 1620, thereby coupling the first tubular member 1610 to the tubular sleeve 1616, and the end of the first tubular member 1610 abuts one side of the internal flange 1618. During the coupling of the first tubular member 1610 to the tubular sleeve 1616, the tapered portion 1630 facilitates the radial compression of the resilient retaining ring 1612 during the insertion of the first tubular member into the tubular sleeve.

Figure 14C:
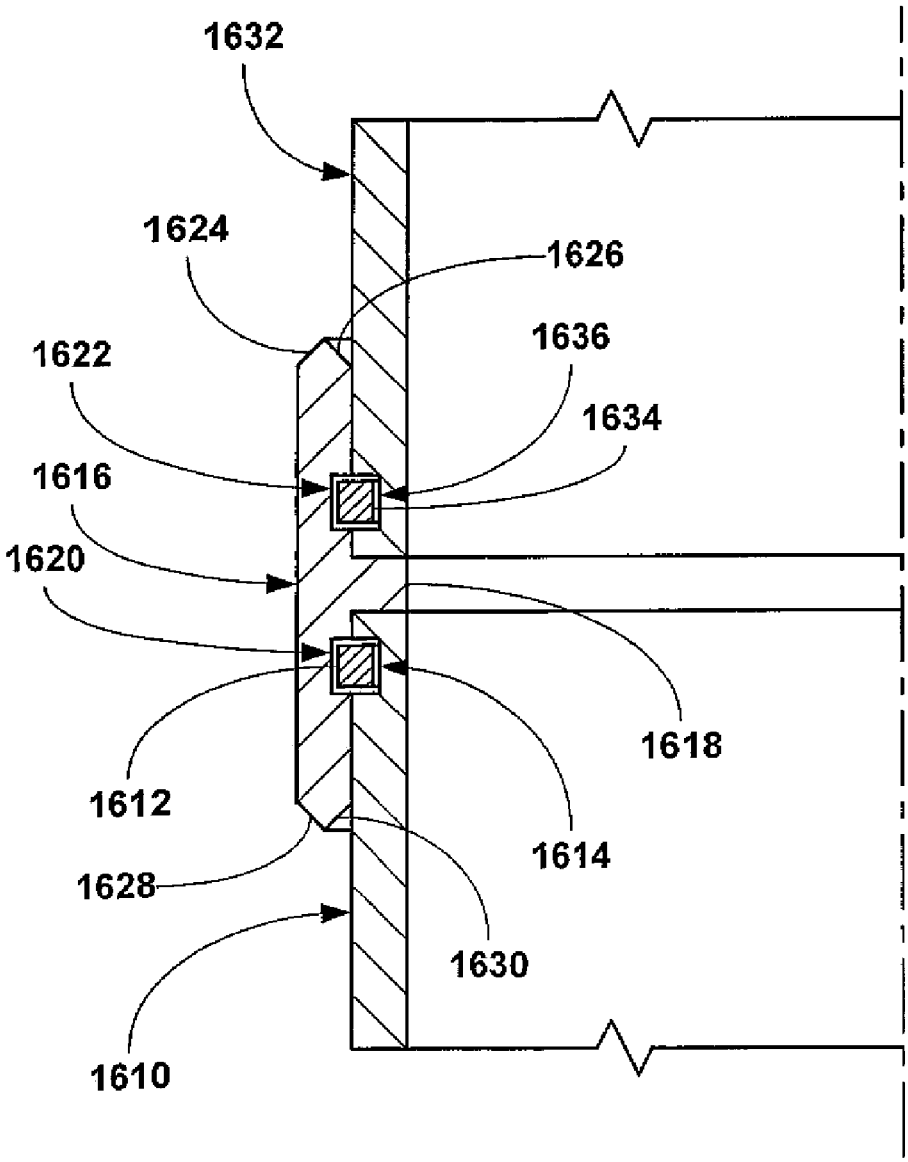
FIG. 14*c* is a fragmentary cross-sectional illustration of the coupling of an end portion of a second tubular member to the other end portion of the tubular sleeve of FIG. 14*b*.

As illustrated in FIG. 14*c*, an end of a second tubular member 1632 that includes a resilient retaining ring 1634 mounted within an annular recess 1636 is then inserted into and coupled to another end of the tubular sleeve 1616. In an exemplary embodiment, the resilient retaining ring 1634 is thereby positioned at least partially in the annular recesses, 1636 and 1622, thereby coupling the second tubular member 1632 to the tubular sleeve 1616, and the end of the second tubular member 1632 abuts another side of the internal flange 1618. During the coupling of the second tubular member 1632 to the tubular sleeve 1616, the tapered portion 1626 facilitates the radial compression of the resilient retaining ring 1634 during the insertion of the second tubular member into the tubular sleeve.

Figure 14D:
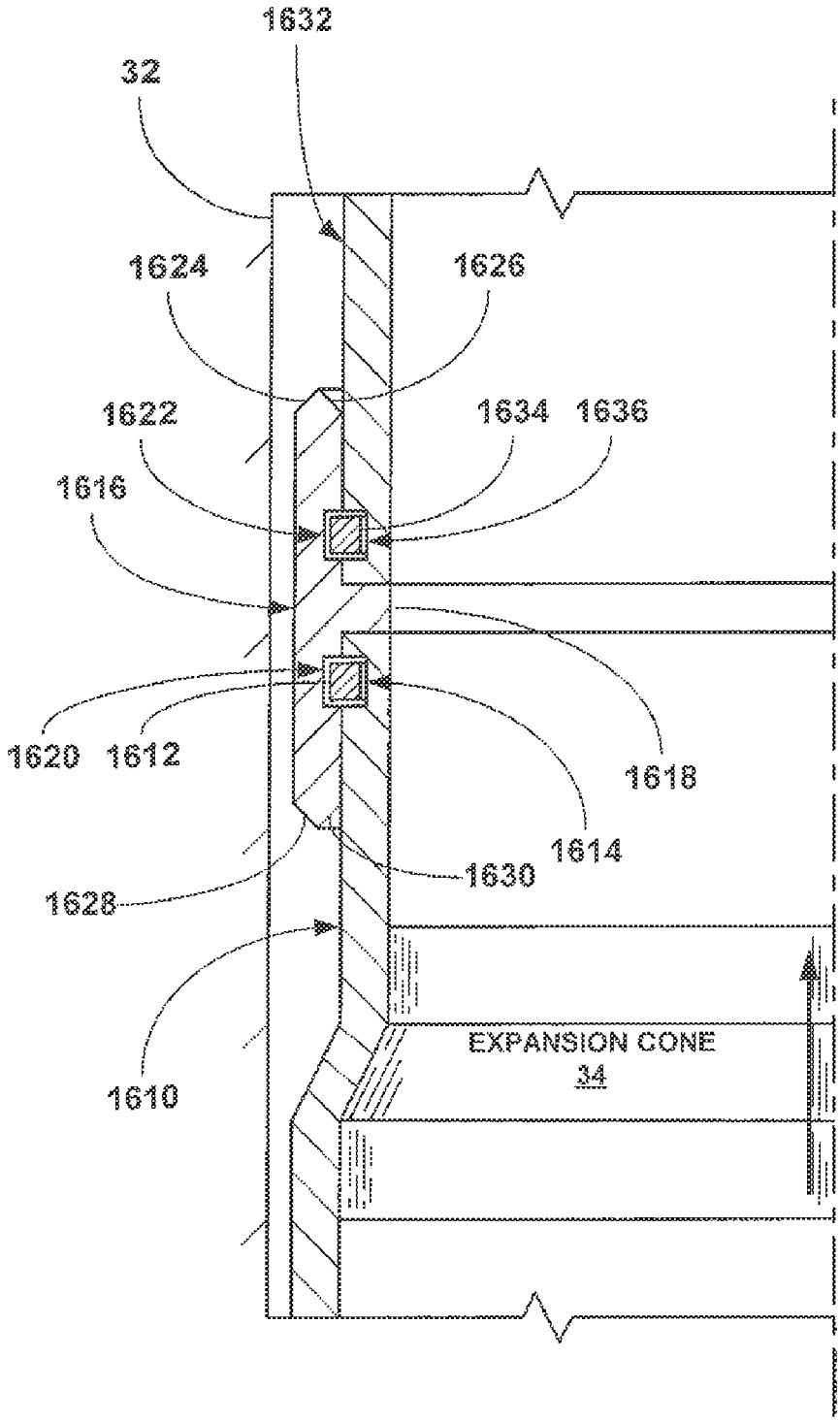
FIG. 14*d* is a fragmentary cross-sectional illustration of the radial expansion and plastic deformation of a portion of the first tubular member of FIG. 14*c*.
Figure 14E:
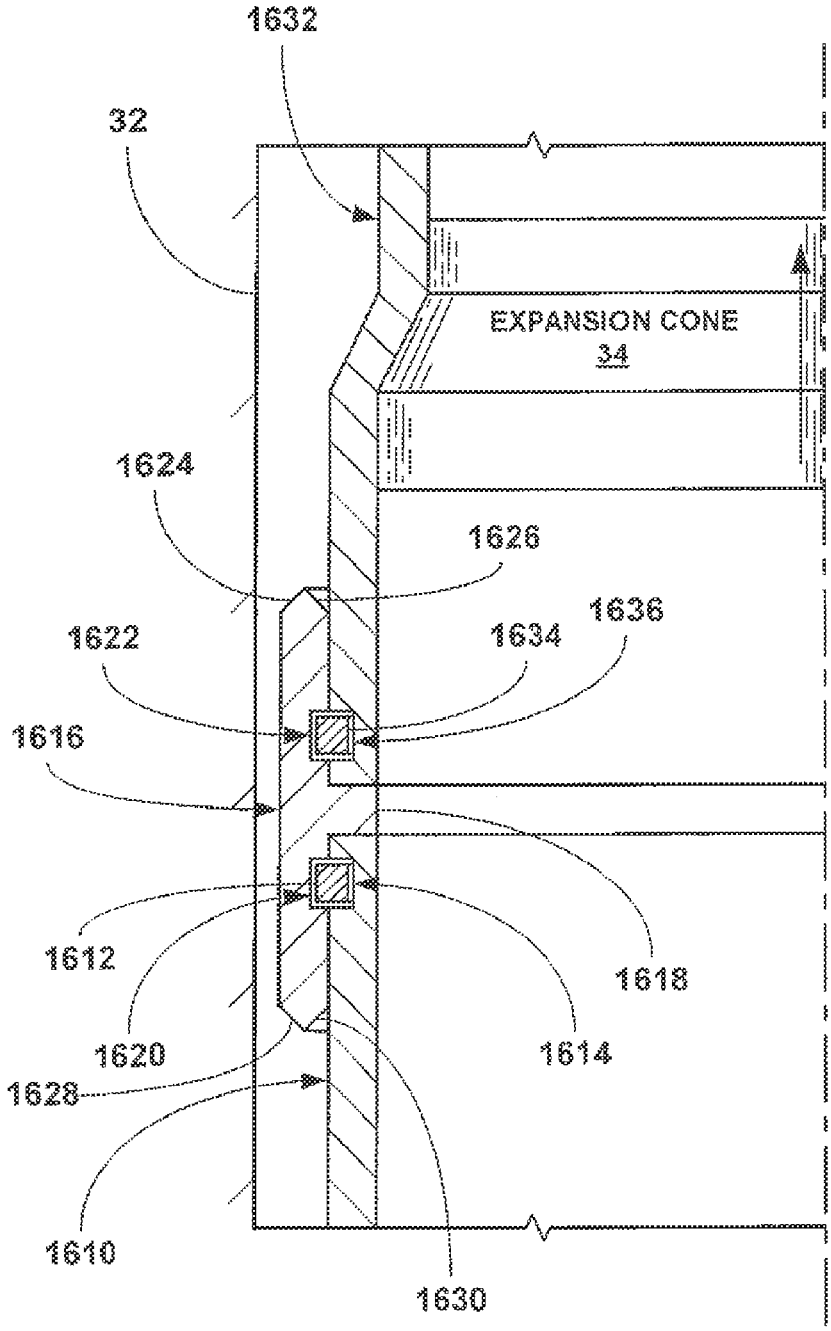
FIG. 14*e* is a fragmentary cross sectional of the continued radial expansion and plastic deformation of the threaded connection between the first and second tubular members and the tubular sleeve of FIG. 14*d*.

In an exemplary embodiment, as illustrated in FIGS. 14*d* and 14*e*, the first and second tubular members, 1610 and 1632, and the tubular sleeve 1616 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1610 and 1632, may be from top to bottom or from bottom to top.

In an exemplary embodiment, during the radial expansion and plastic deformation of the first and second tubular members, 1610 and 1632, the tubular sleeve 1616 is also radially expanded and plastically deformed. In an exemplary embodiment, as a result, the tubular sleeve 1616 may be maintained in circumferential compression and the ends of the first and second tubular members, 1610 and 1632, may be maintained in circumferential compression.

The use of the tubular sleeve 1616 during (a the placement of the first and second tubular members, 1610 and 1632, in the structure 32, and (c) the radial expansion and plastic deformation of the first and second tubular members provides a number of significant benefits. For example, the tubular sleeve 1616 protects the exterior surfaces of the ends of the first and second tubular members, 1610 and 1632, during handling and insertion of the tubular members within the structure 32. In this manner, damage to the exterior surfaces of the ends of the first and second tubular member, 1610 and 1632, are prevented that could result in stress concentrations that could result in a catastrophic failure during subsequent radial expansion operations. Furthermore, the tubular sleeve 1616 may prevent crack propagation during the radial expansion and plastic deformation of the first and second tubular members, 1610 and 1632. In this manner, failure modes such as, for example, longitudinal cracks in the ends of the first and second tubular members, 1610 and 1632, may be limited in severity or eliminated all together. In addition, after completing the radial expansion and plastic deformation of the first and second tubular members, 1610 and 1632, the tubular sleeve 1616 may provide a fluid tight metal-to-metal seal between interior surface of the tubular sleeve and the exterior surfaces of the ends of the first and second tubular members. Furthermore, because, following the radial expansion and plastic deformation of the first and second tubular members, 1610 and 1632, the tubular sleeve 1616 may be maintained in circumferential tension and the ends of the first and second tubular members, 1610 and 1632, may be maintained in circumferential compression, axial loads and/or torque loads may be transmitted through the tubular sleeve.

A method of radially expanding and plastically deforming a first tubular member and a second tubular member has been described that includes inserting a threaded end portion of the first tubular member into an end of a tubular sleeve having an internal flange; inserting a threaded end portion of the second tubular member into another end of the tubular sleeve; threadably coupling the threaded end portions of the first and second tubular members within the tubular sleeve; and displacing an expansion device through the interiors of the first and second tubular members to radially expand and plastically deform portions of the first and second tubular members; wherein the internal diameters of the radially expanded and plastically deformed portions of the first and second tubular members are equal. In an exemplary embodiment, the internal flange of the tubular sleeve is positioned between the ends of the tubular sleeve. In an exemplary embodiment, the internal flange of the tubular sleeve is positioned at one end of the tubular sleeve. In an exemplary embodiment, the tubular sleeve further includes one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the method further includes radially expanding the tubular sleeve into engagement with the structure. In an exemplary embodiment, the method further includes sealing an annulus between the tubular sleeve and the other structure. In an exemplary embodiment, the other structure comprises a wellbore. In an exemplary embodiment, the other structure comprises a wellbore casing. In an exemplary embodiment, the tubular sleeve further comprises a sealing element coupled to the exterior of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages. In an exemplary embodiment, the internal diameter of the non-threaded portion of the second tubular member is equal to the internal diameter of the internal flange of the tubular sleeve. In an exemplary embodiment, after the radial expansion and plastic deformation, the internal diameter of the non-threaded portion of the first tubular member is equal to the internal diameter of the internal flange of the tubular sleeve. In an exemplary embodiment, after the radial expansion and plastic deformation, the internal diameter of the non-threaded portion of the second tubular member is equal to the internal diameter of the internal flange of the tubular sleeve. In an exemplary embodiment, a portion of the first tubular member abuts an end face of the internal flange of the tubular sleeve; and a portion of the second tubular member abuts another end face of the internal flange of the tubular sleeve.

A method of radially expanding and plastically deforming a first tubular member and a second tubular member has been described that includes inserting a threaded end portion of the first tubular member into an end of a tubular sleeve; coupling the end of the tubular sleeve to the threaded end portion of the first tubular member; inserting a threaded end portion of the second tubular member into another end of the tubular sleeve; threadably coupling the threaded end portions of the first and second tubular member within the tubular sleeve; coupling the other end of the tubular sleeve to the threaded end portion of the second tubular member; and displacing an expansion device through the interiors of the first and second tubular members to radially expand and plastically deform portions of the first and second tubular members; wherein the internal diameters of the radially expanded and plastically deformed portions of first and second tubular members are equal. In an exemplary embodiment, coupling the ends of the tubular sleeve to the ends of the first and second tubular members includes coupling the ends of the tubular sleeve to the ends of the first and second tubular members using locking rings. In an exemplary embodiment, coupling the ends of the tubular sleeve to the ends of the first and second tubular members using locking rings includes wedging the locking rings between the ends of the tubular sleeve and the ends of the first and second tubular members. In an exemplary embodiment, coupling the ends of the tubular sleeve to the ends of the first and second tubular members using locking rings includes affixing the locking rings to the ends of the first and second tubular members. In an exemplary embodiment, the locking rings are resilient. In an exemplary embodiment, the locking rings are elastomeric. In an exemplary embodiment, coupling the ends of the tubular sleeve to the ends of the first and second tubular members includes crimping the ends of the tubular sleeve onto the ends of the first and second tubular members. In an exemplary embodiment, the tubular sleeve further includes one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the method further includes radially expanding the tubular sleeve into engagement with the structure. In an exemplary embodiment, the method further includes sealing an annulus between the tubular sleeve and the other structure. In an exemplary embodiment, the other structure is a wellbore. In an exemplary embodiment, the other structure is a wellbore casing. In an exemplary embodiment, the tubular sleeve further includes a sealing element coupled to the exterior of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages.

A method of radially expanding and plastically deforming a first tubular member and a second tubular member has also been described that includes inserting an end of a tubular sleeve having an external flange into an end of the first tubular member until the external flange abuts the end of the first tubular member, inserting the other end of the tubular sleeve into an end of a second tubular member, threadably coupling the ends of the first and second tubular member within the tubular sleeve until both ends of the first and second tubular members abut the external flange of the tubular sleeve, and displacing an expansion cone through the interiors of the first and second tubular members. In an exemplary embodiment, the external flange of the tubular sleeve is positioned between the ends of the tubular sleeve. In an exemplary embodiment, the external flange of the tubular sleeve is positioned at one end of the tubular sleeve. In an exemplary embodiment, the tubular sleeve further includes one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the other structure comprises a wellbore. In an exemplary embodiment, the other structure comprises a wellbore casing. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages.

A method of radially expanding and plastically deforming a first tubular member and a second tubular member has been described that includes inserting an end of the first tubular member into an end of a tubular sleeve having an internal flange into abutment with the internal flange; inserting an end of the second tubular member into another end of the tubular sleeve into abutment with the internal flange; coupling the ends of the first and second tubular member to the tubular sleeve; and displacing an expansion device through the interiors of the first and second tubular members to radially expand and plastically deform the ends of the first and second tubular members; wherein the internal diameters of the radially expanded and plastically deformed ends of the first and second tubular members are equal. In an exemplary embodiment, the internal flange of the tubular sleeve is positioned between the ends of the tubular sleeve. In an exemplary embodiment, the internal flange of the tubular sleeve is positioned at one end of the tubular sleeve. In an exemplary embodiment, the tubular sleeve further comprises one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the method further includes radially expanding the tubular sleeve into engagement with the structure. In an exemplary embodiment, the method further includes sealing an annulus between the tubular sleeve and the other structure. In an exemplary embodiment, the other structure is a wellbore. In an exemplary embodiment, the other structure is a wellbore casing. In an exemplary embodiment, the tubular sleeve further includes a sealing element coupled to the exterior of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages. In an exemplary embodiment, coupling the ends of the first and second tubular member to the tubular sleeve includes heating the tubular sleeve and inserting the ends of the first and second tubular members into the tubular sleeve. In an exemplary embodiment, coupling the ends of the first and second tubular member to the tubular sleeve includes coupling the tubular sleeve to the ends of the first and second tubular members using a locking ring. In an exemplary embodiment, the internal diameter of the first tubular member is equal to the internal diameter of the internal flange of the tubular sleeve. In an exemplary embodiment, the internal diameter of the second tubular member is equal to the internal diameter of the internal flange of the tubular sleeve. In an exemplary embodiment, after the radial expansion and plastic deformation, the internal diameter of the first tubular member is equal to the internal diameter of the internal flange of the tubular sleeve. In an exemplary embodiment, after the radial expansion and plastic deformation, the internal diameter of the second tubular member is equal to the internal diameter of the internal flange of the tubular sleeve.

An apparatus has been described that includes a first tubular member comprising a threaded end portion; a second tubular member comprising a threaded end portion; and a tubular sleeve that receives, overlaps with, and is coupled to the threaded end portions of the first and second tubular members; wherein the threaded end portion of the first tubular member is threadably coupled to the threaded end portion of the second tubular member; wherein portions of the first and second tubular members are radially expanded and plastically deformed; and wherein the internal diameters of non-threaded portions of the radially expanded and plastically deformed portions of the first and second tubular members are equal. In an exemplary embodiment, the threaded ends of the first and second tubular members are radially expanded and plastically deformed within a wellbore. In an exemplary embodiment, the threaded ends of the first and second tubular members are in circumferential compression; and wherein the tubular sleeve is in circumferential tension. In an exemplary embodiment, the opposite ends of the tubular sleeve are tapered. In an exemplary embodiment, the tubular sleeve comprises an internal flange that abuts the ends faces of the threaded ends of the first and second tubular members. In an exemplary embodiment, the internal flange is positioned proximate an end of the tubular sleeve. In an exemplary embodiment, the interface between the exterior surfaces of the first and second tubular members and the interior surface of the tubular sleeve provides a fluid tight seal. In an exemplary embodiment, the tubular sleeve includes one or more sealing members for sealing an interface between the interior surface of the tubular sleeve and the exterior surfaces of at least one of the first and second tubular members. In an exemplary embodiment, the apparatus further includes a structure defining an opening for receiving the first and second tubular members and the tubular sleeve; wherein the tubular sleeve includes one or more sealing members for sealing an interface between the tubular sleeve and the structure. In an exemplary embodiment, the tubular sleeve comprises materials selected from the group consisting of: plastic, ceramic, elastomeric, composite, frangible material, or metal. In an exemplary embodiment, the tubular sleeve defines one or more radial passages. In an exemplary embodiment, one or more of the radial passages comprise axial slots. In an exemplary embodiment, the axial slots are staggered in the axial direction. In an exemplary embodiment, the apparatus further includes one or more retaining members for coupling the ends of the tubular sleeve to the exterior surfaces of the first and second tubular members. In an exemplary embodiment, one or more of the retaining members penetrate the exterior surfaces of at least one of the first and second tubular members. In an exemplary embodiment, one or more of the retaining members are elastic. In an exemplary embodiment, the ends of the tubular sleeve are deformed into engagement with the exterior surfaces of the first and second tubular members.

An apparatus has been described that includes a first tubular member comprising a threaded end; a second tubular member comprising a threaded end; and a tubular sleeve that is received within, overlaps with, and is coupled to the threaded ends of the first and second tubular members; wherein the threaded end of the first tubular member is threadably coupled to the threaded end of the second tubular member; and wherein the threaded ends of the first and second tubular members are radially expanded and plastically deformed. In an exemplary embodiment, the threaded ends of the first and second tubular members are radially expanded and plastically deformed within a wellbore. In an exemplary embodiment, the threaded ends of the first and second tubular members are in circumferential tension; and the tubular sleeve is in circumferential compression. In an exemplary embodiment, the opposite ends of the tubular sleeve are tapered. In an exemplary embodiment, the tubular sleeve comprises an external flange that abuts ends faces of the threaded ends of the first and second tubular members. In an exemplary embodiment, the external flange is positioned proximate an end of the tubular sleeve. In an exemplary embodiment, the interface between the interior surfaces of the first and second tubular members and the exterior surface of the tubular sleeve provides a fluid tight seal. In an exemplary embodiment, the tubular sleeve includes one or more sealing members for sealing an interface between the exterior surface of the tubular sleeve and the interior surfaces of at least one of the first and second tubular members. In an exemplary embodiment, the tubular sleeve comprises materials selected from the group consisting of: plastic, ceramic, elastomeric, composite, frangible material, or metal. In an exemplary embodiment, the tubular sleeve defines one or more radial passages. In an exemplary embodiment, one or more of the radial passages comprise axial slots. In an exemplary embodiment, the axial slots are staggered in the axial direction.

An apparatus has been described that includes a first tubular member; a second tubular member; and a tubular sleeve that receives, overlaps with, and is coupled to the threaded ends of the first and second tubular members; wherein the ends of the first and second tubular members are in circumferential compression and the tubular sleeve is in circumferential tension; wherein the ends of the first and second tubular members are radially expanded and plastically deformed; and wherein the internal diameters of the radially expanded and plastically deformed ends of the first and second tubular members are equal. In an exemplary embodiment, the ends of the first and second tubular members are radially expanded and plastically deformed within a wellbore. In an exemplary embodiment, the opposite ends of the tubular sleeve are tapered. In an exemplary embodiment, the tubular sleeve comprises an internal flange that abuts the ends faces of the threaded ends of the first and second tubular members. In an exemplary embodiment, the internal flange is positioned proximate an end of the tubular sleeve. In an exemplary embodiment, the interface between the exterior surfaces of the first and second tubular members and the interior surface of the tubular sleeve provides a fluid tight seal. In an exemplary embodiment, the tubular sleeve includes one or more sealing members for sealing an interface between the interior surface of the tubular sleeve and the exterior surfaces of at least one of the first and second tubular members. In an exemplary embodiment, the apparatus further includes a structure defining an opening for receiving the first and second tubular members and the tubular sleeve; wherein the tubular sleeve includes one or more sealing members for sealing an interface between the tubular sleeve and the structure. In an exemplary embodiment, the tubular sleeve comprises materials selected from the group consisting of: plastic, ceramic, elastomeric, composite, frangible material, or metal. In an exemplary embodiment, the tubular sleeve defines one or more radial passages. In an exemplary embodiment, one or more of the radial passages comprise axial slots. In an exemplary embodiment, the axial slots are staggered in the axial direction. In an exemplary embodiment, further one or more retaining members for coupling the ends of the tubular sleeve to the exterior surfaces of the first and second tubular members. In an exemplary embodiment, one or more of the retaining members penetrate the exterior surfaces of at least one of the first and second tubular members. In an exemplary embodiment, one or more of the retaining members are elastic. In an exemplary embodiment, the ends of the tubular sleeve are deformed into engagement with the exterior surfaces of the first and second tubular members.

An apparatus has been described that includes a first tubular member comprising a threaded end portion; a second tubular member comprising a threaded end portion; a tubular sleeve that receives, overlaps with, and is coupled to the threaded end portions of the first and second tubular members; one or more first resilient locking members for locking the first tubular member to the tubular sleeve; and one or more second resilient locking members for locking the second tubular member to the tubular sleeve; wherein the threaded end portions of the first and second tubular members are in circumferential compression and the tubular sleeve is in circumferential tension; wherein portions of the first and second tubular members are radially expanded and plastically deformed; and wherein the internal diameters of radially expanded and plastically deformed portions of the first and second tubular members are equal. In an exemplary embodiment, the ends of the first and second tubular members are radially expanded and plastically deformed within a wellbore. In an exemplary embodiment, the opposite ends of the tubular sleeve are tapered. In an exemplary embodiment, the tubular sleeve comprises an internal flange that abuts the ends faces of the threaded ends of the first and second tubular members. In an exemplary embodiment, the internal flange is positioned proximate an end of the tubular sleeve. In an exemplary embodiment, the interface between the exterior surfaces of the first and second tubular members and the interior surface of the tubular sleeve provides a fluid tight seal. In an exemplary embodiment, the tubular sleeve includes one or more sealing members for sealing an interface between the interior surface of the tubular sleeve and the exterior surfaces of at least one of the first and second tubular members. In an exemplary embodiment, the apparatus further includes a structure defining an opening for receiving the first and second tubular members and the tubular sleeve; wherein the tubular sleeve includes one or more sealing members for sealing an interface between the tubular sleeve and the structure. In an exemplary embodiment, the tubular sleeve comprises materials selected from the group consisting of: plastic, ceramic, elastomeric, composite, frangible material, or metal. In an exemplary embodiment, the tubular sleeve defines one or more radial passages. In an exemplary embodiment, one or more of the radial passages comprise axial slots. In an exemplary embodiment, the axial slots are staggered in the axial direction. In an exemplary embodiment, the apparatus further includes one or more retaining members for coupling the ends of the tubular sleeve to the exterior surfaces of the first and second tubular members. In an exemplary embodiment, one or more of the retaining members penetrate the exterior surfaces of at least one of the first and second tubular members. In an exemplary embodiment, one or more of the retaining members are elastic. In an exemplary embodiment, the ends of the tubular sleeve are deformed into engagement with the exterior surfaces of the first and second tubular members.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments. Finally, any conventional radial expansion device such as, for example, an expansion mandrel or rotary expansion tool, may used either alone or in combination with other types of conventional radial expansion devices to radially expand and plastically deform the tubular members and/or the protective sleeves of the present disclosure. Moreover, other forms of conventional radial expansion devices such as, for example, hydroforming and/or or explosive forming may also be used either alone or in combination with any other types of conventional radial expansion devices to radially expand and plastically deform the tubular members and/or protective sleeves of the present disclosure.

Because conventional rotary expansion devices and methods may damage and thereby compromise the threaded connections between adjacent tubular members during a radial expansion operation, the use of the tubular sleeves of the present exemplary embodiments are particularly advantageous when the adjacent tubular members are radially expanded and plastically deformed using such rotary expansion devices.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus comprising:

a first tubular member comprising an internally threaded end portion;

a second tubular member comprising an externally threaded end portion;

a tubular sleeve that receives and overlaps with the threaded end portions of the first and second tubular members; and an expansion device coupled to an interior of one of the first and second tubular members;

wherein the internally threaded end portion of the first tubular member is threadably coupled to the externally threaded end portion of the second tubular member;

wherein the first and second tubular members are adapted to receive the expansion device;

wherein portions of the first and second tubular members are radially expanded and plastically deformed by the expansion device.

2. The apparatus of claim 1 wherein the internal diameters of the radially expanded and plastically deformed portions of the first and second tubular members are equal.

3. The apparatus of claim 1 wherein the tubular sleeve comprises an internal flange.

4. The apparatus of claim 1 further comprising:

a structure receiving the first tubular member, the second tubular member, the tubular sleeve and the expansion device; and wherein the portions of the first and second tubular members are radially expanded and plastically deformed by the expansion device while in the structure.

5. The apparatus of claim 4 wherein the tubular sleeve is radially expanded and plastically deformed by the expansion device into engagement with the structure.

6. The apparatus of claim 4 wherein the structure comprises a wellbore or a wellbore casing.

7. The apparatus of claim 1 wherein opposite ends of the tubular sleeve are tapered.

8. An apparatus comprising:

a first tubular member comprising a threaded end portion;

a second tubular member comprising a threaded end portion;

a tubular sleeve that receives, overlaps with, and is coupled to the threaded end portions of the first and second tubular members; and an expansion device coupled to an interior of one of the first and second tubular members;

wherein the threaded end portion of the first tubular member is threadably coupled to the threaded end portion of the second tubular member;

wherein the first and second tubular members are adapted to receive the expansion device;

wherein portions of the first and second tubular members are radially expanded and plastically deformed by the expansion device;

wherein the internal diameters of the radially expanded and plastically deformed portions of the first and second tubular members are equal.

9. The apparatus of claim 8 wherein the tubular sleeve comprises an internal flange that abuts the ends faces of the threaded ends of the first and second tubular members.

10. The apparatus of claim 8 wherein the tubular sleeve includes one or more sealing members for sealing an interface between the interior surface of the tubular sleeve and the exterior surfaces of at least one of the first and second tubular members.

11. The apparatus of claim 8 further comprising a structure defining an opening for receiving the first and second tubular members and the tubular sleeve, wherein the tubular sleeve includes one or more sealing members for sealing an interface between the tubular sleeve and the structure.

12. The apparatus of claim 8 further comprising one or more retaining members for coupling the ends of the tubular sleeve to the exterior surfaces of the first and second tubular members.

13. The apparatus of claim 8 wherein the ends of the tubular sleeve are deformed into engagement with the exterior surfaces of the first and second tubular members.

14. The apparatus of claim 8 further comprising:

one or more first resilient locking members for locking the first tubular member to the tubular sleeve; and one or more second resilient locking members for locking the second tubular member to the tubular sleeve.

15. A method of radially expanding and plastically deforming a first tubular member and a second tubular member comprising:

inserting an externally threaded end portion of the first tubular member into an end of a tubular sleeve;

inserting an internally threaded end portion of the second tubular member into another end of the tubular sleeve;

threadably coupling the threaded end portions of the first and second tubular members within the tubular sleeve; and displacing an expansion device through the interiors of the first and second tubular members to radially expand and plastically deform portions of the first and second tubular members.

16. The method of claim 15 wherein the internal diameters of the radially expanded and plastically deformed portions of the first and second tubular members are equal.

17. The method of claim 16 further comprising abutting a portion of the first tubular member and an end face of an internal flange of the tubular sleeve, and abutting a portion of the second tubular member and another end face of the internal flange of the tubular sleeve.

18. The method of claim 15 further comprising:

positioning the first tubular member, the second tubular member, the tubular sleeve, and the expansion device within a wellbore or wellbore casing; and then displacing the expansion device through the interiors of the first and second tubular members.

19. The method of claim 18 further comprising radially expanding the tubular sleeve into engagement with the wellbore or wellbore casing.

20. The method of claim 15 further comprising:

coupling the end of the tubular sleeve to the threaded end portion of the first tubular member; and coupling the other end of the tubular sleeve to the threaded end portion of the second tubular member.

21. The method of claim 15 wherein coupling the ends of the tubular sleeve to the ends of the first and second tubular members comprises any one or more of:

coupling the ends of the tubular sleeve to the ends of the first and second tubular members using locking rings;

coupling the ends of the tubular sleeve to the ends of the first and second tubular members using retaining members;

crimping the ends of the tubular sleeve onto the ends of the first and second tubular members; or heating the tubular sleeve and inserting the ends of the first and second tubular members into the tubular sleeve.

* * * * *